US009086647B2

(12) United States Patent
Sakashita et al.

(10) Patent No.: US 9,086,647 B2
(45) Date of Patent: Jul. 21, 2015

(54) DEVELOPING DEVICE THAT SUPPRESSES HYSTERESIS

(71) Applicants: Shingo Sakashita, Shizuoka (JP); Junichi Awamura, Shizuoka (JP); Tsuneyasu Nagatomo, Shizuoka (JP); Satoshi Kojima, Shizuoka (JP); Tomoki Murayama, Kanagawa (JP)

(72) Inventors: Shingo Sakashita, Shizuoka (JP); Junichi Awamura, Shizuoka (JP); Tsuneyasu Nagatomo, Shizuoka (JP); Satoshi Kojima, Shizuoka (JP); Tomoki Murayama, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 59 days.

(21) Appl. No.: 14/022,691

(22) Filed: Sep. 10, 2013

(65) Prior Publication Data

US 2014/0072349 A1 Mar. 13, 2014

(30) Foreign Application Priority Data

Sep. 12, 2012 (JP) ..... 2012-200356

(51) Int. Cl.
*G03G 15/09* (2006.01)
*G03G 15/08* (2006.01)
(Continued)

(52) U.S. Cl.
CPC ..... *G03G 15/0822* (2013.01); *G03G 9/09716* (2013.01); *G03G 9/09725* (2013.01); *G03G 9/10* (2013.01); *G03G 9/107* (2013.01);
(Continued)

(58) Field of Classification Search
CPC ..... G03G 9/09708; G03G 9/09716; G03G 9/09725; G03G 9/09791; G03G 9/08; G03G 9/09733; G03G 9/09783; G03G 9/0827; G03G 9/0819; G03G 9/0821; G03G 9/107; G03G 9/1075; G03G 15/0822; G03G 9/10
USPC ..... 399/222, 267, 276, 277, 290; 430/111.4, 111.41
See application file for complete search history.

(56) References Cited

U.S. PATENT DOCUMENTS 5,672,455 A * 9/1997 Yanagida et al. ..... 430/111.1
6,104,903 A * 8/2000 Hara et al. ..... 399/265
(Continued)

FOREIGN PATENT DOCUMENTS

JP 11-065247 3/1999
JP 3005081 11/1999
(Continued)

OTHER PUBLICATIONS

U.S. Appl. No. 13/729,926, filed Dec. 28, 2012.
(Continued)

*Primary Examiner* — Francis Gray
(74) *Attorney, Agent, or Firm* — Oblon, McClelland, Maier & Neustadt, L.L.P.

(57) ABSTRACT

A developing device, including: a developer bearing member, which is disposed opposite to an electrostatic latent image bearing member and which bears thereon a developer for developing an electrostatic latent image formed on the electrostatic latent image bearing member and conveys the developer to a developing region, wherein the developer includes a toner and a carrier, the toner containing: a toner base containing a binder resin and a colorant; and an external additive, wherein the external additive contains coalescent particles each made up of a plurality of coalescing primary particles, and wherein a work function Wc of the carrier and a work function Ws of the developer bearing member satisfy a relationship of the following formula (1):

$$Ws-Wc \geq 0.4 \text{ eV} \quad (1).$$

10 Claims, 8 Drawing Sheets

(51) Int. Cl.

| | |
|---|---|
| ***G03G 9/097*** | (2006.01) |
| ***G03G 9/10*** | (2006.01) |
| ***G03G 9/107*** | (2006.01) |
| ***G03G 9/113*** | (2006.01) |

(52) U.S. Cl.
CPC ..... *G03G 9/1075* (2013.01); *G03G 9/1132* (2013.01); *G03G 9/1139* (2013.01)

(56) References Cited

U.S. PATENT DOCUMENTS

| | | | | |
|---|---|---|---|---|
| 7,374,851 | B2 | 5/2008 | Nakayama et al. | |
| 7,455,942 | B2 | 11/2008 | Nagatomo et al. | |
| 7,504,188 | B2 | 3/2009 | Yamada et al. | |
| 2004/0146795 | A1 | 7/2004 | Emoto et al. | |
| 2004/0248025 | A1* | 12/2004 | Miyakawa | 430/107.1 |
| 2005/0112488 | A1 | 5/2005 | Yamada et al. | |
| 2005/0208404 | A1* | 9/2005 | Miyakawa et al. | 430/108.1 |
| 2006/0040195 | A1* | 2/2006 | Miyakawa et al. | 430/108.7 |
| 2007/0218383 | A1* | 9/2007 | Seshita et al. | 430/108.1 |
| 2007/0275315 | A1 | 11/2007 | Nagatomo et al. | |
| 2008/0070144 | A1 | 3/2008 | Nagatomo et al. | |
| 2008/0076055 | A1 | 3/2008 | Sawada et al. | |
| 2008/0213682 | A1 | 9/2008 | Saitoh et al. | |
| 2008/0226998 | A1 | 9/2008 | Ishii et al. | |
| 2008/0227018 | A1 | 9/2008 | Awamura et al. | |
| 2008/0268366 | A1 | 10/2008 | Nakayama et al. | |
| 2008/0280218 | A1 | 11/2008 | Sabu et al. | |
| 2008/0280219 | A1 | 11/2008 | Nakayama et al. | |
| 2008/0292361 | A1 | 11/2008 | Seshita et al. | |
| 2008/0311500 | A1 | 12/2008 | Yamada et al. | |
| 2009/0117480 | A1 | 5/2009 | Yamada et al. | |
| 2009/0142094 | A1 | 6/2009 | Sawada et al. | |
| 2009/0142682 | A1 | 6/2009 | Saitoh et al. | |
| 2009/0280421 | A1 | 11/2009 | Awamura et al. | |
| 2010/0075245 | A1 | 3/2010 | Watanabe et al. | |
| 2010/0119255 | A1 | 5/2010 | Seshita et al. | |
| 2010/0183967 | A1 | 7/2010 | Sabu et al. | |
| 2010/0216068 | A1 | 8/2010 | Kotsugai et al. | |
| 2010/0330489 | A1 | 12/2010 | Inoue et al. | |
| 2011/0065036 | A1 | 3/2011 | Inoue et al. | |
| 2011/0076607 | A1 | 3/2011 | Sugimoto et al. | |
| 2011/0104608 | A1 | 5/2011 | Nakajima et al. | |
| 2011/0124838 | A1 | 5/2011 | Kotsugai et al. | |
| 2011/0262853 | A1 | 10/2011 | Watanabe et al. | |
| 2011/0281213 | A1 | 11/2011 | Sakashita et al. | |
| 2011/0294058 | A1 | 12/2011 | Shiba et al. | |
| 2012/0082926 | A1 | 4/2012 | Suzuki et al. | |
| 2012/0288791 | A1 | 11/2012 | Sakashita et al. | |
| 2013/0011779 | A1 | 1/2013 | Yamashita et al. | |
| 2013/0017480 | A1 | 1/2013 | Suzuki et al. | |
| 2013/0065171 | A1 | 3/2013 | Yaguchi et al. | |
| 2013/0130171 | A1 | 5/2013 | Watanabe et al. | |
| 2013/0157183 | A1 | 6/2013 | Santo et al. | |
| 2013/0157185 | A1 | 6/2013 | Sakashita et al. | |
| 2013/0252166 | A1* | 9/2013 | Yanagida | 430/109.4 |

FOREIGN PATENT DOCUMENTS

| | | |
|---|---|---|
| JP | 3126433 | 11/2000 |
| JP | 2013-057817 | 3/2013 |

OTHER PUBLICATIONS

U.S. Appl. No. 13/709,185, filed Dec. 10, 2012.

* cited by examiner

DEVELOPING DEVICE THAT SUPPRESSES HYSTERESIS

BACKGROUND OF THE INVENTION

1. Field of the Invention

The present invention relates to a developing device and an image forming apparatus to be used for electrophotographic image formation such as a copier, electrostatic printing, a facsimile, a printer, and electrostatic recording.

2. Description of the Related Art

In image formation by electrophotography, an electrostatic charge image (latent image) is formed on an electrostatic latent image bearing member, the latent image is developed by use of a charged toner to form a toner image, and then the toner image is transferred onto a recording medium such as paper, and fixed by a method such as heating to obtain an output image.

Recently, image forming apparatuses by electrophotography have come to be used also in the field of commercial printing, so-called production printing, and image forming apparatuses that are higher in speed and capable of forming high-quality full-color images have been demanded.

One of the important challenges in obtaining a high-quality full-color image is to continuously supply a toner amount according to a desired image density onto an electrostatic latent image bearing member in order to reproduce a latent image on the electrostatic latent image bearing member exactly by toner.

For example, in terms of a one-component developing system, a phenomenon (fading phenomenon) has been reported in which a band-like part with a low image density is produced when the same image patterns are continuously output. This fading phenomenon occurs mainly because a low-charged toner, due to friction with the surface of a developer bearing member (developing sleeve), slips through a concentrated magnetic field formed by magnets in the developing sleeve and a blade (doctor blade) for regulating the toner layer thickness to be conveyed to a developing region as a part of a toner layer, and does not move onto an electrostatic latent image bearing member even when having received a developing electric field. Therefore, in Japanese Patent No. 3005081 and Japanese Patent No. 3126433, by using an image forming apparatus composed of a developing sleeve having a surface layer with an inclination $\gamma$ of 10 or more in a work function measurement, formed of a resin layer containing conductive fine particles or a solid lubricant and toner whose weight-average particle diameter, fine powder content by percentage, coarse powder content by percentage, and MI (melt index) value have been controlled to specific ranges or an image forming apparatus composed of the developing sleeve and toner having a silicone oil- or silicone varnish-treated external additive, the toner can be stably charged to a desired value even in a high-temperature and high-humidity environment, and conveying to a developing region only a toner with an appropriate charge amount not by friction between the toner and developing sleeve surface but by an image force acting between the toner and developing sleeve prevents a fading phenomenon.

Also in terms of a two-component developing system more suitable for a higher-speed image forming apparatus, it has been reported that, when a developer is used for a long period of time, a hysteresis occurs in which the developing performance declines to reduce image density (Japanese Patent Application Laid-Open (JP-A) No. 11-065247). The hysteresis in the two-component developing system disclosed therein is caused by the fact that releasing of a two-component developer is not normally performed. Releasing of the developer is performed by providing magnets in odd numbers in a developing sleeve and providing a magnet pair of the same polarity at a position lower than the rotating axis of the developing sleeve to form a releasing region that has nearly zero magnetic force, and causing the developer after development to naturally fall using gravity in the region. However, as a result of a counter charge being generated in a carrier during toner consumption for a preceding image, an image force is generated between the carrier and developer bearing member, and the developer is not released normally. Therefore, the developer with a toner concentration lowered due to toner consumption is again conveyed to the developing region, and the developing performance declines. That is, there is a problem that the image density is normal for one round of the sleeve, whereas the second round onward results in a low image density. To cope therewith, JP-A No. 11-065247 mentioned above has proposed a method in which a draw-up roll having magnets inside is disposed near a releasing region on the developing sleeve, and releasing of the developer after development is performed by means of a magnetic force thereof. The released developer is drawn up by another draw-up roll and then conveyed to a developer stirring chamber having screws, and a re-adjustment of the toner concentration and toner charging are therein performed. However, in the above-described proposal, there has been a problem that an initial hysteresis can indeed be eliminated, but in the case of continuous use over time, a sufficient effect cannot be exerted, and a hysteresis occurs.

The present inventors have discovered, in the course of studying an image forming apparatus that is high speed and capable of forming high-quality full-color images, there is a problem, as another hysteresis in the two-component developing system, that a toner remaining without being developed in the developing region is not collected together with the carrier, and remains adhered on the developer bearing member, and when the remaining toner is again conveyed as it is to the developing region together with a newly drawn-up developer at the next development, an image density difference occurs depending on whether there is remaining toner on the developer bearing member. This hysteresis is considered to occur when the adhesion force between the toner and developer bearing member has become greater than the adhesion force between the toner and carrier. This tendency becomes prominent when a developer is continuously stirred over time under conditions where the toner consumption is small, and becomes more prominent in the case of, particularly, a high-speed machine. Moreover, in response to the recent demand for energy saving, low-temperature fixing of toner has been promoted, and as one of the means therefor, there have been made many proposals to add into toner a crystalline resin (particularly, a crystalline polyester resin) that indicates a sharp melt property to the temperature, but this hysteresis tends to be more prominent in an image forming apparatus using such a low-temperature fixing toner.

SUMMARY OF THE INVENTION

It is an object of the present invention to provide a developing device that allows obtaining high-quality full-color images by effectively suppressing such hystereses not only initially but also over time.

A developing device as a means for solving the problems mentioned above includes a developer bearing member, which is disposed opposite to an electrostatic latent image bearing member and which bears thereon a developer for developing an electrostatic latent image formed on the electrostatic latent image bearing member and conveys the developer to a developing region, wherein the developer includes a toner and a carrier, the toner containing: a toner base containing a binder resin and a colorant; and an external additive, wherein the external additive contains coalescent particles each made up of a plurality of coalescing primary particles, and wherein a work function Wc of the carrier and a work function Ws of the developer bearing member satisfy a relationship of the following formula (1):

$$Ws-Wc \geq 0.4 \text{ eV} \quad (1)$$

The present invention can provide a developing device that can solve the various conventional problems mentioned above, and allows obtaining high-quality full-color images by effectively suppressing hystereses in a two-component developing system not only initially but also over time.

DETAILED DESCRIPTION OF THE INVENTION

Figure 1:
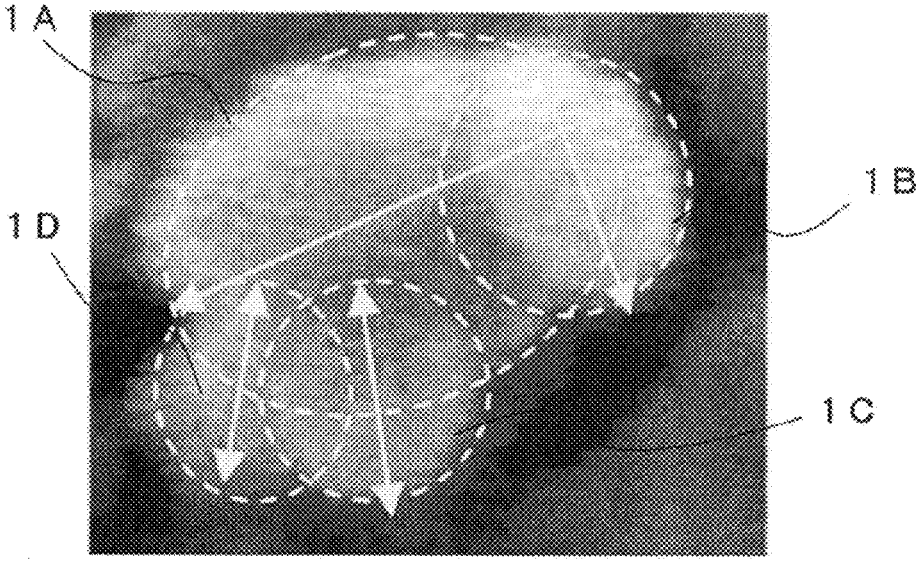
FIG. 1 is a photograph showing an example of a toner external additive in the present invention.

A toner, a carrier, a developer bearing member that constitute a developing device of the present invention will be described. Also, it is easy for so-called persons skilled in the art to modify and alter the present invention within the scope of claims so as to carry out another embodiment, these modifications and alterations are included in this scope of claims, and the following description is an example of the best mode of the present invention, and by no means limits this scope of claims.

(Developing Device)

The developing device of the present invention includes: a developer made of at least a toner and a carrier; and a developer bearing member.

As a result of intensive studies made in view of the problems mentioned above, the present inventors have discovered that hystereses can be suppressed not only initially but also over time by a developing device including a developer bearing member that is disposed opposite to an electrostatic latent image bearing member, and bears thereon a developer for developing an electrostatic latent image formed on the electrostatic latent image bearing member and conveys the developer to a developing region, wherein the developer includes a toner and a carrier, the toner containing: a toner base containing a binder resin and a colorant; and an external additive, and the external additive contains coalescent particles each made up of a plurality of coalescing primary particles, and a work function Wc of the carrier and a work function Ws of the developer bearing member satisfy a relationship of the following formula (1):

$$Ws-Wc \geq 0.4 \text{ eV} \quad (1)$$

In the developing device of the present invention, the work function Wc of a carrier and the work function Ws of a developer bearing member satisfy the relationship of the above formula (1).

It is considered that the occurrence of a hysteresis in a two-component system as a problem in the present invention relates to an adhesion force Ftc between the toner and carrier and an adhesion force Fts between the toner and developer bearing member, and is considered that, when Fts has become greater than Ftc, a toner remaining without being developed in the developing region is not normally held on the carrier, and remains adhered on the developer bearing member, and when the remaining toner is again conveyed as it is to the developing region together with a newly drawn-up developer at the next development, an image density difference occurs depending on whether there is remaining toner on the developer bearing member, which appears as a hysteresis. Wc in the above formula (1) relates to an electrostatic adhesion force between the toner and carrier, and Ws relates to an electrostatic adhesion force between the toner and developer bearing member. Wc contributes to the value of a charge amount when the toner and carrier are frictionally charged, and has a tendency, as a result of becoming smaller in value, to increase the charge amount of the toner due to frictional charging so as to increase the electrostatic adhesion force between the toner and carrier, thereby making it easy to hold the toner on the carrier normally. On the other hand, Ws is considered to contribute to a charge movement between the toner and developer bearing member when a charged toner held on the carrier has made contact with the developer bearing member, and has a tendency, as a result of becoming greater in value, that the charge moving amount from the toner to the developer bearing member increases in the vicinity of a contact point between the charged toner and developer bearing member, which reduces the electrostatic adhesion force between the toner and developer bearing member. As a result of these relationships satisfying the relationship of the above formula (1), the adhesion force between the toner and carrier becomes greater than the adhesion force between the toner and developer bearing member, and the occurrence of a hysteresis can be suppressed.

The carrier work function Wc and the developer bearing member work function Ws can be measured by use of, for example, a work function measuring device (Surface Analyzer AC-2, manufactured by Riken Keiki Co., Ltd.) using a photoelectric effect. Specifically, a carrier was filled into a recess portion of a sample measurement cell (having a shape having a recess portion with a diameter of 10 mm and a depth of 1 mm in the center of a stainless steel-made disk with a diameter of 13 mm and a height of 5 mm), and the surface is smoothed by a knife edge. After the sample measurement cell filled with a carrier is fixed to a defined position on a sample table, the irradiation light amount is set to 500 nW, the irradiation area is provided as 4 mm square, and a measurement is performed under a condition of an energy scanning range of 3.4 eV to 6.2 eV.

(Developer Bearing Member)

The developer bearing member of the present invention is not particularly limited as long as it satisfies the relationship of the above formula (1), and conventionally known various developer bearing members can be used. The work function Ws of the developer bearing member in the above formula (1) is determined by a surface material for forming the developer bearing member, and as the material for forming the developer bearing member, for example, Al (Ws: 3.7 eV), SUS (Ws: 4.4 eV), TiN (Ws: 4.7 eV), etc., can be used.

(Toner)

The toner of the present invention includes a toner base and an external additive, and further includes other components according to necessity.

<External Additive>

The external additive is not particularly limited as long as it contains coalescent particles made up of pluralities of coalescing primary particles, and can be appropriately selected according to the purpose.

By controlling the particle size distribution and breakability of coalescent particles as an external additive to the following specific ranges, coalescent particles on the toner surface are held without being buried or separated even against a steering stress over time, an increase in non-electrostatic adhesion force between the toner and developer bearing member is suppressed, and the occurrence of a hysteresis can be suppressed over time even in a toner high-speed machine.

<<Coalescent Particle>>

The coalescent particle is a non-spherical particle made up of a plurality of coalescing primary particles, that is, as shown in FIG. 1, a particle for which primary particles (reference signs 1A to 1D) coalesce in plural numbers into one and those primary particles have coalescent parts overlapping each other, and is different from a state of primary particles simply maintaining their shapes while aggregating each other. Also, the "coalescent particle" is sometimes called a "secondary particle."

—Primary Particle—

The primary particle is not particularly limited and can be appropriately selected according to the purpose, and examples thereof include inorganic fine particles such as silica, alumina, titanium oxide, barium titanate, magnesium titanate, calcium tinatate, strontium titanate, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, and silicon nitride and organic fine particles. These may be used alone or in combination of two or more. Among these, silica is preferable in consideration of being able to prevent burying and separation of an external additive into and from toner base particles.

An average particle diameter (Da) of the primary particles is not particularly limited and can be appropriately selected according to the purpose, but this is preferably 20 nm to 150 nm, and more preferably, 35 nm to 150 nm. Where the average particle diameter of the primary particles is less than 20 nm, there is a case where, as a result of that burying of the external additive into the toner base due to an external stress cannot be sufficiently suppressed, which no longer allows exhibiting a function as spacers, the non-electrostatic adhesion force between the toner and developer bearing member increases to cause a hysteresis easily, which is not preferable. On the other hand, where it exceeds 150 nm, freedom from the toner is likely to occur, and this may easily cause photoconductor filming, which is not preferable.

An average particle diameter (Da) of the primary particles is determined based on the particle diameters (lengths of all arrows shown in FIG. 1) of primary particles in the coalescent particles. The determination is performed, with a sample for which the secondary particles are dispersed in an appropriate solvent (THF or the like), and then the solvent is removed for drying and hardening on a substrate, by measuring the particle diameters of primary particles in a field of view by using a field emission-scanning electron microscope (FE-SEM, accelerating voltage: 5 kV to 8 kV, observation magnification: 8,000× to 10,000×). Determination of the particle diameters of primary particles is performed by estimating whole pictures from the outer frames of coalescent particles, and measuring an average value of the maximum lengths (lengths of all arrows shown in FIG. 1) of the whole pictures (the number of particles measured: 100 or more and 200 or less).

—Secondary Particle—

The secondary particle is not particularly limited and can be appropriately selected according to the purpose, but as shown by reference sign 1 of FIG. 3, this is preferably a particle (secondary-aggregated particle) for which the primary particles are chemically bonded by a treatment agent to be described later, and more preferably, a particle for which the primary particles are chemically bonded by a sol-gel method, and specifically, sol-gel silica and the like can be mentioned.

An average particle diameter (Dba) of the secondary particles, that is, a number-average particle diameter of the coalescent particles is not particularly limited and can be appropriately selected according to the purpose, but this is preferably 80 nm to 200 nm, and more preferably, 100 nm to 180 nm, and particularly preferably, 100 nm to 160 nm. Where the number-average particle diameter is less than 80 nm, there is a case where as a result of that burying of the external additive into the toner base due to an external stress cannot be sufficiently suppressed, which no longer allows exhibiting a function as spacers, the non-electrostatic adhesion force between the toner and developer bearing member increases to cause a hysteresis easily, which is not preferable. On the other hand, where it exceeds 200 nm, freedom from the toner is likely to occur, and this may easily cause photoconductor filming, which is not preferable.

Figure 2:
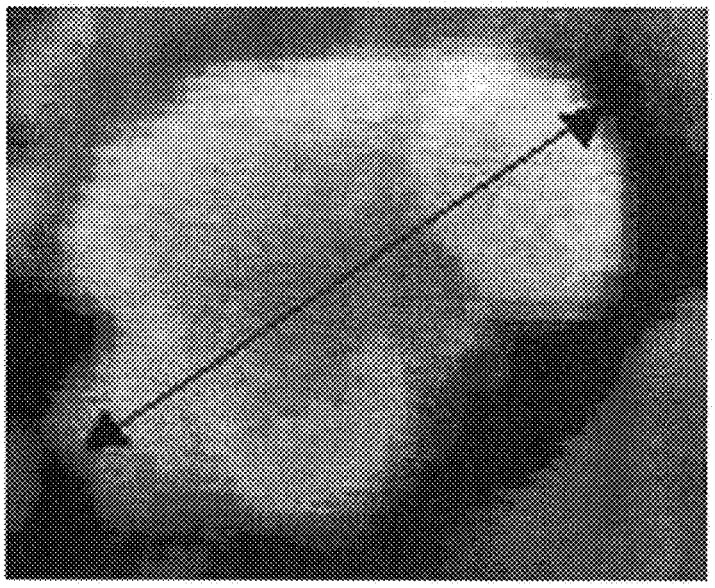
FIG. 2 is a photograph showing an example of a toner external additive in the present invention.

Determination of the number-average particle diameter (Dba) of secondary particles is performed, with a sample for which the secondary particles are dispersed in an appropriate solvent (THF or the like), and then the solvent is removed for drying and hardening on a substrate, by measuring the particle diameters of secondary particles in a field of view by using a field emission-scanning electron microscope (FE-SEM, accelerating voltage: 5 kV to 8 kV, observation magnification: 8,000× to 10,000×), and specifically, is performed by estimating whole pictures from the outer frames of coalescing secondary particles, and measuring the maximum lengths (length of the arrow shown in FIG. 2) of the whole pictures (the number of particles measured: 100 or more).

—Production Method for Coalescent Particles—

A method for producing the coalescent particles is not particularly limited and can be appropriately selected according to the purpose, but this is preferably a method for production by a sol-gel method, and specifically, preferably a method for production by chemical bonding through mixing or firing of primary particles and a treatment agent to cause secondary aggregation so as to provide secondary particles (coalescent particles). Also, in the case of synthesis by the sol-gel method, coalescent particles may be prepared in a single-stage reaction under coexistence of the treatment agent. A production example will be mentioned in the following, but the production method is not limited thereto.

--Treatment Agent--

The treatment agent is not particularly limited and can be appropriately selected according to the purpose, and examples thereof include silane-based treatment agents and epoxy-based treatment agents. These may be used alone or in combination of two or more. When silica is used as the primary particles, a silane-based treatment agent is preferable in consideration that Si—O—Si bonds formed by the silane-based treatment agents are more stable to heat than Si—O—C bonds formed by the epoxy-based treatment agents. Moreover, a treatment aid (water, a 1% by mass aqueous solution of acetic acid, or the like) may be used according to necessity.

---Silane-Based Treatment Agent---

The silane-based treatment agent is not particularly limited, and can be appropriately selected according to the purpose, and examples thereof include mixtures of alkoxysilanes (tetramethoxysilane, tetraethoxysilane, methyltrimethoxysilane, methyltriethoxysilane, dimethyldimethoxysilane, dimethyldiethoxysilane, methyldimethoxysilane, methyldiethoxysilane, diphenyldimethoxysilane, isobutyltrimethoxysilane, decyltrimethoxysilane, and the like); silane coupling agents (γ-aminopropyltriethoxysilane, γ-glycidoxypropyltrimethoxysilane, γ-glycidoxypropylmethyldiethoxysilane, γ-methacryloxypropyltrimethoxysilane, γ-mercaptopropyltrimethoxysilane, vinyltriethoxysilane, methylvinyldimethoxysilane, and the like); vinyltrichlorosilane, dimethyldichlorosilane, methyl vinyl dichlorosilane, methyl phenyl dichlorosilane, phenyltrichlorosilane, N,N'-bis(trimethyl silyl)urea, N,O-bis(trimethylsilyl)acetamide, dimethyltrimethylsilylamine, hexamethyldisilazane, and cyclic silazane.

The silane-based treatment agent causes, as in the following, chemical bonding of the primary particles (for example, silica primary particles) to form a secondary aggregation.

When the silica primary particles are treated using the alkoxysilanes, the silane-based coupling agents, and the like as the silane-based treatment agent, as shown in the following formula (A), silanol groups bonding to the silica primary particles and alkoxy groups bonding to the silane-based treatment agent react, and due to dealcoholization, form new Si—O—Si bonds to cause secondary aggregation.

When the silica primary particles are treated using the chlorosilanes as the silane-based coupling agent, chloro groups of the chlorosilanes and silanol groups bonding to the silica primary particles, due to a dehydrochlorination reaction, and new Si—O—Si-bonding silanol groups, due to a dehydration reaction, form new Si—O—Si bonds to cause secondary aggregation. On the other hand, when the silica primary particles are treated using the chlorosilanes as the silane-based coupling agent, under coexistence of water in the system, the chlorosilanes are first hydrolyzed into water to yield silanol groups, and the silanol groups and silanol groups bonding to the silica primary particles, due to a dehydration reaction, form new Si—O—Si bonds to cause secondary aggregation.

When the silica primary particles are treated using silazanes as the silane-based coupling agent, amino groups and silanol groups bonding to the silica primary particles, due to deammoniation, form new Si—O—Si bonds to cause secondary aggregation.

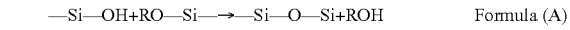

Formula (A)

In the above formula (A), R denotes an alkyl group.

---Epoxy-Based Treatment Agent---

The epoxy-based treatment agent is not particularly limited and can be appropriately selected according to the purpose, and examples thereof include bisphenol A type epoxy resins, bisphenol F type epoxy resins, phenol novolac type epoxy resins, cresol novolac type epoxy resins, bisphenol A novolac type epoxy resins, biphenol type epoxy resins, glycidylamine type epoxy resins, and alicyclic epoxy resins.

The epoxy-based treatment agent causes, as shown in the following formula (B), chemical bonding of the silica primary particles to form a secondary aggregation. When the silica primary particles are treated using the epoxy-based treatment agent, silanol groups bonding to the silica primary particles, due to addition of epoxy group oxygen atoms of the epoxy-based treatment agent and carbon atoms bonding to the epoxy groups, form new Si—O—Si bonds to cause secondary aggregation.

Formula (B)

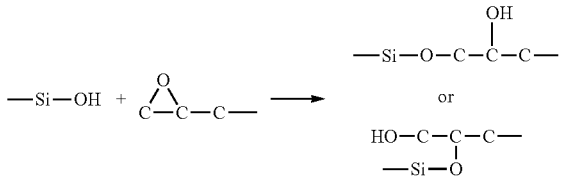

A mass mixing ratio (primary particles:treatment agent) of the treatment agent and the primary particles is not particularly limited and can be appropriately selected according to the purpose, but this is preferably 100:0.01 to 100:50. Also, there is a tendency that the larger the amount of the treatment agent, the higher the degree of coalescence.

A method for mixing the treatment agent and the primary particles is not particularly limited and can be appropriately selected according to the purpose, and examples thereof include a method for mixing by a known mixer (spray dryer or the like). Also, in the case of mixing, the primary particles may be prepared and then mixed with the treatment agent for preparation, or the treatment agent may coexist in preparation of the primary particles to carry out preparation in a single-stage reaction.

A firing temperature of the treatment agent and the primary particles is not particularly limited and can be appropriately selected according to the purpose, but this is preferably 100° C. to 2,500° C. Also, there is a tendency that the higher the amount of the firing temperature, the higher the degree of coalescence.

A firing time of the treatment agent and the primary particles is not particularly limited and can be appropriately selected according to the purpose, but this is preferably 0.5 hours to 30 hours.

—Particle Size Distribution Index of Coalescent Particles—

Using particles that satisfy the following formula (2) as a particle size distribution index of the coalescent particles results in a sharp particle size distribution of coalescent particles. Accordingly, the rate of particles that function as spacers without being buried into the toner base due to an external stress is increased, which allows more effectively suppressing an increase in non-electrostatic adhesion force between the toner and developer bearing member, thereby suppressing the occurrence of a hysteresis.

$$\frac{Db_{50}}{Db_{10}} \leq 1.2 \quad (2)$$

In the above formula (2), in a distribution diagram in which particle diameters (nm) of the coalesced particles are on the horizontal axis and cumulative percentages (% by number) of the coalesced particles are on the vertical axis and in which the coalesced particles are accumulated from the coalesced particles having smaller particle diameters to the coalesced particles having larger particle diameters, $Db_{50}$ denotes a particle diameter of the coalesced particle at which the cumulative percentage is 50% by number, and $Db_{10}$ denotes a particle diameter of the coalesced particle at which the cumulative percentage is 10% by number.

The $Db_{50}$ is determined based on the distribution diagram in which the particle diameters of the coalesced particles (nm) are on the horizontal axis and the cumulative percentages (% by number) are on the vertical axis. When the number of the measured coalesced particles is 200, the $Db_{50}$ is a particle diameter of the $100^{th}$ largest particle. When the number of the measured coalesced particles is 150, the $Db_{50}$ is a particle diameter of the $75^{th}$ largest particle.

The $Db_{50}$ is measured as follows. Firstly, the coalesced particles are dispersed in an appropriate solvent (e.g., tetrahydrofuran (THF)). The resultant dispersion liquid is subjected to solvent removal to dryness on a substrate to thereby obtain a measurement sample. The measurement sample is observed under a field emission type scanning electron microscope (FE-SEM, acceleration voltage: 5 kV to 8 kV, observed magnification: 8,000 to 10,000), and measured for particle diameters of the coalesced particles within a field of vision to thereby determine a particle diameter of a coalesced particle at which the cumulative percentage is 50% by number. The particle diameters of the coalesced particles are determined by measuring maximum diameters of the aggregated particles (length of an arrow shown in FIG. 2) (the number of measured aggregated particles: 100 or more and 200 or less).

The $Db_{10}$ is determined based on the distribution diagram in which the particle diameters of the coalesced particles (nm) are on the horizontal axis and the cumulative percentages (% by number) are on the vertical axis. When the number of the measured coalesced particles is 200, the $Db_{10}$ is a particle diameter of the $20^{th}$ largest particle. When the number of the measured coalesced particles is 150, the $Db_{10}$ is a particle diameter of the $15^{th}$ largest particle.

The $Db_{10}$ is measured as follows. Firstly, the coalesced particles are dispersed in an appropriate solvent (e.g., tetrahydrofuran (THF)). The resultant dispersion liquid is subjected to solvent removal to dryness on a substrate to thereby obtain a measurement sample. The measurement sample is observed under a field emission type scanning electron microscope (FE-SEM, acceleration voltage: 5 kV to 8 kV, observed magnification: 8,000 to 10,000), and measured for particle diameters of the coalesced particles within a field of vision to thereby determine a particle diameter of a coalesced particle at which the cumulative percentage is 10% by number. The particle diameters of the coalesced particles are determined by measuring maximum diameters of the aggregated particles (length of an arrow shown in FIG. 2) (the number of measured aggregated particles: 100 or more and 200 or less).

The "$Db_{50}/Db_{10}$" is preferably 1.2 or less, and more preferably, 1.15 or less. Where the "$Db_{50}/Db_{10}$" exceeds 1.2, the particle size distribution of coalescent particles is broad, and many small-diameter particles are included. That is, this means that at least either "small-diameter particles A" (particles whose coalescence has not proceeded, and which exist in a state of primary particles) or "small-diameter particles B" (particles whose coalescence has proceeded, but the primary particles themselves have small diameters) exist in large numbers. Where the "small-diameter particles A" exist in large numbers, because the coalescent particles cannot sufficiently perform the function as a non-spherical external additive and are inferior in burying resistance, there is a case where an increase in non-electrostatic adhesion force between the toner and developer bearing member particularly over time cannot be suppressed, and a hysteresis easily occurs, which is therefore not preferable. On the other hand, where the "small-diameter particles B" exist in large numbers, because the coalescent particles cannot perform the function as spacers, there is a case where an increase in non-electrostatic adhesion force between the toner and developer bearing member cannot be suppressed, and a hysteresis easily occurs even initially, which is therefore not preferable. Therefore, it is necessary to reduce the "small-diameter particles A" and the "small-diameter particles B."

A method for reducing the "small-diameter particles A" and the "small-diameter particles B" is not particularly limited and can be appropriately selected according to the purpose, but this is preferably a method in which small-diameter particles are removed in advance by classification.

—Breaking Resistance of Coalescent Particle—

The coalescent particle preferably satisfies the following formula (3), and more preferably satisfies the following formula (3-1). Accordingly, the aggregation force (coalescence force) between primary particles to compose a coalescent particle is maintained even against a stirring force in the developing device, so that burying into the toner base does not occur, which allows more effectively suppressing an increase in non-electrostatic adhesion force between the toner and developer bearing member, thereby suppressing the occurrence of a hysteresis not only initially but also over time.

$$\frac{N_x}{1000} \times 100 \leq 30\ (\%) \quad (3)$$

$$\frac{N_x}{1000} \times 100 \leq 20\ (\%) \quad (3\text{-}1)$$

In the above formulas (3) and (3-1), Nx denotes the number of broken or collapsed particles in 1,000 of the coalescent particles. The broken or collapsed particles are selected by stirring 0.5 g of the coalescent particles and 49.5 g of a carrier placed in a 50 mL-bottle by use of a rocking mill (manufactured by Seiwa Giken Co., Ltd.) under the conditions of 67 Hz and for 10 minutes, and then observing the stirred coalescent particles through a scanning electron microscope.

Figure 4:
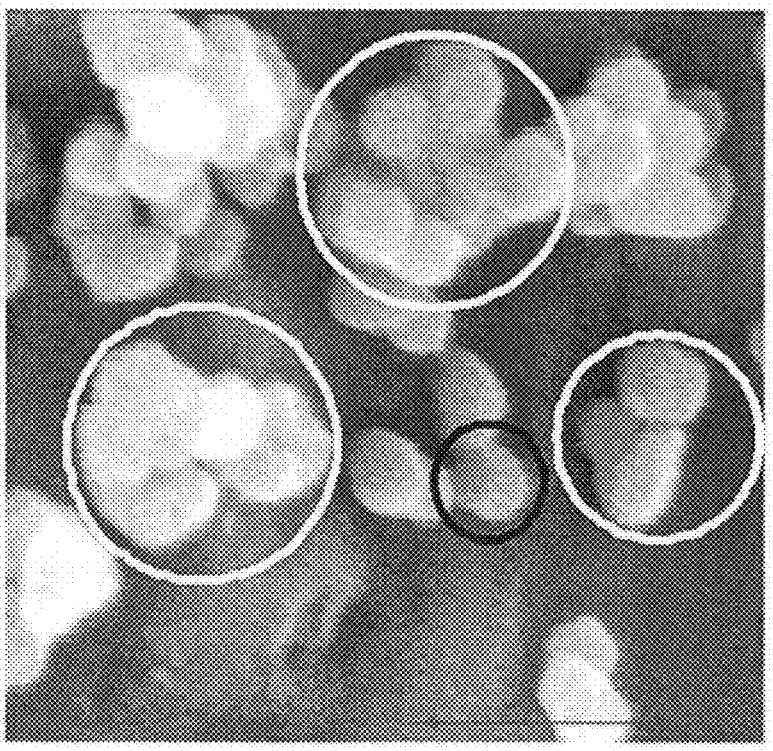
FIG. 4 is a photograph showing an example of an external additive where the rate of broken or collapsed particles in 1,000 coalescent particles is 30% or less. In the figure, the arrow scale indicates 300 nm.

When the coalescent particles have a strong aggregation force (as shown in FIG. 4, when the rate of broken or collapsed particles (for example, the particle shown within a black frame in FIG. 4) in the 1,000 coalescent particles is 30% or less), particles (broken or collapsed particles) an external additive of which in the toner breaks or collapses due to a load of the developing device and the like exist in small numbers, and burying and tumbling of the external additive is suppressed, and the occurrence of a hysteresis over time can be suppressed, which is therefore preferable.

Figure 5:
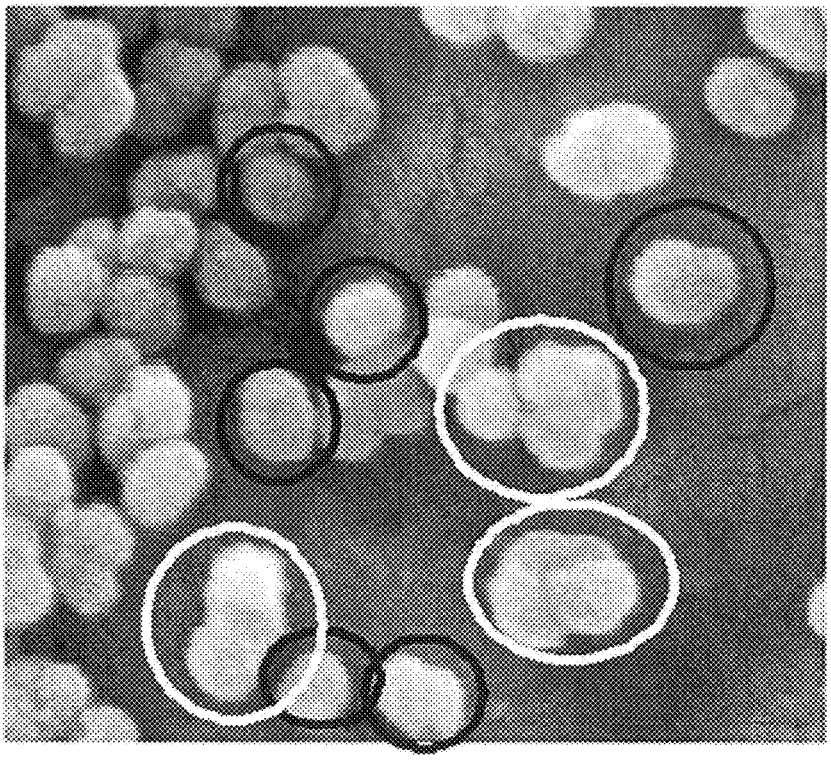
FIG. 5 is a photograph showing an example of an external additive where the rate of broken or collapsed particles in 1,000 coalescent particles exceeds 30%. In the figure, the arrow scale indicates 300 nm.

When the coalescent particles have a weak aggregation force (as shown in FIG. 5, where the rate of broken or collapsed particles (for example, the particles shown within black frames in FIG. 5) in the 1,000 coalescent particles exceeds 30%), particles (broken or collapsed particles) an external additive of which in the toner breaks or collapses due to a load of the developing device and the like exist in large numbers, the rate of spherical particle increase, movement and burying of the external additive easily occurs, and the occurrence of a hysteresis over time can no longer be suppressed in some cases, which is therefore not preferable.

--Formula (3) Conditions--

Figure 3:
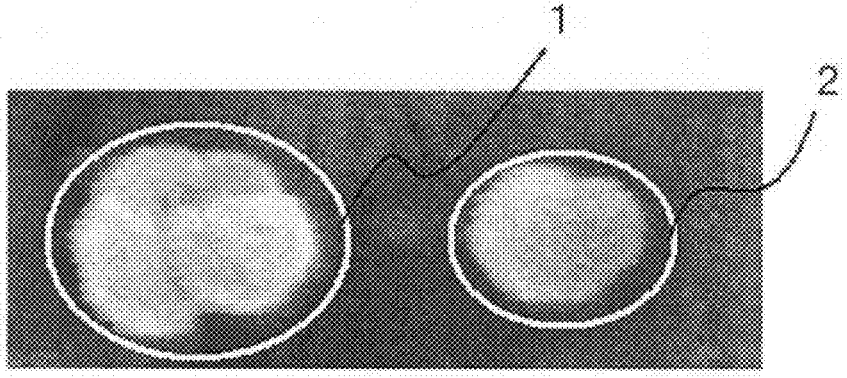
FIG. 3 is a photograph showing an example of a toner external additive in the present invention.

In the above formula (3), the broken or collapsed particles mean particles that exist on their own as the primary particles, and include particles that have become primary particles as a result of a break or collapse having occurred after stirring the coalescent particles under the stirring conditions by use of the rocking mill and particles that have existed independently as the primary particles since before performing the stirring, and examples thereof include, like the particles shown by reference sign 2 of FIG. 3 and within the black frames of FIG. 4 to FIG. 5, particles as which the primary particles exist on their own without being coalesced.

In the above formula (3), the shape of the broken or collapsed particles is not particularly limited as long as it is a shape in which particles are not coalesced with each other, and can be appropriately selected according to the purpose, and for example, as shown by reference sign 2 of FIG. 3, the broken or collapsed particles often exist in substantially spherical states.

In the above formula (3), a method for confirming that the broken or collapsed particles exist is not particularly limited and can be appropriately selected according to the purpose, but this is preferably a method for confirming that particles exist on their own by observation through a scanning electron microscope (SEM).

A method for determining an average particle diameter of the broken or collapsed particles is not particularly limited and can be appropriately selected according to the purpose, but determination is performed by measuring an average value of the particle diameters of the broken or collapsed particles in a field of view by using a scanning electron microscope (FE-SEM, accelerating voltage: 5 kV to 8 kV, observation magnification: 8,000× to 10,000×) (the number of particles measured: 100 or more).

In the above formula (3), as a count of broken or collapsed particles in the 1,000 particles, like the particles shown by reference sign 2 of FIG. 3 and within the black frames of FIG. 4 to FIG. 5, a particle that exists on its own is counted as one broken or collapsed particle by observation through a scanning electron microscope, after the stirring.

In the above formula (3), when counting the number of broken or collapsed particles in the 1,000 particles, where a coalescent particle made up of a plurality of coalescing particles is confirmed by the scanning electron microscope, the coalescent particle is counted as one particle.

As a carrier to be used in the above formula (3), a resin-coated ferrite carrier that is obtained by coating and drying a coating layer forming solution of an acryl resin and silicone resin containing alumina particles to the surface of fired ferrite powder (weight-average particle diameter: 35 μm) is used.

In the above formula (3), the 50 mL-bottle is not particularly limited and can be appropriately selected according to the purpose, and examples thereof include commercially available vials (manufactured by NICHIDEN-RIKA GLASS CO., LTD.).

—Characteristics of Coalescent Particle—

The degree of coalescence is determined by the following formula, in a measurement of the first particle diameter and second particle diameter of the coalescent particle, by determining the secondary particle diameter of a single coalescent particle and an average value of the primary particle diameters of a plurality of primary particles that compose the coalescent particle.

$$\text{Degree of coalescence} = \text{secondary particle diameter} / \text{average primary particle diameter}$$

By observation of 100 or more coalescent particles, the degrees of coalescence of the respective particles are determined, and an average value of the degree of coalescence and a rate that the degree of coalescence is less than 1.3 are determined.

An average of the degrees of coalescence of the coalescent particles is not particularly limited and can be appropriately selected according to the purpose, but this is preferably, 1.5 to 4.0. Where the average of the degrees of coalescence is less than 1.5, the coalescent particles cannot sufficiently perform the function as a non-spherical external additive, the coalescent particles easily transfer into recesses on the toner base surface, and there is a case where an increase in non-electrostatic adhesion force between the toner and developer bearing member particularly over time cannot be sufficiently suppressed, and a hysteresis easily occurs, which is therefore not preferable. On the other hand, where the average exceeds 4.0, the coalescent particles easily peel off the toner base to cause carrier contamination and damage to the photoconductor, which may therefore result in image defects over time, and is not preferable.

The content of coalescent particles the degree of coalescence of which is less than 1.3 is not particularly limited and can be appropriately selected according to the purpose, but this is preferably 10% by number or less. The degree of coalescence has distribution in production, and particles the degree of coalescence of which is less than 1.3 are particles whose coalescence has not proceeded, and exist substantially in a state of nearly spherical shapes. Therefore, the particles have trouble performing the function as a non-spherical additive characterized for suppressing burying. Also, for determination of the content of the coalescent particles the degree of coalescence is less than 1.3, the average of the particle diameters of primary particles of a coalescent particle and the secondary particle diameter are measured, by the foregoing method, for 100 or more and 200 or less particles, and then the degrees of coalescence of the respective coalescent particles are calculated from the obtained measurements, and the number of particles the degree of coalescence of which is less than 1.3 is divided by the number of measured particles for calculation.

A method for confirming that primary particles of the coalescent particle are coalesced with each other is not particularly limited and can be appropriately selected according to the purpose, but this is preferably a method for confirming that primary particles are coalesced with each other by observation through a scanning electron microscope (SEM).

The content of the external additive is not particularly limited and can be appropriately selected according to the purpose, but this is preferably 0.5 parts by mass to 4.0 parts by mass to 100 parts by mass of toner base particles.

—Other External Additives—

To the toner, various external additives can be added for the purpose of an improvement in fluidity, a charge amount adjustment, an adjustment of electrical characteristics besides the coalescent particles. The external additives are not particularly limited and can be appropriately selected from known ones according to the purpose, and examples thereof include silica fine particles, hydrophobized silica fine particles, fatty acid metal salts (for example, zinc stearate and aluminum stearate); metal oxides (for example, titania, alumina, tin oxide, and antimony oxide) or those that have been hydrophobized, and fluoropolymers. Among these, hydrophobized silica fine particles, titania particles, and hydrophobized titania particles are suitable.

The content of other external additives are not particularly limited and can be appropriately selected according to the purpose, but this is preferably 0.3 parts by mass to 3.0 parts by mass to 100 parts by mass of toner base particles.

Examples of the hydrophobized silica fine particles include HDK H2000 HDK H2000/4, HDK H2050EP, HVK21, HDK 111303 (all of which are manufactured by Hoechst AG); and R972, R974, RX200, RY200, R202, R805, R812 (all of which are manufactured by Nippon Aerosil Co., Ltd.). Examples of the titania fine particles include P-25 (Nippon Aerosil Co., Ltd.); STT-30, STT-65C-S (both of which are manufactured by Titan Kogyo Ltd.); TAF-140 (manufactured by Fuji Titanium Industry Co., Ltd.); and MT-150W, MT-500B, MT-600B, MT-150A (all of which are manufactured by Tayca Corporation). Examples of the hydrophobized titanium oxide fine particles include T-805 (manufactured by Nippon Aerosil Co., Ltd.); STT-30A, STT-65S-S (both of which are manufactured by Titan Kogyo Ltd.); TAF-500T, TAF-1500T (both of which are manufactured by Fuji Titanium Industry Co., Ltd.); MT-100S, MT-100T (both of which are manufactured by Tayca Corporation); and IT-S (manufactured by Ishihara Sangyo Kaisha Ltd.).

<Toner Base Particles>

The toner base particles contain at least a binder resin and a colorant. The toner base particles can further contain a releasing agent, a charge control agent, a layered inorganic mineral, and others according to necessity.

<<Binder Resin>>

The binder resin is not particularly limited and can be appropriately selected according to the purpose, and examples thereof include polyester resins, silicone resins, styrene-acrylic resins, styrene resins, acrylic resins, epoxy resins, diene-based resins, phenol resins, terpene resins, coumarin resins, amide-imide resins, butyral resins, urethane resins, and ethylene vinyl acetate resins. These may be used alone or in combination of two or more. Among these, a polyester resin and a resin for which a polyester resin and the above-described other binder resin are combined are preferable in consideration of being excellent in low-temperature fixability to allow flattening the image surface and in consideration of having sufficient flexibility even at a lowered molecular weight.

—Polyester Resin—

The polyester resin is not particularly limited and can be appropriately selected according to the purpose, but this is preferably an unmodified polyester resin and a modified polyester resin. These may be used alone or in combination of two or more.

--Unmodified Polyester Resin--

The unmodified polyester resin is not particularly limited and can be appropriately selected according to the purpose, and examples thereof include resins for which polyol expressed by the following general formula (1) and polycarboxylic acid expressed by the following general formula (2) are made into polyester and crystalline polyester resins. The present invention can provide a developing device and an image forming apparatus that allow similarly suppressing the occurrence of a hysteresis over time also in a high-speed machine loaded with a toner using a crystalline polyester resin and excellent in low-temperature fixability in which a hysteresis becomes more prominent.

$$A\text{-}[OH]_m \qquad \text{General formula (1)}$$

$$B\text{—}[COOH]_n \qquad \text{General formula (2)}$$

In the above general formula (1), A denotes an alkyl group, an alkylene group, or an aromatic group or aromatic hetero ring group that may have a substituent group, having 1 to 20 carbon atoms, and m denotes an integer of 2 to 4.

In the above general formula (2), B denotes an alkyl group, an alkylene group, or an aromatic group or aromatic hetero ring group that may have a substituent group, having 1 to 20 carbon atoms, and n denotes an integer of 2 to 4.

The polyol expressed by the above general formula (1) is not particularly limited and can be appropriately selected according to the purpose, and examples thereof include ethylene glycol, diethylene glycol, triethylene glycol, 1,2-propylene glycol, 1,3-propylene glycol, 1,4-butanediol, neopentyl glycol, 1,4-butenediol, 1,5-pentanediol, 1,6-hexanediol, 1,4-cyclohexane dimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentatriol, glycerol, 2-methylpropanetriol, 2-methyl-1,2,4-butanetriol, trimethylolethane, trimethylolpropane, and 1,3,5-trihydroxymethylbenzene, bisphenol A, ethylene oxide adducts of bisphenol A, propylene oxide adducts of bisphenol A, hydrogenated bisphenol A, ethylene oxide adducts of hydrogenated bisphenol A, and propylene oxide adducts of hydrogenated bisphenol A. These may be used alone or in combination of two or more.

The polycarboxylic acid expressed by the ordinary formula (2) is not particularly limited and can be appropriately selected according to the purpose, and examples thereof include maleic acids, fumaric acids, citraconic acids, itaconic acids, glutaconic acids, phthalic acids, isophthalic acids, terephthalic acids, succinic acids, adipic acid, sebacic acid, azelaic acid, malonic acid, n-dodecenyl succinic acid, isooctyl succinic acid, isododecenyl succinic acid, n-dodecyl succinic acid, isododecyl succinic acid, n-octenyl succinic acid, n-octyl succinic acid, isooctenyl succinic acid, isooctyl succinic acid, 1,2,4-benzene tricarboxylic acid, 2,5,7-naphthalene tricarboxylic acid, 1,2,4-naphthalene tricarboxylic acid, 1,2,4-butane tricarboxylic acid, 1,2,5-hexane tricarboxylic acid, 1,3-dicarboxylic-2-methyl-2-methylene-carboxylpropane, 1,2,4-cyclohexane tricarboxylic acid, tetra (methylenecarboxyl) methane, 1,2,7,8-octane tetracarboxylic acid, pyromellitic acid, empol trimer acid and the like, cyclohexane dicarboxylic acid, cyclohexene dicarboxylic acid, butane tetracarboxylic acid, diphenylsulfone tetracarboxylic acid, and ethyleneglycol bis(trimellitic acid). These may be used alone or in combination of two or more.

---Crystalline Polyester Resin---

As the polyester resin, a crystalline polyester resin can be contained.

Examples of the crystalline polyester resin are preferably crystalline polyesters that are synthesized using as alcohol components, saturated aliphatic diol compounds having 2 to 12 carbon atoms, particularly, 1,4-butanediol, 1,6-hexanediol, 1,8-octanediol, 1,10-decanediol, 1,12-dodecanediol, and derivatives of these and at least as acid components, dicarboxylic acid having 2 to 12 carbon atoms having a double bond (C=C bond) or saturated dicarboxylic acid having 2 to 12 carbon atoms, particularly, fumaric acid, 1,4-butanedioic acid, 1,6-hexanedioic acid, 1,8-octanedioic acid, 1,10-decanedioic acid, 1,12-dodecanedioic acid, and derivatives of these.

Among these, in consideration of making the difference between the endothermic peak temperature and endothermic shoulder temperature smaller, a crystalline polyester resin is preferably composed only of an alcohol component of any one of the group consisting of 1,4-butanediol, 1,6-hexanediol, 1,8-octanediol, 1,10-decanediol, and 1,12-dodecanediol and a dicarboxylic acid of only one of the group consisting of fumaric acid, 1,4-butanedioic acid, 1,6-hexanedioic acid, 1,8-octanedioic acid, 1,10-decanedioic acid, 1,12-dodecanedioic acid.

Moreover, as a method for controlling the crystallinity and softening point of a crystalline polyester resin, such a method can be mentioned as designing and using non-linear polyester or the like for which trivalent or higher multivalent alcohol such as glycerin is added to an alcohol component and trivalent or higher multivalent carboxylic acid such as trimellitic anhydride is added to an acid component for condensation polymerization in synthesis of polyester.

The molecular structure of a crystalline polyester resin of the present invention can be confirmed by X-ray diffraction, GC/MS, LC/MS, and IR measurements, and the like, besides an NMR measurement in a solution or solid state.

The content in the toner of the crystalline polyester resin is not particularly limited and can be appropriately selected according to the purpose, but this is preferably 3% by mass to 15% by mass, and more preferably, 5% by mass to 10% by mass. Where the content is less than 3% by mass, there is a case where an effect on the low-temperature fixability cannot be sufficiently obtained, which is not preferable, and where the content exceeds 15% by mass, the image density stability over time, particularly, the image density stability over time in a high-speed machine tends to deteriorate, which is therefore not preferable.

--Modified Polyester Resin--

The modified polyester resin is not particularly limited and can be appropriately selected according to the purpose, and examples thereof include resins that are obtained by allowing an active hydrogen group-containing compound and polyester (hereinafter, sometimes referred to as a "polyester prepolymer") capable of reacting with the active hydrogen group-containing compound to undergo an elongation reaction and/or crosslinking reaction. The elongation reaction and/or crosslinking reaction may be stopped, according to necessity, by a reaction stopper (diethylamine, dibutylamine, butylamine, laurylamine, a blocked monoamine such as a ketimine compound, or the like).

---Active Hydrogen Group-Containing Compound---

The active hydrogen group-containing compound acts as an elongation agent, a crosslinking agent, and the like when the polyester prepolymer undergoes an elongation reaction, crosslinking reaction, or the like in an aqueous phase.

The active hydrogen group-containing compound is not particularly limited as long as it has an active hydrogen group, and can be appropriately selected according to the purpose, but this is preferably amines in consideration of enabling a higher molecular weight where the polyester porepolymer is an isocyanate group-containing polyester prepolymer to be described later.

The active hydrogen group is not particularly limited and can be appropriately selected according to the purpose, and examples thereof include hydroxyl groups (alcoholic hydroxyl groups or phenol hydroxyl groups), amino groups, carboxyl groups, and mercapto groups. These may be contained alone or in combination of two or more.

The amines being the active hydrogen group-containing compound are not particularly limited and can be appropriately selected according to the purpose, and examples thereof include diamine, trivalent or higher polyamine, amino alcohol, amino mercaptan, amino acid, and blocked products in which amino groups of these amines are blocked. Examples of the diamine include aromatic diamines (phenylene diamine, diethyl toluene diamine, 4,4'-diaminodiphenyl methane, and the like); alicyclic diamines (4,4'-diamino-3,3'-dimethyl dicyclohexyl methane, diamine cyclohexane, isophorone diamine, and the like); and aliphatic diamines (ethylene diamine, tetramethylene diamine, hexamethylene diamine, and the like). Examples of the trivalent or higher polyamine include diethylene triamine and triethylene tetramine. Examples of the amino alcohol include ethanolamine and hydroxyethylaniline. Examples of the amino mercaptan include aminoethyl mercaptan and aminopropyl mercaptan. Examples of the amino acid include aminopropionic acid and aminocaproic acid. Examples of the blocked products in which amino groups of these amines are blocked include ketimine compounds obtained from any one of these amines (diamine, trivalent or higher polyamine, amino alcohol, amino mercaptan, amino acid, and the like) and ketones (acetone, methyl ethyl ketone, methyl isobutyl ketone, and the like) and oxazolidine compounds. These may be used alone or in combination of two or more. Among these, as the amines, diamine and a mixture of diamine and a small amount of trivalent or higher polyamine are particularly preferable.

---Polymer Capable of Reacting with Active Hydrogen Group-Containing Compound---

A polymer capable of reacting with the active hydrogen group-containing compound is not particularly limited as long as it is a polymer having at least a group capable of reacting with the active hydrogen group-containing compound, and can be appropriately selected according to the purpose, but this is preferably a urea bond generating group-containing polyester resin (RMPE), and more preferably, an isocyanate group-containing polyester prepolymer, in consideration of high fluidity on melting, being excellent in transparency, and allowing easily adjusting the molecular weight of polymeric components, thus being excellent in oilless low-temperature fixability and releasability with a dry toner.

The isocyanate group-containing polyester prepolymer is not particularly limited and can be appropriately selected according to the purpose, and examples thereof include polycondensates of polyol with polycarboxylic acid, which are obtained by allowing active hydrogen group-containing polyester resins to react with polyisocyanate.

The polyol is not particularly limited and appropriately selected according to the purpose, and examples thereof include diols such as alkylene glycols (ethylene glycol, 1,2-propylene glycol, 1,3-propylene glycol, 1,4-butane diol, 1,6-hexane diol, and the like), alkylene ether glycols (diethylene glycol, triethylene glycol, dipropylene glycol, polyethylene glycol, polypropylene glycol, polytetramethylene ether glycol, and the like), alicyclic diols (1,4-cyclohexane dimethanol, hydrogenated bisphenol A, and the like), bisphenols (bisphenol A, bisphenol F, bisphenol S, and the like), alkylene oxide (ethylene oxide, propylene oxide, butylene oxide, and the like) adducts of the alicyclic diols, and alkylene oxide (ethylene oxide, propylene oxide, butylene oxide, and the like) adducts of the bisphenols; trivalent or higher polyols such as multivalent aliphatic alcohols (glycerin, trimethylolethane, trimethylolpropane, pentaerythritol, sorbitol, and the like), trivalent or higher phenols (phenol novolac, cresol novolac, and the like), and alkylene oxide adducts of trivalent or higher polyphenols; and mixtures of diols and trivalent or higher phenols. These may be used alone or in combination of two or more. Among these, as the polyol, the diol alone and a mixture of the diol and a small amount of the trivalent or higher phenol are preferable. As the diol, alkylene glycols having 2 to 12 carbons and alkylene oxide adducts of bisphenols (an ethylene oxide 2-mole adduct of bisphenol A, a propylene oxide 2-mole adduct of bisphenol A, a propylene oxide 3-mole adduct of bisphenol A, and the like) are preferable.

The content in an isocyanate group-containing polyester prepolymer of the polyol is not particularly limited and can be appropriately selected according to the purpose, but this is preferably 0.5% by mass to 40% by mass, more preferably, 1% by mass to 30% by mass, and particularly preferably, 2% by mass to 20% by mass, for example. Where the content is less than 0.5% by mass, where the hot offset resistance may deteriorate, thus making it difficult to achieve both the storability and low-temperature fixability of toner, and where the content exceeds 40% by mass, the low-temperature fixability may deteriorate.

The polycarboxylic acid is not preferably limited and can be appropriately selected according to the purpose, and examples thereof include alkylene dicarboxylic acids (succinic acid, adipic acid, sebacic acid, and the like); alkenylene dicarboxylic acids (maleic acid, fumaric acid, and the like); aromatic dicarboxylic acids (terephthalic acid, isophthalic acid, naphthalene dicarboxylic acid, and the like); and trivalent or higher polycarboxylic acids (aromatic polycarboxylic acids and the like, having 9 to 20 carbon atoms such as trimellitic acid and pyromellitic acid). These may be used alone or in combination of two or more. Among these, as the polycarboxylic acid, alkenylene dicarboxylic acid having 4 to 20 carbon atoms and aromatic dicarboxylic acid having 8 to 20 carbon atoms are preferable. In addition, in place of the polycarboxylic acid, acid anhydrides of polycarboxylic acids, lower alkylesters (methyl ester, ethyl ester, isopropyl ester, and the like), and others may be used.

A mixture ratio of the polyol and the polycarboxylic acid is not particularly limited and can be appropriately selected according to the purpose, but this is preferably 2/1 to 1/1 as an equivalent ratio [OH]/[COOH] of hydroxyl group [OH] in the polyol to carboxyl group [COOH] in the polycarboxylic acid, more preferably, 1.5/1 to 1/1, and particularly preferably, 1.3/1 to 1.02/1.

The polyisocyanate is not particularly limited and can be appropriately selected according to the purpose, and examples thereof include aliphatic polyisocyanates (tetramethylene diisocyanate, hexamethylene diisocyanate, 2,6-diisocyanato methylcaproate, octamethylene diisocyanate, decamethylene diisocyanate, dodecamethylene diisocyanate, tetradecamethylene diisocyanate, trimethylhexane diisocyanate, tetramethylhexane diisocyanate, and the like); alicyclic polyisocyanates (isophorone diisocyanate, cyclohexylmethane diisocyanate, and the like); aromatic diisocyanates (tolylene diisocyanate, diphenylmethane, diisocyanate, 1,5-naphthylene diisocyanate, diphenylene-4,4'-diisocyanate, 4,4'-diisocyanato-3,3'-dimethyl diphenyl, 3-methyl diphenyl methane-4,4'-diisocyanate, diphenyl ether-4,4'-diisocyanate, and the like); aromatic aliphatic diisocyanates ($\alpha,\alpha,\alpha',\alpha'$-tetramethylxylylene diisocyanate and the like); isocyanurates (tris-isocyanatoalkyl-isocyanurate, triisocyanatocycloalkyl-isocyanurate, and the like); phenol derivatives of these; and those blocked with oximes, caprolactams, or the like. These may be used alone or in combination of two or more.

A mixture ratio of the polyisocyanate and the active hydrogen group-containing polyester resin (hydroxyl group-containing polyester resin) is not particularly limited and can be appropriately selected according to the purpose, but this is preferably 5/1 to 1/1 as an equivalent ratio [NCO]/[OH] of isocyanate group [NCO] in the polyisocyanate to hydroxyl group [OH] in the hydroxyl group-containing polyester resin, more preferably, 4/1 to 1.2/1, and particularly preferably, 3/1 to 1.5/1. Where the equivalent ratio [NCO]/[OH] is less than 1/1, the offset resistance may deteriorate, and where the equivalent ratio exceeds 5/1, the low-temperature fixability may deteriorate.

The content of the polyisocyanate in the isocyanate group-containing polyester prepolymer is not particularly limited and can be appropriately selected according to the purpose, but this is preferably 0.5% by mass to 40% by mass, more preferably, 1% by mass to 30% by mass, and particularly preferably, 2% by mass to 20% by mass. Where the content is less than 0.5% by mass, the hot offset resistance may deteriorate, thus making it difficult to achieve both the storage stability and low-temperature fixability, and where the content exceeds 40% by mass, the low-temperature fixability may deteriorate.

The average number of isocyanate groups contained in one molecule of the isocyanate group-containing polyester prepolymer is preferably 1 or more, more preferably, 1.2 to 5, and still more preferably, 1.5 to 4. Where the average number is less than 1, a polyester resin (RMPE) modified by a urea bond-generating group may decrease in molecular weight to deteriorate the hot offset resistance.

A mixture ratio of the isocyanate group-containing polyester prepolymer and the amines is not particularly limited and can be appropriately selected according to the purpose, but this is preferably 1/3 to 3/1 in a mixture equivalent ratio [NCO]/[NHx] of isocyanate group [NCO] in the isocyanate group-containing polyester prepolymer to amino group [NHx] in the amines, more preferably, 1/2 to 2/1, and particularly preferably, 1/1.5 to 1.5/1. Where the mixture equivalent ratio ([NCO]/[NHx]) is less than ⅓, the low-temperature fixability may decline, and where the equivalent ratio exceeds 3/1, a urea modified polyester resin may decrease in molecular weight to deteriorate the hot offset resistance.

---Method for Synthesizing Polymer Capable of Reacting with Active Hydrogen Group-Containing Compound---

A method for synthesizing a polymer capable of reacting with the active hydrogen group-containing compound is not particularly limited and can be appropriately selected according to the purpose, and examples thereof include, in the case of the isocyanate group-containing polyester prepolymer, a method for synthesis by heating the polyol and the polycarboxylic acid to 150° C. to 280° C. in the presence of a known esterification catalyst (dibutyl tin oxide, titanium tetrabutoxide, or the like), appropriately reducing pressure if necessary while performing generation, distilling off water to obtain hydroxyl group-containing polyester, and then allowing the polyisocyanate to react with the hydroxyl group-containing polyester at 40° C. to 140° C.

A weight-average molecular weight (Mw) of a polymer capable of reacting with the active hydrogen group-containing compound is not particularly limited and can be appropriately selected according to the purpose, but this is preferably 3,000 to 40,000, and more preferably, 4,000 to 30,000 when a tetrahydrofuran (THF)-soluble part is determined for molecular weight distribution by GPC (gel permeation chromatography). Where the weight-average molecular weight (Mw) is less than 3,000, the storage stability may deteriorate. Where it exceeds 40,000, the low-temperature fixability may deteriorate. Determination of the weight-average molecular weight (Mw) is performed, for example, as follows. First, a column is stabilized in a heat chamber kept at 40° C. At this temperature, tetrahydrofuran (THF) as a column solvent is allowed to flow at a flow rate of 1 mL per minute, and a tetrahydrofuran sample solution of resin that has been adjusted to be 0.05% by mass to 0.6% by mass in sample concentration is injected in a quantity of 50 μL to 200 μL to make determination. In determining the molecular weights of the sample, a molecular weight distribution of the sample is calculated by referring to the relationship between the logarithms of a calibration curve prepared by several types of monodisperse polystyrene standard samples and the counts. The standard polystyrene sample for preparing the calibration curve includes those having the molecular weight of $6\times10^2$, $2.1\times10^2$, $4\times10^2$, $1.75\times10^4$, $1.1\times10^5$, $3.9\times10^5$, $8.6\times10^5$, $2\times10^6$, and $4.48\times10^6$ manufactured by Pressure Chemical Company or Toyo Soda Manufacturing Co., Ltd. At least about 10 standard polystyrene samples are preferably used. It is noted that an RI (refractive index) detector can be used as a detector.

—Colorant—

A colorant to be used for the toner of the present invention is not particularly limited and can be appropriately selected from known colorants according to the purpose.

The toner colorant is not particularly limited in color and can be appropriately selected according to the purpose. This can be provided as at least one selected from a black toner, a cyan toner, a magenta toner, and a yellow toner. The respective color toners can be obtained by appropriately selecting the type of colorant, but color toners are preferable.

Examples of the colorant for black include carbon blacks (C. I. Pigment Black 7) such as furnace black, lamp black, acetylene black, and channel black, metals such as copper, iron (C. I. Pigment Black 11), and titanium oxide, and organic pigments such as aniline black (C. I. Pigment Black 1).

Examples of coloring pigments for magenta include C. I. Pigment Red 1, 2, 3, 4, 5, 6, 7, 8, 9, 10, 11, 12, 13, 14, 15, 16, 17, 18 19, 21, 22, 23, 30, 31, 32, 37, 38, 39, 40, 41, 48, 48:1, 49, 50, 51, 52, 53, 53:1, 54, 55, 57, 57:1, 58, 60, 63, 64, 68, 81, 83, 87, 88, 89, 90, 112, 114, 122, 123, 150, 163, 177, 179, 184, 202, 206, 207, 209, 211, 269; C. I. Pigment Violet 19; C. I. Vat Red 1, 2, 10, 13, 15, 23, 29, and 35.

Examples of coloring pigments for cyan include C. I. Pigment Blue 2, 3, 15, 15:1, 15:2, 15:3, 15:4, 15:6, 16, 17, 60; C. I. Vat Blue 6; C. I. Acid Blue 45 or copper phthalocyanine pigments having a phthalocyanine skeleton substituted with 1 to 5 of phthalimidemethyl groups, Green 7, and Green 36.

Examples of coloring pigments for yellow include C. I. Pigment Yellow 1, 2, 3, 4, 5, 6, 7, 10, 11, 12, 13, 14, 15, 16, 17, 23, 55, 65, 73, 74, 83, 97, 110, 139, 151, 154, 155, 180, 185; C. I. Vat Yellow 1, 3, 20, and Orange 36.

The content of a colorant in the toner is preferably 1% by mass to 15% by mass, and more preferably, 3% by mass to 10% by mass. Where the content is less than 1% by mass, the toner may decline in coloring power, and where the content exceeds 15% by mass, the pigment may be poorly dispersed in the toner to cause a decline in coloring power and degradation in electrical characteristics of the toner.

The colorant may be used as a master batch combined with a resin. Such resin is not particularly limited, but in consideration of compatibility with a binder resin in the present invention, the binder resin or a resin having a similar structure as that of the binder resin is preferably used.

The master batch can be produced by mixing or kneading a resin and a colorant under a high shearing force. In this instance, for increasing interactions between the colorant and resin, it is preferable to add an organic solvent. Further, a so-called flushing method is also suitable in that a wet cake of the colorant can be used, as it is, to eliminate a subsequent drying. The flushing method is a method in which an aqueous paste containing water of the colorant is mixed or kneaded together with the resin and the organic solvent, by which the colorant is transferred to the resin to remove water and the organic solvent. Mixing or kneading can be conducted by the use of, for example, a high-shearing dispersing apparatus such as a three-roll mill.

(Releasing Agent)

The releasing agent is not particularly limited and can be appropriately selected according to the purpose, and examples thereof include waxes such as vegetable-based waxes (carnauba wax, cotton wax, haze wax, rice wax, and the like), animal-based waxes (bee wax, lanolin, and the like), mineral-based waxes (ozokerite, selsyn, and the like), and petroleum-based waxes (paraffin wax, microcrystalline wax, petrolatum wax, and the like); waxes other than natural waxes such as synthesized hydrocarbon waxes (Fischer Tropsch wax, polyethylene wax, and the like) and synthesized waxes (ester, ketone, ether, and the like); fatty acid amides such as 12-hydroxy stearamide, stearamide, anhydrous phthalic acid imide, and chlorinated hydrocarbon; and crystalline high polymers having long alkyl groups on side chains including homopolymers or copolymers of polyacrylate such as poly-n-stearyl methacrylate and poly-n-lauryl methacrylate which are crystalline high polymers with low molecular weight (copolymers of n-stearyl acrylate-ethyl methacrylate and the like). Among these, wax having a melting point of 50° C. to 120° C. is preferable in consideration of being able to effectively act as a releasing agent between the fixing roller and toner interface, thus allowing improving the hot offset resistance even without applying a releasing agent such as oil to the fixing roller.

A melting point of the releasing agent is not particularly limited and can be appropriately selected according to the purpose, but this is preferably 50° C. to 120° C., and more preferably, 60° C. to 90° C. Where the melting point is less than 50° C., the wax may adversely affect storage stability, and where it exceeds 120° C., it is liable to cause cold offset on fixing at low temperature. A melting point of the releasing agent is determined by measuring the maximum endothermic peak by using a differential scanning calorimeter (TG-DSC system, TAS-100, manufactured by Rigaku Denki Co., Ltd.).

A melt viscosity of the releasing agent is not particularly limited and can be appropriately selected according to the purpose, but this is preferably 5 cps to 1,000 cps as a measurement at a temperature which is 20° C. higher than the melting point of the wax, and more preferably, 10 cps to 100 cps. Where the melt viscosity is less than 5 cps, the releasability may decline, and where the melt viscosity exceeds 1,000 cps, enhancing effects on the hot offset resistance and low-temperature fixing ability may no longer be obtained.

The releasing agent preferably exists in a state dispersed in the toner base particles, and for that sake, it is preferable that the releasing agent and the binder resin are not mutually soluble. A method by which the releasing agent is finely dispersed in the toner base particles is not particularly limited and can be appropriately selected according to the purpose, and examples thereof include a method for dispersing under shearing force for kneading in toner production.

A dispersing state of the releasing agent can be confirmed by observing a thin-film section of a toner particle through a transmission electron microscope (TEM). The dispersion diameter of the releasing agent is preferably small, but oozing-out in fixing may be insufficient if the dispersion diameter is excessively small. Therefore, if the releasing agent can be confirmed at a magnification power of 10,000×, this indicates that the releasing agent exists in a dispersed state. Where the releasing agent cannot be confirmed at 10,000×, this results in insufficient oozing-out in fixing even when the releasing agent is finely dispersed.

The content in the toner of the releasing agent is not particularly limited and can be appropriately selected according to the purpose, but this is preferably 1% by mass to 20% by mass, and more preferably, 3% by mass to 10% by mass.

Where the content is less than 1% by mass, the hot offset resistance tends to deteriorate, and where the content exceeds 20% by mass, the heat-resistant storage stability, chargeability, transferability, and stress resistance tend to deteriorate, which is not preferable.

—Charge Control Agent—

Moreover, it is also possible to make toner contain a charge control agent according to necessity in order to impart appropriate charging performance to the toner.

As the charge control agent, any of the known charge control agents can be used. Since the use of a colored material may change the color tone, a material which is colorless or close to white is preferable, and examples thereof include triphenylmethane-based dyes, molybdic acid chelate pigments, rhodamine-based dyes, alkoxy amines, quaternary ammonium salts (including fluorine-modified quaternary ammonium salts), alkyl amides, a single body of phosphorous or compounds thereof, a single body of tungsten or compounds thereof, fluorine activators, metal salts of salicylic acid, and metal salts of salicylic acid derivatives. These may be used alone or in combination of two or more.

The content of the charge control agent is determined depending on a toner production method including the type and dispersing method of a binder resin, and is not uniquely limited, but this is preferably 0.01% by mass to 5% by mass, and more preferably, 0.02% by mass to 2% by mass, to the binder resin. Where the amount of addition exceeds 5% by mass, the charging ability of the toner is excessively great, which reduces the effect of the charge control agent, the electrostatic attractive force with the developing roller increases, which may cause a decline in fluidity of the developer and a decline in image density. Where the amount of addition is less 0.01% by mass, the charging rising property and the amount of charge are insufficient, which is liable to affect a toner image.

—Layered Inorganic Mineral—

The layered inorganic mineral is not particularly limited as long as it is an inorganic mineral of a lamination of a few nanometer-thick layers, and can be appropriately selected according to the purpose. Examples thereof include montmorillonites, bentonites, hectorites, attapulgites, sepiolites, and mixtures of these. These may be used alone or in combination of two or more. Among these, a modified layered inorganic mineral is preferable in consideration of allowing deformation when granulating a toner to perform a charge adjusting function and being excellent in low-temperature fixability, and a modified layered inorganic mineral for which a layered mineral having a montmorillonite-based basic crystal structure is modified with organic cations is more preferable, and organic modified montmorillonite and bentonite are particularly preferable in consideration of allowing easily adjusting viscosity without having influence on toner characteristics.

For the modified layered inorganic compound, it is preferable to modify the layered inorganic mineral at least in part by organic ions. By modifying the layered inorganic mineral at least in part by organic ions, the modified layered inorganic compound has moderate hydrophobicity, has a non-Newtonian viscosity in an oil phase including a toner composition and/or toner composition precursor, thus allowing deformation of the toner.

The content in toner base particles of the modified layered inorganic mineral is not particularly limited and can be appropriately selected according to the purpose, but this is preferably 0.05% by mass to 5% by mass.

—Toner Production Method—

As a production method and material for a toner in the present invention, any known production method and material can be used as long as they satisfy conditions, and there is no particular limitation, but examples thereof include a kneading and pulverizing method and a so-called chemical process in which toner particles are granulated in an aqueous medium.

Examples of the chemical process include a suspension polymerization method, an emulsion polymerization method, a seed polymerization method, a dispersion polymerization method, and others in which a monomer is used as a starting material to produce a toner; a dissolution suspension method in which a resin or resin precursor is dissolved in an organic solvent or the like to effect dispersion or emulsification in an aqueous medium; a method (production method (I)) for which, in a dissolution suspension method, an oil-phase composition including a resin precursor (reactive group-containing prepolymer) having a functional group reactive with an activated hydrogen group is emulsified or dispersed into an aqueous medium including resin fine particles, and in the aqueous medium, an active hydrogen group-containing compound and the reactive group-containing prepolymer are allowed to react; a phase inversion emulsification method in which phase inversion is allowed to take place by adding water to a solution composed of a resin or resin precursor and an appropriate emulsifying agent; and an aggregation method in which resin particles obtained by any of these methods are aggregated in a state of being dispersed in an aqueous medium and granulated into particles with a desired size by heat melting and the like. Among these, a toner produced by any of the dissolution suspension method, the production method (I), and the aggregation method is preferable in terms of granulation property due to a crystalline resin (particle size distribution control, particle shape control, and others), and a toner produced by the production method (I) is more preferable.

Hereinafter, a detailed description will be given of these production methods.

The kneading pulverizing method is a method for producing base particles of the toner, for example, by pulverizing and classifying a toner material containing at least a colorant, a binder resin, and a releasing agent that has been melt-kneaded.

In the melt-kneading, the toner material is mixed, and the mixture is charged in a melt kneader for melt kneading. As the melt kneader, for example, a single-screw or twin-screw continuous kneader, or a batch-type kneader by a roll mill can be used. Examples thereof that are suitably used include a twin-screw extruder Model KTK manufactured by Kobe Steel, Ltd., an extruder Model TEM manufactured by Toshiba Machine Co., Ltd., a twin-screw extruder manufactured by KCK, Co., Ltd., a twin-screw extruder Model PCM manufactured by Ikegai Iron Works, Ltd., and a co-kneader manufactured by Buss AG. It is preferable to carry out this melt kneading under proper conditions so as not to cause cutoff of molecular chains of the binder resin. Specifically, the melt kneading is carried out at a temperature with reference to a softening point of the binder resin, severe cutoff may occur when the temperature is excessively higher than the softening point, and dispersion may not progress when the temperature is excessively low.

In the pulverization, a kneaded product obtained by the kneading is pulverized. In the pulverization, it is preferable that the kneaded product is first crudely pulverized and then finely pulverized. In this case, preferably used is a method in which the product is pulverized by collision with a collision board in a jet stream, pulverized by allowing particles to collide together in the jet stream, or pulverized at a narrow gap between a mechanically rotating rotor and a stator.

In the classification, a pulverized product obtained by the pulverization is classified and adjusted to particles with a predetermined particle diameter. The classification can be carried out by removing fine particle portions with the use of a cyclone, a decanter, a centrifugal machine or the like.

After completion of the pulverization and classification, the pulverized product is classified into an air current by a centrifugal force or the like, thus making it possible to produce toner base particles with a predetermined particle diameter.

The dissolution suspension method is a method for producing base particles of a toner by, for example, dispersing or emulsifying in an aqueous medium an oil-phase composition for which a toner composition containing at least a binder resin or resin precursor, a colorant, and a releasing agent is dissolved or dispersed into an organic solvent.

The organic solvent to be used when dissolving or dispersing the toner composition is preferably a volatile solvent having a boiling point of less than 100° C. in consideration of ease in subsequent solvent removal.

Examples of the organic solvent include ester-based or ester ether-based solvents such as ethyl acetate, butyl acetate, methoxy butyl acetate, methyl cellosolve acetate, and ethyl cellosolve acetate; ether-based solvents such as diethyl ether, tetrahydrofuran, dioxan, ethyl cellosolve, buthyl cellosolve, and propylene glycol monomethyl ether; ketone-based solvents such as acetone, methyl ethyl ketone, methyl isobutyl ketone, di-n-butyl ketone, and cyclohexanone; alcohol-based solvents such as methanol, ethanol, n-propanol, isopropanol, n-butanol, isobutanol, t-butanol, 2-ethylhexyl alcohol, and benzyl alcohol; and solvent mixtures of two or more of these.

In the dissolution suspension method, when dispersing or emulsifying an oil-phase composition in an aqueous medium, an emulsifying agent or dispersing agent may be used according to necessity.

As the emulsifying agent or dispersing agent, a known surface active agent, water-soluble polymer, or the like can be used. The surface active agent is not particularly limited, and examples thereof include anionic surface active agents (alkyl benzene sulfonate, phosphorate ester, and the like), cationic surface active agents (quaternary ammonium salt types, amine salt types, and the like), ampholytic surface active agents (carboxylate types, sulfate types, sulfonate types, phosphate types, and the like), and nonionic surface active agents (AO adduct types, polyalcohol types, and the like). As the surface active agent, these surface active agents may be used alone or in combination of two or more.

Examples of the water-soluble polymer include cellulose-based compounds (for example, methyl cellulose, ethyl cellulose, hydroxyethyl cellulose, ethyl hydroxyethyl cellulose, carboxymethyl cellulose, hydroxypropyl cellulose, and saponified products of those), gelatines, starches, dextrins, Arabian gums, chitins, chitosans, polyvinyl alcohols, polyvinyl pyrrolidones, polyethylene glycols, polyethylene imines, polyacrylamides, acrylate-containing polymers (sodium polyacrylate, potassium polyacrylate, ammonium polyacrylate, polyacrylate partially neutralized with sodium hydroxide, sodium acrylate-acrylic acid ester copolymers), styrene-maleic anhydride copolymers (partially) neutralized with sodium hydroxide, and water-soluble polyurethanes (reaction products of polyethylene glycol, polycaprolactone diol, and others with polyisocyanate and the like).

Moreover, as an emulsifying or dispersing aid, the above-described organic solvent and a plasticizer may be used in combination.

It is preferable to obtain a toner according to the present invention by granulating base particles of a toner by a method (production method (I)) for which, in a dissolution suspension method, an oil-phase composition including at least a binder resin, a binder resin precursor (reactive group-containing prepolymer) having a functional group reactive with an activated hydrogen group, a colorant, and a releasing agent is dispersed or emulsified into an aqueous medium including resin fine particles, and an active hydrogen group-containing compound included in the oil-phase composition and/or aqueous medium and the reactive group-containing prepolymer are allowed to react.

The resin fine particles can be formed by using a known polymerization method, but are preferably obtained as an aqueous dispersion of resin fine particles. Examples of a method for preparing an aqueous dispersion of resin fine particles include the following (a) to (h).

(a) A method in which vinyl monomer is used as a starting material, polymerization reaction is conducted by any method selected from suspension polymerization method, emulsion polymerization method, seed polymerization method, and disperse polymerization method to directly prepare an aqueous dispersion of resin fine particles.

(b) A method in which a precursor (monomer, oligomer, or others) of a polyaddition or condensation resin such as a polyester resin, polyurethane resin, and epoxy resin or a solvent solution thereof is dispersed in an aqueous medium in the presence of an appropriate dispersing agent, and then cured by heating or addition of a curing agent, thereby preparing an aqueous dispersion of resin fine particles.

(c) A method in which an appropriate emulsifying agent is dissolved in a precursor (monomer, oligomer, or others) of a polyaddition or condensation resin such as a polyester resin, polyurethane resin, and epoxy resin or in a solvent solution thereof (which is preferably in a liquid, or which may be liquefied by heating), and then water is added to effect the phase inversion emulsification, thereby preparing an aqueous dispersion of resin fine particles.

(d) A method in which a resin previously synthesized by polymerization reaction (for example, addition polymerization, ring-opening polymerization, polyaddition, addition condensation, or condensation polymerization) is pulverized by using a mechanical rotation-type pulverizer or a jet-type pulverizer, and then classified to obtain resin fine particles, which are thereafter dispersed in water in the presence of an appropriate dispersing agent, thereby preparing an aqueous dispersion of resin fine particles.

(e) A method in which a resin previously synthesized by polymerization reaction (for example, addition polymerization, ring-opening polymerization, polyaddition, addition condensation, or condensation polymerization) is dissolved in a solvent to give a resin solution, which is sprayed in a mist form to obtain resin fine particles, thereafter, the resin fine particles are dispersed in water in the presence of an appropriate dispersing agent, thereby preparing an aqueous dispersion of resin fine particles.

(f) A method in which a resin previously synthesized by polymerization reaction (for example, polymerization reaction is acceptable such as addition polymerization, ring-opening polymerization, polyaddition, addition condensation, or condensation polymerization) is dissolved in a solvent to give a resin solution, to which a poor solvent is added, or a resin solution previously dissolved in a solvent by heating is cooled to precipitate resin fine particles, the solvent is removed to obtain resin particles, and thereafter the resin particles are dispersed in water in the presence of an appropriate dispersing agent, thereby preparing an aqueous dispersion of resin fine particles.

(g) A method in which a resin previously synthesized by polymerization reaction (for example, addition polymerization, ring-opening polymerization, polyaddition, addition condensation, or condensation polymerization) is dissolved in a solvent to give a resin solution, and the resin solution is dispersed in an aqueous medium in the presence of an appropriate dispersing agent, and thereafter the solvent is removed by heating or under reduced pressure, thereby preparing an aqueous dispersion of resin fine particles.

(h) A method in which a resin previously synthesized by polymerization reaction (for example, addition polymerization, ring-opening polymerization, polyaddition, addition condensation, or condensation polymerization) is dissolved in a solvent to give a resin solution, an appropriate emulsifying agent is dissolved in the resin solution, and thereafter water is added to effect the phase inversion emulsification, thereby preparing an aqueous dispersion of resin fine particles.

The resin fine particles preferably have a volume-average particle diameter of 10 nm or more and 300 nm or less, and more preferably, 30 nm or more and 120 nm or less. Where the volume-average particle diameter of the resin fine particles is less than 10 nm and where it exceeds 300 nm, the toner may deteriorate in particle size distribution, which is therefore not preferable.

The oil phase preferably has a solid content concentration of 40% by mass to 80% by mass. Where the concentration is excessively high, the oil phase is hard to dissolve or disperse. Further, the oil phase is increased in viscosity and handling is difficult. Where the concentration is excessively low, toner productivity declines.

Toner compositions such as the coloring agent and releasing agent other than a binder resin as well as master batches thereof may be individually dissolved or dispersed in an organic solvent and then mixed with a binder resin solution or dispersion solution.

As the aqueous medium, water may be used alone, but a solvent miscible with water may be used in combination. Examples of the miscible solvent include alcohols (methanol, isopropanol, ethylene glycol, and the like), dimethylformamide, tetrahydrofuran, cellosolves (methyl cellosolve and the like), and lower ketones (acetone and methyl ethyl ketone and the like).

A method for dispersion or emulsification into the aqueous medium is not particularly limited, and applicable is any known equipment selected from low-speed shearing, high-speed shearing, friction, high-pressure jet, and supersonic types. Of the equipment, high-speed shearing equipment is preferable in terms of making particles with a small diameter. Where a high-speed shearing dispersion machine is used, there is no particular limitation on the number of rotations, but this is normally 1,000 rpm to 30,000 rpm, and preferably, 5,000 rpm to 20,000 rpm. The temperature on dispersion is normally 0° C. to 150° C. (under pressure), and preferably, 20° C. to 80° C.

For removing the organic solvent from an obtained emulsified dispersion product, any known technique can be used without particular limitation, and for example, a method can be adopted in which a whole system is gradually heated under normal or reduced pressure to completely evaporatively remove an organic solvent in droplets.

As a method for washing and drying base particles of a toner dispersed in an aqueous medium, known techniques are used. That is, after a centrifugal machine, a filter press, or the like is used to effect solid-liquid separation, thus obtained toner cake is dispersed again in ion-exchanged water at normal temperature to approximately 40° C. and acid or alkali is used to adjust pH of the cake, if necessary, thereafter effecting solid-liquid separation again. This step is repeated several times to remove impurities and a surface active agent and, thereafter, drying is carried out by using a flash dryer, a circulation dryer, a vacuum dryer, a vibration fluidized dryer, or the like to obtain toner powder. In this case, centrifugation, or the like may be carried out to remove fine particle components of the toner. Further, any known classifier can be used to obtain desired particle-diameter distribution after drying, if necessary.

The aggregation method is a method for producing toner base particles by mixing at least a resin fine particle dispersion made of a binder resin and a colorant particle dispersion and a releasing agent particle dispersion if necessary to effect aggregation. The resin fine particle dispersion is obtained by a known method, for example, an emulsion polymerization method, a seed polymerization method, or a phase inversion emulsification method, and the colorant particle dispersion and the releasing agent particle dispersion are obtained by dispersing a colorant or a releasing agent in an aqueous medium by a known wet dispersion method or the like.

An aggregation state is controlled preferably by a method such as applying heat, adding a metal salt, or adjusting pH.

There is no particular restriction on the metal salt. Examples of the metal salt include monovalent metals which constitutes salts such as sodium or potassium; divalent metals which constitute salts such as calcium or magnesium; and trivalent metals which constitute salts such as aluminum.

Examples of anions which constitute the salts include chloride ions, bromide ions, iodide ions, carbonate ions, and sulfate ions. Among these, magnesium chloride, aluminum chloride, a complex thereof, and a multimer thereof are preferable.

Further, heating is done during aggregation or after completion of aggregation, by which fusion of fine resin particles can be accelerated. This is preferable in terms of uniformity of a toner. Still further, the shape of the toner can be controlled by heating. In most cases, greater heating makes the toner closer to a spherical form.

For a method for washing and drying base particles of a toner dispersed in an aqueous medium, the foregoing method and the like can be used.

In addition, in order to improve fluidity, storage stability, develop ability, and transferability of the toner, the thus manufactured toner base particles, which is added and mixed with the coalescent particles, may be further added and mixed with inorganic particles such as hydrophobic silica fine powder.

A common powder mixer is used to mix an additive, but it is preferable to equip a jacket or the like to adjust the temperature inside. Here, in order to change the history of a stress applied to the additive, the additive may be added in the middle or gradually. In this case, the number of revolutions, rolling speed, time, temperature, and the like of the mixer may be changed. Alternatively, first, a strong stress and then a relatively weak stress may be added, and vice versa. Examples of available mixing equipment include a V-form mixer, a Rocking mixer, a LOEDIGE mixer, a NAUTA mixer, and a HENSCHEL mixer. Next, coarse particles and aggregation particles are removed by sieving with a screen of 250 mesh or more, and thus a toner can be obtained.

The toner is not particularly limited in terms of the shape and size thereof and can be appropriately selected according to the purpose, but it is preferable to have the following average circularity, volume-average particle diameter, ratio between the volume-average particle diameter and number-average particle diameter (volume-average particle diameter/number-average particle diameter), and the like.

The average circularity is a value obtained by dividing a perimeter of an equivalent circle equal in the projected area to the toner shape by a perimeter of a real particle, and this is preferably 0.950 to 0.980, and more preferably, 0.960 to 0.975, for example. One containing particles having an average circularity of less than 0.95 at 15% or less is preferable.

When the average circularity is less than 0.950, satisfactory transferability and a high quality image without dust may not be obtained, and when this is more than 0.980, in an image forming system employing blade cleaning or the like, there is a possibility that a cleaning defect occurs on the photoconductor, transfer belt, and the like to cause image fouling, for example, in the case of formation of an image with a high image area ratio such as a photographic image, background fouling as a result of toner that has formed an image untransferred due to a paper feed defect and the like being accumulated as a residual untransferred toner on the photoconductor or to contaminate the charge roller that contact-charges the photoconductor to disable the charge roller from exhibiting original charging ability.

The average circularity was measured by use of a flow-type particle image analyzer ("FPIA-2100," manufactured by SYSMEX CORPORATION) and analyzed by use of analysis software (FPIA-2100 Data Processing Program for FPIA version 00-10). Specifically, in a 100 ml glass beaker, 0.1 mL to 0.5 mL of a 10% by mass surface active agent (alkylbenzene sulfonate, NEOGEN SC-A, manufactured by Daiichi Kogyo Seiyaku Co., Ltd.) was placed, then 0.1 g to 0.5 g of each of the toners was added and stirred with a microspatula, and then 80 mL of ion exchange water was added. The thus obtained dispersion was dispersed in an ultrasonic dispersing machine (manufactured by Honda Electronics Co., Ltd.) for 3 minutes. The shape and distribution of the toner of the dispersion were measured by use of the analyzer FPIA-2100 until a concentration of 5,000 to 15,000 particles/μL was obtained. In the present measuring method, controlling the dispersion concentration to 5,000 to 15,000 particles/μL is important from the point of measurement reproducibility of average circularity. In order to obtain the dispersion concentration, it is necessary to change the conditions of the dispersion, that is, the amount of the surface active agent and the amount of the toner to be added. Similar to the measurement of the toner particle diameter described above, the requirement of the surface active agent differs depending on hydrophobicity of the toner, noise due to bubbles occurs when a large amount of the surface active agent is added, while it is impossible to sufficiently moisten the toner when the amount is small, and thus dispersion is insufficient. In addition, the amount of addition of the toner differs depending on the particle diameter, the amount is small with a small particle diameter, while it is necessary to increase the amount with a large particle diameter, and when the toner particle diameter is 3 μm to 10 μm, it becomes possible to adjust the dispersion concentration to 5,000 to 15,000 particles/μl by adding the toner by 0.1 g to 0.5 g.

The volume-average particle diameter of the toner is not particularly limited and can be appropriately selected according to the purpose, but this is preferably 3 μm to 10 μm, and more preferably, 4 μm to 7 μm, for example. When the volume-average particle diameter is less than 3 μm, with a two-component developer, the toner may be fusion-bonded to the surface of a carrier as a result of a long-term stirring in a developing device, which deteriorates charging ability of the carrier, and when this is more than 10 μm, it becomes difficult to obtain a high resolution, high quality image, and the particle diameter of the toner may greatly fluctuate when the toner is consumed and replenished in the developer.

The ratio of the volume-average-particle diameter and the number-average particle diameter (volume-average particle diameter/number-average particle diameter) in the toner is preferably 1.00 to 1.25, and more preferably, 1.10 to 1.15.

The volume-average particle diameter and the ratio of the volume-average particle diameter and the number-average particle diameter (volume-average particle diameter/number-average particle diameter) were measured at an aperture diameter of 100 μm by use of a particle size analyzer ("Multisizer III," manufactured by Beckman Coulter, Inc.), and were analyzed by analysis software (Beckman Coulter Multisizer 3 Version 3.51). Specifically, in a 100 ml glass beaker, 0.5 mL of a 10% by mass surface active agent (alkylbenzene sulfonate, NEOGEN SC-A, manufactured by Daiichi Kogyo Seiyaku Co., Ltd.) was placed, then 0.5 g of each of the toners was added thereto and stirred with a microspatula, and then 80 mL of ion exchange water was added. The thus obtained dispersion was dispersed in an ultrasonic dispersing machine (W-113MK-II, manufactured by Honda Electronics Co., Ltd.) for 10 minutes. Using Isoton III (manufactured by Beckman Coulter, Inc.) as a solution for measurement, properties of the dispersion were measured by use of the Multisizer III. The measurement was performed by dropping the toner sample dispersion such that the concentration thereof indicated by the analyzer reaches 8±2%. In the present measuring method, controlling the concentration of the toner sample dispersion to 8±2% is important from the point of measurement reproducibility of the particle diameter. Within this concentration range, no error with respect to particle diameter occurs.

(Developer)

A developer in the present invention is two-component developer containing toner and carrier. When used in a high-speed printer suitable for improvements in information processing speeds in recent years, the two-component developer is preferable in terms of an extended service life.

In the two-component developer in which the toner is used, even after the toner is balanced for a long time, the diameter of toner particles in the developer changes less, and there is also provided favorable and stable developability upon prolonged stirring by the developing unit.

(Carrier)

A carrier of the present invention is not particularly limited as long as it satisfies the above formula (1), and can be appropriately selected according to the purpose, but one having a core particle and a resin layer (coating layer) that coats the core particle is preferable. Further, it is preferable to have a magnetic core particle and a coating layer that coats the core particle and have a shape factor SF-2 of 115 to 150 and a bulk density of 1.8 g/cm$^3$ to 2.4 g/cm$^3$ and that the core particle has a shape factor SF-2 of 120 to 160, the core particle has an arithmetic average surface roughness Ra of 0.5 μm to 1.0 μm, and the coating layer contains a resin and inorganic fine particles, and contains the inorganic fine particles at a rate of 50 parts by weight to 500 parts by weight to 100 parts by mass of the resin.

By combination with a carrier having the above-described specific shape, bulk density, etc., also in an image forming apparatus loaded with a toner excellent in low-temperature fixability, the occurrence of a hysteresis can be similarly suppressed.

<Core Particle>

The core particle is not particularly limited as long as it is a magnetic core particle, and can be appropriately selected according to the purpose. Examples thereof include resin particles for which magnetic materials such as ferromagnetic metals including iron and cobalt; iron oxides such as magnetite, hematite, and ferrite; and various alloys and compounds are dispersed into resin. Among these, Mn-based ferrite, Mn—Mg-based ferrite, and Mn—Mg—Sr-based ferrite are preferable in terms of environmental considerations.

—Shape Factor SF-1 of Core Particle—

The core particle is regulated by a shape factor SF-1.

The SF-1 regulates the degree of particle roundness.

When the SF-1 takes a greater value, the particle shape deviates from a circle (spherical shape).

A shape factor SF-1 of the core particle is not particularly limited, and can be appropriately selected according to the purpose.

Determination of a shape factor SF-1 of the core particle is performed by sampling at random 100 particle images of the core particles magnified by 300× with use of a scanning electron microscope (for example, FE-SEM (S-800), manufactured by Hitachi, Ltd.), and analyzing obtained image information by an image analyzer (for example, Luzex AP, manufactured by NIRECO CORPORATION), and calculating by using the following formula (1).

$$SF\text{-}1=(L^2/A)\times(\pi/4)\times 100 \quad \text{(I)}$$

In the above formula (I), L denotes the absolute maximum length (circumscribed circle length) of a particle, and A denotes a projected area of a particle.

—Shape Factor SF-2 of Core Particle—

The core particle is regulated by a shape factor SF-2.

The SF-2 regulates the degree of particle unevenness.

When the SF-2 takes a greater value, the particle surface unevenness has more intense ups and downs.

The core particle shape factor SF-2 is not particularly limited as long as it is 120 to 160, and can be appropriately selected according to the purpose. Where the shape factor SF-2 is less than 120, projections on the core particle are easily coated, so that a local low-resistance may become hard to form. On the other hand, where the shape factor SF-2 exceeds 160, there is a large void in the core particle, not only does the core particle have a weak strength, but also, when used in a developing device for a long period of time, the core particle is largely exposed to have a great change between an initial resistance value and a resistance value after use, so that the toner amount on an electrostatic latent image bearing member and the way a toner image is formed thereon may vary to vary the image density.

Determination of a shape factor SF-2 of the core particle is performed by sampling at random 100 particle images of core particles magnified by 300× with use of a scanning electron microscope (for example, FE-SEM (S-800), manufactured by Hitachi, Ltd.), and analyzing obtained image information by an image analyzer (for example, Luzex AP, manufactured by NIRECO CORPORATION), and calculating by using the following formula (II).

$$SF\text{-}2=(P^2/A)\times(1/4\pi)\times 100 \quad \text{(II)}$$

In the above formula (II), R denotes a perimeter of a particle, and A denotes a projected area of a particle.

—Arithmetic Average Surface Roughness Ra of Core Particle—

An arithmetic average surface roughness Ra of the core particle regulates surface roughness of the core particle.

The arithmetic average surface roughness Ra of the core particle is preferably 0.5 μm to 1.0 μm, and more preferably, 0.6 μm to 0.9 μm. Where the arithmetic average surface roughness Ra of the core particle is less than 0.5 μm, there is a case where a carrier has an excessively small arithmetic average surface roughness after being formed with a coating layer, and as a result of a reduction in contacts between the carrier and toner, adhesion force between the toner and carrier may not appropriately act, so that the toner remains adhered on the developer bearing member and a hysteresis easily occurs, which is not preferable. Where the arithmetic average surface roughness Ra of the core particle exceeds 1.0 μm, there is a case where a carrier has an excessively large arithmetic average surface roughness after being formed with a coating layer, and when used in a developing device for a long period of time, wear of the coating layer at projections is remarkable to have a great change between an initial resistance value and a resistance value after use, so that the toner amount on an electrostatic latent image bearing member and the way a toner image is formed thereon vary to vary the image density, which is not preferable.

Determination of an arithmetic average surface roughness Ra of the core particle is performed, by use of an optical microscope (for example, OPTELICS C130, manufactured by Lasertec Corporation), by setting the objective lens magnification to 50×, scanning an image at a resolution of 0.20 μm, and then setting an observation area of 10 μm×10 μm around an apex part of the core particle, and determining an average value of the surface roughnesses Ra of the 100 core particles.

—Weight-Average Particle Diameter Dw of Core Particle—

A weight-average particle diameter Dw of the core particle means a particle diameter at an integrated value of 50% in a particle size distribution of the core particles determined by a laser diffraction or scanning method. The weight-average particle diameter Dw of the core particles is not particularly limited and can be appropriately selected according to the purpose, but this is preferably 10 μm to 80 μm.

For determination of a weight-average particle diameter Dw of the core particle, a particle diameter distribution of particles measured on a number basis (the relationship between the number frequency and particle diameter) is measured under the conditions to be described later with use of a Microtrac particle size analyzer (HRA9320-X100, manufactured by Honeywell, Inc.), and a weight-average particle diameter is calculated by using the following formula (III). Each channel denotes a length for dividing the particle diameter range in a particle diameter distribution chart into measurement width units, and the representative particle diameter adopts a lower limit value of the particle diameter that is stored in each channel.

$$Dw=\{1/\Sigma(nD^3)\}\times\{\Sigma(nD^4)\} \quad \text{(III)}$$

In the above formula (III), D denotes a representative particle diameter (μm) of core particles present in each channel, and n denotes a total number of core particles present in each channel.

[Measurement Conditions]

[1] Particle diameter range: 100 μm to 8 μm

[2] Channel length (channel width): 2 μm

[3] Number of channels: 46

[4] Refractive index: 2.42

<Coating Layer>

The coating layer is formed of a resin and a coating layer forming solution containing a filler, and inorganic particles are preferable as the filler.

The coating layer is not particularly limited and can be appropriately selected according to the purpose as long as it is a coating layer that contains the filler at a rate of 50 parts by mass to 500 parts by mass to 100 parts by mass of the resin, but a coating layer that contains the filler at a rate of 100 parts by mass to 300 parts by mass to 100 parts by mass of the resin is preferable. Where the content of the filler is less than 50 parts by mass, the coating layer may be scraped, and where it exceeds 500 parts by mass, a relatively small ratio of resin appears on the surface of the carrier, and toner spent may easily occur on the carrier surface. On the other hand, where the content is within the preferable range, there is an advantage in that a coating layer is difficult to scrape when used for a long period of time in a developing device.

As the thickness of the coating layer, if it is excessively thin, the surface of the core particle is easily exposed due to stirring in a developing device, which may result in a great change in resistance value, and if it is excessively thick, projections on the core particle are not exposed, thus making it difficult to form a local low-resistance state. The thickness of the coating layer can be controlled by the content of the resin relative to the core particle. The content of the resin to the core particle is not particularly limited and can be appropriately selected according to the purpose, but this is preferably 0.5% by mass to 3.0% by mass in consideration of allowing forming a local low-resistance state by the thickness of the coating layer.

—Resin—

The resin is not particularly limited, and can be appropriately selected according to the purpose, and examples thereof include amino resins, polyvinyl resins, polystyrene resins, halogenated olefin resins, polyesters, polycarbonates, polyethylenes, polyvinyl fluorides, polyvinylidene fluorides, polytrifluoroethylenes, polyhexafluoropropylenes, copolymers of vinylidene fluoride and vinyl fluoride, fluoroterpolymers such as terpolymers of tetrafluoroethylene, vinylidene fluoride, and non-fluorinated monomers, and silicone resins. These may be used alone or in combination of two or more. Among these, a silicone resin is particularly preferable in consideration of a high effectiveness.

The resin is not particularly limited and can be appropriately selected according to the purpose, but this is preferably a resin including a cured mixture containing a silane coupling agent and a silicone resin.

--Silicone Resin--

The silicone resin is not particularly limited and can be appropriately selected according to the purpose, but this is preferably a resin containing a crosslinking substance that is obtained by hydrolyzing a copolymer including at least a part A expressed by the following general formula (A) and a part B expressed by the following general formula (B) to yield a silanol group to undergo condensation.

General formula (A)

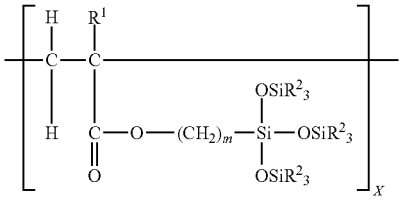

In the above general formula (A), $R^1$ denotes either of a hydrogen group and a methyl group, $R^2$ denotes an alkyl group having 1 to 4 carbon atoms, m denotes an integer of 1 to 8, and X denotes a molar ratio in the copolymer, and denotes 10% by mole to 90% by mole.

General formula (B)

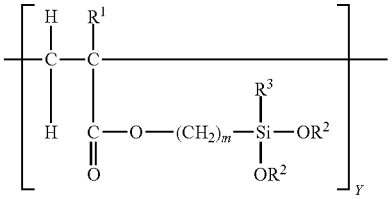

In the above general formula (B), $R^1$ denotes either of a hydrogen group and a methyl group, $R^2$ denotes an alkyl group having 1 to 4 carbon atoms, $R^3$ denotes any of an alkyl group having 1 to 8 carbon atoms or an alkoxy group having 1 to 4 carbon atoms, m denotes an integer of 1 to 8, and Y denotes a molar ratio in the copolymer, and denotes 10% by mole to 90% by mole.

--Silane Coupling Agent--

The silane coupling agent allows stably dispersing the filler.

The silane coupling agent is not particularly limited and can be appropriately selected according to the purpose. Examples thereof include r-(2-aminoethypaminopropyltrimethoxysilane, r-(2-aminoethypaminopropylmethyldimethoxysilane, r-methacryloxypropyltrimethoxysilane, N-β-(N-vinylbenzilaminoethyl)-r-aminopropyltrimethoxysilane hydrochloride, r-glycidoxypropyltrimethoxysilane, r-mercaptopropyltrimethoxysilane, methyltrimethoxysilane, methyltriethoxysilane, vinyltriacethoxysilane, r-chlorpropyltrimethoxysilane, hexamethyldisilazane, r-anilinopropyltrimethoxysilane, vinyltrimethoxysilane, octadecyldimethyl[3-(trimethoxysilyl)propyl]ammoniumchloride, r-chlorpropylmethyldimethoxysilane, methyltrichlorsilane, dimethyldichlorosilane, trimethylchlorosilane, allyltriethoxysilane, 3-aminopropylmethyldiethoxysilane, 3-aminopropyltrimethoxysilane, dimethyldiethoxysilane, 1,3-divinyltetramethyldisilazane, and methacryloxyethyldimethyl(3-trimethoxysilylpropyl)ammonium chloride. These may be used alone or in combination of two or more.

Examples of commercially available products of the silane coupling agent include AY43-059, SR6020, SZ6023, SH6020, SH6026, SZ6032, SZ6050, AY43-310M, SZ6030, SH6040, AY43-026, AY43-031, sh6062, Z-6911, sz6300, sz6075, sz6079, sz6083, sz6070, sz6072, Z-6721, AY43-004, Z-6187, AY43-021, AY43-043, AY43-040, AY43-047, Z-6265, AY43-204M, AY43-048, Z-6403, AY43-206M, AY43-206E, Z6341, AY43-210MC, AY43-083, AY43-101, AY43-013, AY43-158E, Z-6920, and Z-6940 (all of which are manufactured by Dow Corning Toray Co., Ltd.).

An addition amount of the silane coupling agent is not particularly limited and can be appropriately selected according to the purpose, but this is preferably 0.1% by mass to 10% by mass. Where the addition amount is less than 0.1% by mass, the core particle, the filler, and the resin decline in adhesion, so that a coating layer may drop over a long period of use, and where it exceeds 10% by mass, toner filming may occur over a long period of use.

—Filler—

The filler is not particularly limited and can be appropriately selected according to the purpose, and examples thereof include conductive fillers and non-conductive fillers. These may be used alone or in combination of two or more. Among these, it is preferable to make the coating layer contain a conductive filler and a non-conductive filler.

The conductive filler means a filler having a powder resistivity value of 100 Ω·cm or less.

The non-conductive filler means a filler having a powder resistivity value of more than 100 Ω·cm.

Determination of a resistivity value of the filler is performed by measuring under conditions of a sample of 1.0 g, an electrode spacing of 3 mm, a sample radius of 10.0 mm, and a load of 20 kN by using a powder resistivity measuring system (MCP-PD51, Dia Instruments Co., Ltd.) and a resistivity meter (4-terminal 4-probe method, Loresta-GP, manufactured by Mitsubishi Chemical Analytic Co., Ltd.).

—Conductive Filler—

The conductive filler is not particularly limited and can be appropriately selected according to the purpose, and examples thereof include conductive fillers for which tin dioxide or indium oxide is formed as a layer on bases such as aluminum oxide, titanium oxide, zinc oxide, barium sulphate, silicon oxide, and zirconium oxide; and conductive fillers formed using carbon blacks. Among these, conductive fillers containing aluminum oxide, titanium oxide, or barium sulphate are preferable.

—Non-Conductive Filler—

The non-conductive filler is not particularly limited and can be appropriately selected according to the purpose, and example thereof include non-conductive fillers formed using aluminum oxide, titanium oxide, barium sulphate, zinc oxide, silicon dixide, zirconium oxide, and the like. Among these, conductive fillers containing aluminum oxide, titanium oxide, or barium sulphate are preferable.

—Number-Average Particle Diameter of Filler—

A number average particle diameter of the filler is not particularly limited and can be appropriately selected according to the purpose, but this is preferably 50 nm to 800 nm, and more preferably, 200 nm to 700 nm in consideration that the filler easily projects from the surface of a resin contained in the coating layer to easily form a partial low-resistance and easily scrape away a spent component on the carrier surface and being excellent in wear resistance. For determination of a number average particle diameter of the filler, 100 particle images of a filler magnified by 10,000× with use of a scanning electron microscope (for example, FE-SEM (S-800), manufactured by Hitachi, Ltd.) are sampled at random to measure the particle diameters, and a number average particle diameter thereof is used.

<Other Components>

The other components are not particularly limited and can be appropriately selected according to the purpose, but it is preferable to make the coating layer to contain a catalyst, and a solvent, a curing agent, and others may be contained.

—Catalyst—

The catalyst is not particularly limited and can be appropriately selected according to the purpose. Examples thereof include titanium-based catalysts, tin-based catalysts, zirconium-based catalysts, and aluminum-based catalysts, and specifically include acetylacetonate complexes, alkylacetoacetate complexes, and salicylaldehydato complexes of these. These may be used alone or in combination of two or more. Among these, titanium-based catalysts are preferable in consideration of having a great effect to promote a condensation reaction of a silanol group and the catalyst being difficult to inactivate, and diisopropoxybis(ethylacetoacetate) titanium is more preferable.

<Carrier Production Method>

A production method for the carrier is not particularly limited and can be appropriately selected according to the purpose, but this is preferably a method for producing the same by applying a coating layer forming solution containing the resin and the filler to the surface of the core particle by using a fluidized-bed coating apparatus. Also, condensation of a resin contained in the coating layer may proceed when applying the coating layer forming solution, and condensation of a resin contained in the coating layer may proceed after applying the coating layer forming solution. A condensation method for the resin is not particularly limited and can be appropriately selected according to the purpose, and examples thereof include a method of applying heat, light, etc., to the coating layer forming solution to condense resin.

—Work Function Wc of Carrier—

The work function Wc of a carrier in the above formula (1) can be controlled to a desirable value by, for example, changing the type and addition amount of the silane coupling agent, the type of a resin to form the coating layer, the type and addition amount of the filler.

—Shape Factor SF-2 of Carrier—

The carrier is regulated by a shape factor SF-2.

The SF-2 regulates the degree of particle unevenness.

When the SF-2 takes a greater value, the particle surface unevenness has more intense ups and downs.

The carrier shape factor SF-2 is not particularly limited as long as it is 115 to 150, and can be appropriately selected according to the purpose, but this is preferably 120 to 145 in consideration of allowing coating with core particle unevenness remaining to some extent.

Determination of a shape factor SF-2 of the carrier is performed by sampling at random 100 particle images of a carrier magnified by 300× with use of a scanning electron microscope (for example, FE-SEM (S-800), manufactured by Hitachi, Ltd.), and analyzing obtained image information by an image analyzer (for example, Luzex AP, manufactured by NIRECO CORPORATION), and calculating by using the following formula (IV).

$$SF\text{-}2=(P^2/A)\times(1/4\pi)\times 100 \quad \text{(IV)}$$

In the above formula (IV), R denotes a perimeter of a carrier, and A denotes a projected area of a carrier.

—Bulk Density of Carrier—

A bulk density of the carrier is not particularly limited as long it is 1.80 g/cm$^3$ to 2.40 g/cm$^3$, and can be appropriately selected according to the purpose. Where the bulk density is less than 1.80 g/cm$^3$, so-called carrier adhesion in which a carrier adheres to an electrostatic latent image bearing member easily occurs, and where it exceeds 2.40 g/cm$^3$, stirring stress in the developing device is great, which may result in a great resistance change of a carrier.

Determination of a carrier bulk density is performed by dropping from a funnel having an orifice diameter ϕ of 3 mm at a height of 25 mm into a 25 cm$^3$-container.

—Weight-Average Particle Diameter Dw of Carrier—

A weight-average particle diameter Dw of the carrier means a particle diameter at an integrated value of 50% in a particle size distribution of the core particles determined by a laser diffraction/scanning method. The weight-average particle diameter Dw of the carrier is not particularly limited and can be appropriately selected according to the purpose, but this is preferably 10 μm to 80 μm.

For determination of a weight-average particle diameter Dw of the carrier by measuring a particle diameter distribution of particles measured on a number basis (the relationship between the number frequency and particle diameter) is measured under the conditions to be described later with use of a Microtrac particle size analyzer (HRA9320-X100, manufactured by Honeywell, Inc.), and a weight-average particle diameter is calculated by using the following formula (V).

$$Dw=\{1/\Sigma(nD^3)\}\times\{\Sigma(nD^4)\} \quad \text{(V)}$$

In the above formula (V), D denotes a representative particle diameter (μm) of carriers present in each channel, and n denotes a total number of carriers present in each channel.

[Measurement Conditions]

[1] Particle diameter range: 100 μm to 8 μm

[2] Channel length (channel width): 2 μm

[3] Number of channels: 46

[4] Refractive index: 2.42

When the developer is a two-component developer, the mixing ratio of toner and carrier in the two-component developer is preferably 2.0 parts by mass to 12.0 parts by mass, and more preferably, 2.5 parts by mass to 10.0 parts by mass, in terms of the mass ratio of toner to carrier.

(Image Forming Method and Image Forming Apparatus)

An image forming method to be used in the present invention includes at least an electrostatic latent image forming step (charging step and exposure step), a developing step, a transferring step, and a fixing step, and further includes other steps, for example, a discharging step, a cleaning step, a recycling step, a control step, and the like, appropriately selected according to necessity.

An image forming apparatus of the present invention includes: an electrostatic latent image bearing member; a charging unit configured to charge a surface of the electrostatic latent image bearing member; an exposing unit configured to expose the charged electrostatic latent image bearing member surface to form an electrostatic latent image; a developing unit configured to develop the electrostatic latent image with a toner to form a visible image; a transfer unit configured to transfer the visible image to a recording medium; and a fixing unit configured to fix a transfer image transferred to the recording media; and further includes other units, for example, a discharging unit, a cleaning unit, a recycling unit, a control unit, and the like, appropriately selected according to necessity. The developing unit is a developing device of the present invention.

—Latent Image Forming Step and Latent Image Forming Unit—

The electrostatic latent image forming step is a step of forming an electrostatic latent image on the electrostatic latent image bearing member.

The electrostatic latent image bearing member (sometimes referred to as "electrophotographic photoconductor" or "photoconductor") is not particularly limited in material, shape, structure, size, and the like, and can be appropriately selected from known ones. The shape is suitably a drum shape, and examples of the material include amorphous silicon and selenium of inorganic photoconductors and polysilane and phthalopolymethine of organic photoconductors (OPCs). Among these, amorphous silicon or the like is preferable in consideration of a long life span.

The electrostatic latent image can be formed by, for example, uniformly charging the surface of the electrostatic latent image bearing member and then exposing the surface imagewise, and this can be carried out by the electrostatic latent image forming unit. The electrostatic latent image forming unit includes at least, for example, a charging unit (charger) that uniformly charges the surface of the electrostatic latent image bearing member and an exposing unit (exposurer) that exposes the surface of the electrostatic latent image bearing member imagewise.

The charging can be carried out by, for example, applying voltage to the surface of the electrostatic latent image bearing member by use of the charger.

Although the charger is not particularly limited and can be appropriately selected according to the purpose, examples thereof include a contact charger which is known by itself provided with a conductive or semiconductive roll, brush, film, rubber blade, or the like, and a noncontact charger using a corona discharge such as a corotron or scorotron.

As the charger, preferred is one that is disposed in contact or out of contact with the electrostatic latent image bearing member and charges the surface of the electrostatic latent image bearing member by being superposedly applied with direct current and alternating current voltages.

In addition, the charger is preferably a charging roller that is disposed in proximity out of contact with the electrostatic latent image bearing member via a gap tape and charges the surface of the electrostatic latent image bearing member as a result of being superposedly applied with direct current and alternating current voltages to the charging roller.

The exposure can be carried out by, for example, exposing the surface of the electrostatic latent image bearing member imagewise by use of the exposurer.

The exposurer is not particularly limited as long as it is capable of exposing in a form of an image to be formed on the surface of the electrostatic latent image bearing member charged by the charger and can be appropriately selected according to the purpose, but examples thereof include various exposurers such as a copying optical system, a rod lens array system, a laser optical system, and a liquid crystal shutter optical system.

Here, in the present invention, a backlight system for exposing the electrostatic latent image bearing member imagewise from the back surface side may be employed.

—Developing Step and Developing Unit—

The developing step is a step of developing the electrostatic latent image by use of the developer to form a visible image.

The visible image can be formed by, for example, developing the electrostatic latent image by use of the developer, and this can be carried out by the developing unit.

As the developing unit, for example, one that includes at least a developing device that contains the developer of the present invention and is capable of applying the developer to the electrostatic latent image in a contact or noncontact manner is suitable, and a developing device with a developer container is more preferable.

The developing device can be either a single-color developing device or a multi-color developing device, and suitable examples thereof include one including a stirrer that frictionally stirs the developer so as to be charged and a rotatable magnet roller (developer bearing member).

In the developing device, for example, the toner and the carrier are mixed and stirred, the toner is charged by friction at that time and is held in a rising state on the surface of the rotating magnet roller to form a magnetic brush. Since the magnet roller is disposed in the vicinity of the electrostatic latent image bearing member (photoconductor), a part of the toner held in the magnetic brush formed on the surface of the magnet roller is moved to the surface of the electrostatic latent image bearing member (photoconductor) by an electrical suction force. As a result, the electrostatic latent image is developed with the toner to form a visible image of the toner on the surface of the electrostatic latent image bearing member (photoconductor).

—Transferring Step and Transfer Unit—

The transferring step is a step of transferring the visible image to a recording medium. It is preferable to use an intermediate transfer member, primarily transfer a visible image onto the intermediate transfer member, and then secondarily transfer the visible image onto the recording medium, and it is more preferable that the transferring step includes a primary transfer step of transferring a visible image onto an intermediate transfer member to form a compound transfer image by use of, as the toner, a toner of two colors or more, preferably, a full-color toner, and a secondary transfer step of transferring the compound transfer image onto a recording medium.

The transfer is carried out by, for example, charging the visible image onto the electrostatic latent image bearing member (photoconductor) by use of a transfer charger, and this can be carried out by the transfer unit. The transfer unit preferably includes a primary transfer unit that transfers a visible image onto an intermediate transfer member to form a compound transfer image and a secondary transfer unit that transfers the compound transfer image onto a recording medium.

Here, the intermediate transfer member is not particularly limited and can be appropriately selected from known transfer members according to the purpose, and suitable examples include a transfer belt.

The transfer unit (the primary transfer unit and the secondary transfer unit) preferably includes at least a transfer device that releases and charges the visible image formed on the electrostatic latent image bearing member (photoconductor) onto the recording medium side. One or a plurality of transfer units can be provided.

Examples of the transfer device include a corona transfer device using corona discharge, a transfer belt, a transfer roller, a pressure transfer roller, and an adhesion transfer device.

Here, the recording medium is not particularly limited and can be appropriately selected from known recording media (recording paper).

—Fixing Step and Fixing Unit—

The fixing step is a step of fixing a visible image transferred onto a recording medium by use of a fixing device, and this may be carried out for respective color developers every time these are transferred to the recording medium or may be simultaneously carried out for respective color developers in a laminated state at a time.

Although the fixing device is not particularly limited and can be appropriately selected according to the purpose, a known heating pressure unit is suitable. Examples of the heating pressure unit include a combination of a heating roller and a pressure roller and a combination of a heating roller, a pressure roller, and an endless belt.

The fixing device is preferably a unit that includes a heater with a heating element, a film that contacts with the heater, and a pressure member that pressure-contacts with the heater via the film and makes a recording medium with an unfixed image formed pass through between the film and the pressure member for heat-fixing. Usually, heating by the heating pressure unit is preferably at 80° C. to 200° C.

Here, in the present invention, for example, a known optical fixing device may be used in combination with the fixing step and fixing unit or in place of these.

The discharging step is a step of discharging by applying a discharging bias to the electrostatic latent image bearing member, and this can be suitably carried out by a discharging unit.

The discharging unit is not particularly limited, is satisfactory as long as it is capable of applying a discharging bias to the electrostatic latent image bearing member, and can be appropriately selected from known dischargers. Suitable examples include a discharging lamp.

The cleaning step is a step of removing the toner remaining on the electrostatic latent image bearing member, and this can be suitably carried out by a cleaning unit.

The cleaning unit is not particularly limited, and is satisfactory as long as it is capable of removing the toner remaining on the electrostatic latent image bearing member, and can be appropriately selected from known cleaners. Suitable examples include a magnetic brush cleaner, an electrostatic brush cleaner, a magnetic roller cleaner, a blade cleaner, a brush cleaner, and a web cleaner.

The recycling step is a step of making the developing unit recycle the toner removed by the cleaning step, which can be suitably carried out by a recycling unit. The recycling unit is not particularly limited, and this can be a known conveying unit, or the like.

The control step is a step of controlling the respective steps, and the respective steps can be suitably controlled by a control unit.

The control unit is not particularly limited as long as it is capable of controlling operations of the respective units, and can be appropriately selected according to the purpose. Examples thereof include devices such as a sequencer and a computer.

Figure 6:
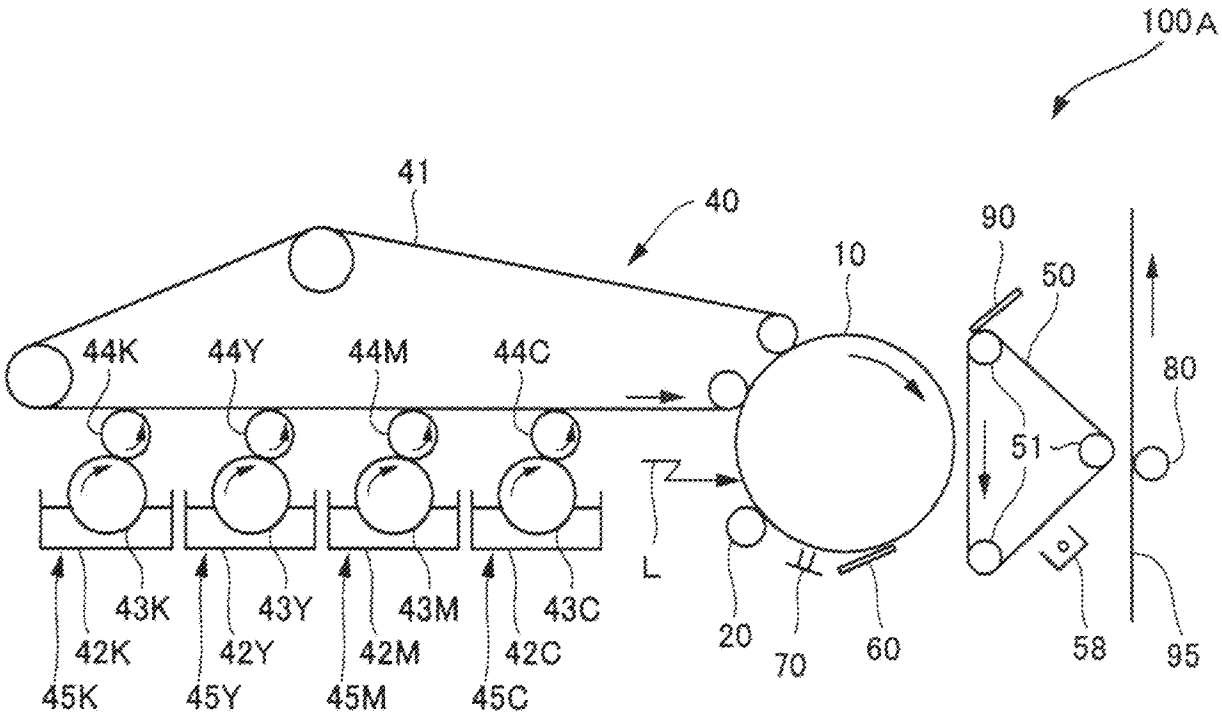
FIG. 6 is a schematic explanatory view showing one example of an image forming apparatus of the present invention.

FIG. 6 shows a first example of the image forming apparatus of the present invention. The image forming apparatus 100A includes a photoconductor drum 10, a charging roller 20, an exposing device (not shown), a developing device 40, an intermediate transfer belt 50, a cleaning device 60 having a cleaning blade, and a discharging lamp 70.

The intermediate transfer belt 50 is an endless belt stretched by three rollers 51 disposed inside, and is movable in the arrow direction in the figure. A part of the three rollers 51 also functions as a transfer bias roller that is capable of applying a transfer bias (primary transfer bias) to the intermediate transfer belt 50. In addition, in the vicinity of the intermediate transfer belt 50, a cleaning device 90 having a cleaning blade is disposed. Further, a transfer roller 80 capable of applying a transfer bias (secondary transfer bias) to transfer a toner image onto a transfer sheet 95 is disposed opposite to the intermediate transfer belt 50. In addition, around the intermediate transfer belt 50, disposed is a corona charging device 58 for imparting a charge to the toner image on the intermediate transfer belt 50, with respect to a rotating direction of the intermediate transfer belt 50, between a contact portion between the photoconductor drum 10 and the intermediate transfer belt 50 and a contact portion between the intermediate transfer belt 50 and the transfer sheet 95.

The developing device 40 is composed of a developing belt 41 and a black development unit 45K, a yellow development unit 45Y, a magenta development unit 45M, and a cyan development unit 45C provided side by side around the developing belt 41. Here, the development unit 45 for each color includes a developer containing portion 42, a developer feed roller 43, and a developing roller (developer bearing member) 44. In addition, the developing belt 41 is an endless belt stretched by a plurality of belt rollers, and is movable in the arrow direction in the figure. Further, a part of the developing belt 41 is in contact with the photoconductor drum 10.

Next, a method for forming an image by using the image forming apparatus 100A will be described. First, the surface of the photoconductor drum 10 is uniformly charged with use of the charging roller 20, and then an exposure light L is exposed to the photoconductor drum 10 with use of an exposing device (not shown) to form an electrostatic latent image. Next, the electrostatic latent image formed on the photoconductor drum 10 is developed by a toner fed from the developing device 40 to form a toner image. Further, the toner image formed on the photoconductor drum 10 is transferred (primary transfer) onto the intermediate transfer belt 50 by a transfer bias applied from the rollers 51 and is then transferred (secondary transfer) onto the transfer sheet 95 by a transfer bias applied from the transfer roller 80. On the other hand, the photoconductor drum 10 from which the toner image has been transferred to the intermediate transfer belt 50 is discharged by the discharging lamp 70 after a toner remaining on the surface is removed by the cleaning device 60.

Figure 7:
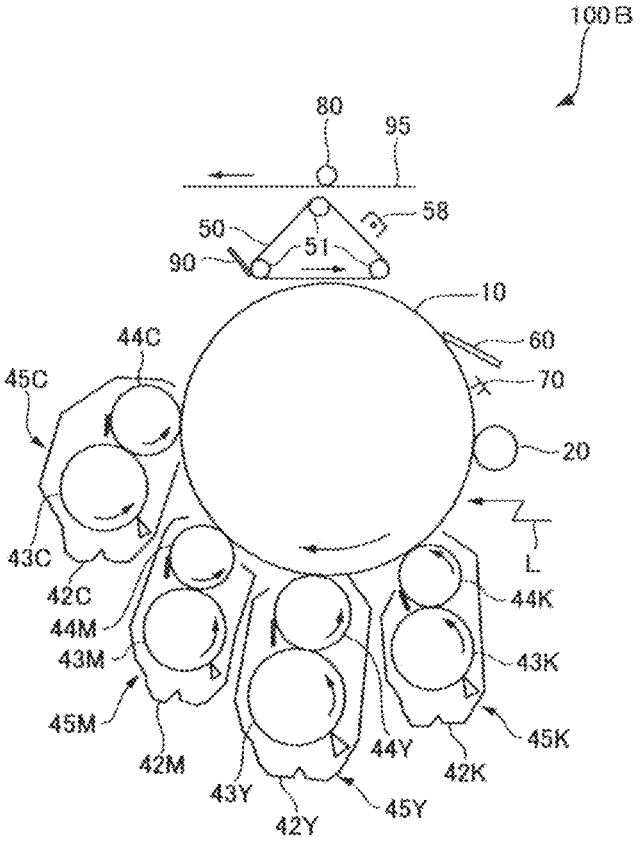
FIG. 7 is a schematic explanatory view showing the other example of an image forming apparatus of the present invention.

FIG. 7 shows a second example of the image forming apparatus to be used in the present invention. The image forming apparatus 100B has the same configuration as that of the image forming apparatus 100A except that no developing belt 41 is provided, and a black development unit 45K, a yellow development unit 45Y, a magenta development unit 45M, and a cyan development unit 45C are disposed in a directly opposing manner around the photoconductor drum 10.

Figure 8:
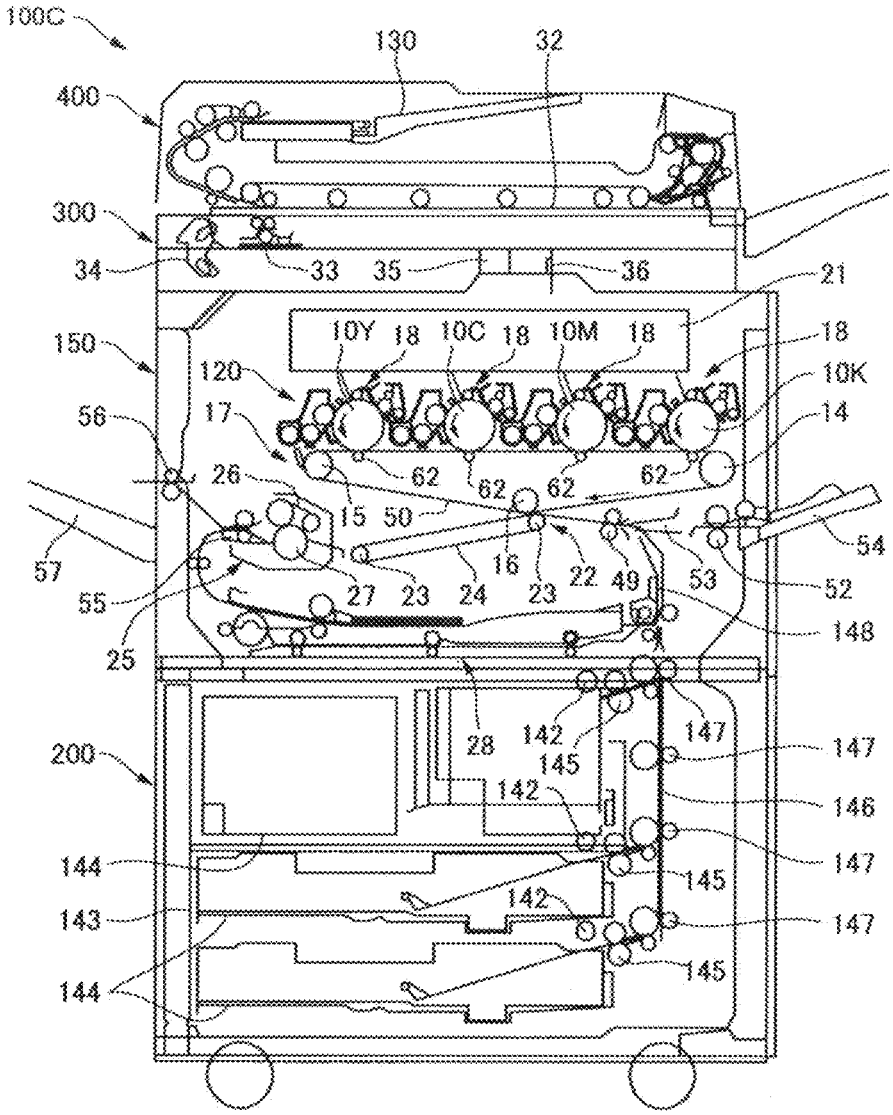
FIG. 8 is a schematic explanatory view showing an example using a tandem type color image forming apparatus of an image forming apparatus of the present invention.

FIG. 8 shows a third example of the image forming apparatus to be used in the present invention. The image forming apparatus 100C is a tandem-type color image forming apparatus, and includes a copier body 150, a paper feed table 200, a scanner 300, and an automatic document feeder (ADF) 400.

An intermediate transfer belt 50 provided at the center portion of the copier body 150 is an endless belt stretched around three rollers 14, 15, and 16, and is rotatable in the arrow direction in the figure. In the vicinity of the roller 15, disposed is a cleaning device 17 having a cleaning blade for removing a toner remaining on the intermediate transfer belt 50 from which the toner image has been transferred to recording paper. Yellow, cyan, magenta, and black image forming units 120Y, 120C, 120M, and 120K are juxtaposed in a manner opposing the intermediate transfer belt 50 stretched by the rollers 14 and 15 and along a conveying direction. In addition, in the vicinity of the image forming units 120, an exposing device 21 is disposed. Further, on the side of the intermediate transfer belt 50 opposite to the side where the image forming units 120 are disposed, a secondary transfer belt 24 is disposed. Here, the secondary transfer belt 24 is an endless belt stretched across a pair of rollers 23, and recording sheet that is conveyed on the secondary transfer belt 24 and the intermediate transfer belt 50 can contact between the rollers 16 and 23. In the vicinity of the secondary transfer belt 24, disposed is a fixing device 25 including a fixing belt 26 serving as an endless belt stretched across a pair of rollers and a pressure roller 27 disposed while being pressed against the fixing belt 26. Here, in the vicinity of the secondary transfer belt 24 and the fixing device 25, disposed is a sheet reversing device 28 for reversing recording paper when forming images on both surfaces of the recording paper.

Next, a method for forming a full-color image by using the image forming apparatus 100C will be described. First, a color document is set on a document table 130 of the automatic document feeder (ADF) 400, or the automatic document feeder 400 is opened to set a color document on a contact glass 32 of the scanner 300, and then the automatic document feeder 400 is closed. When a start switch (not shown) is pressed, the scanner 300 is driven, when the document has been set on the automatic document feeder 400, after the document is conveyed and moved onto the contact glass 32; on the other hand, when the document has been set on the contact glass 32, immediately, and a first traveler 33 including a light source and a second traveler 34 including a mirror travel. At this time, by reflecting by the second traveler 34 a reflected light from the document surface of light irradiated from the first traveler 33 and then receiving the reflected light by a reading sensor 36 via an imaging lens 35, the document is read, and thus black, yellow, magenta, and cyan image information are obtained.

Figure 9:
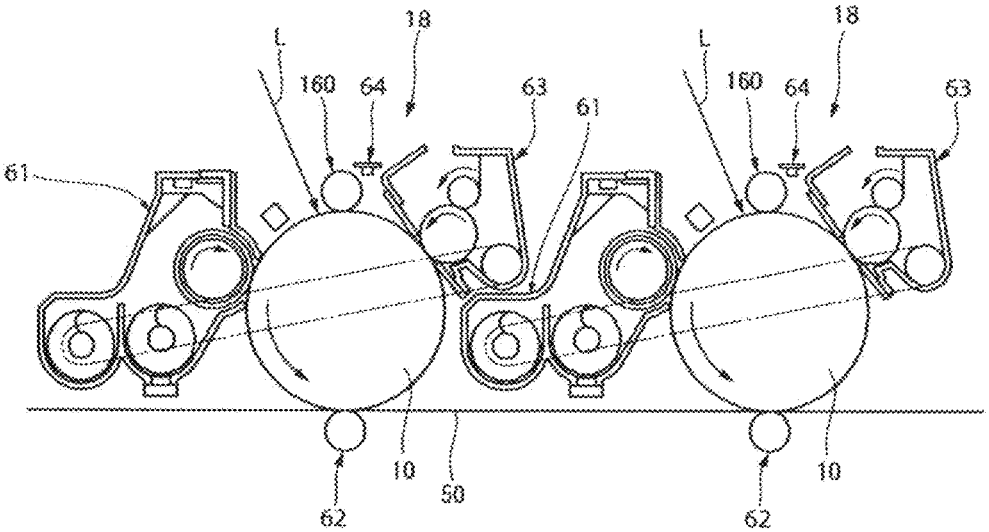
FIG. 9 is a partially enlarged schematic explanatory view of the image forming apparatus shown in FIG. 8.

The respective color image information is transmitted to the respective color image forming units 120, and respective color toner images are formed. The respective color image forming units 120 include, as shown in FIG. 9, photoconductor drums 10, charging rollers 160 that uniformly charge the photoconductor drums 10, exposing devices that expose an exposure light L to the photoconductor drums 10 based on respective color image information and thereby form respective color electrostatic latent images, developing devices 61 that develop the electrostatic latent images with respective color developers to form respective color toner images, transfer roller 62 for transferring the toner images onto the intermediate transfer belt 50, cleaning devices 63 having cleaning blades, and discharging lamps 64, respectively. The respective color toner images formed by the respective color image forming unit 120 are transferred (primary transfer) in sequence onto the intermediate transfer belt 50 that are supported by the rollers 14, 15, and 16 to move, and superimposed to form a composite toner image.

On the other hand, in the paper feed table 200, one of the paper feed rollers 142 is selectively rotated to let recording paper out from one of the paper feed cassettes 144 provided in multiple tiers in a paper bank 143, and the paper is separated one sheet by one sheet by a separation roller 145 and separately sent out to a paper feed path 146, conveyed by a conveyance roller 147 and guided to a paper feed path 148 within the copier body 150, and made to hit against a resist roller 49 and stopped. Alternatively, the paper feed roller is rotated to let recording paper on a manual feed tray 54, and the paper is separated one sheet by one sheet by the separation roller 52 and separately guided to a manual paper feed path 53, and made to hit against the resist roller 49 and stopped. Here, the resist roller 49 is generally used grounded, but it may be used in a state where a bias is applied for removing of powder of the recording sheets. Next, by rotating the resist roller 49 in timing with the composite toner image formed on the intermediate transfer belt 50, the recording paper is sent out between the intermediate transfer belt 50 and the secondary transfer belt 24, and the composite toner image is transferred (secondary transfer) onto the recording paper, a color image is transferred and formed on the recording paper. Here, a toner remaining on the intermediate transfer belt 50 from which the composite toner image has been transferred is cleaned by the cleaning device 17.

The recording paper onto which a composite image has been transferred is conveyed by the secondary transfer belt 24, and then fixed with the composite toner image by the fixing device 25. Next, the recording paper is switched in conveying path by a switching claw 55, and is discharged onto a discharged paper tray 57 by a discharge roller 56. Alternatively, the recording paper is switched in conveying path by the switching claw 55, is reversed by the sheet reversing device 28, is similarly formed with an image on the back surface as well, and then is discharged onto the discharged paper tray 57 by the discharge roller 56.

The image forming apparatus of the present invention can provide high-quality images over a long period.

EXAMPLES

Hereinafter, examples of the present invention will be described, however, the present invention is by no means limited to these embodiments.

Production Examples 1 to 12

Production of External Additives 1 to 12

For production of external additives 1 to 10, by mixing primary particles of silica having various average particle diameters and a treatment agent by a spray dryer and firing the mixtures under conditions described in Table 1, the primary particles were coalesced to produce coalescent particles, and then classification was performed by a classification device in order to obtain a sharp particle size distribution. In addition, external additives 11 to 12 were produced by only applying hydrophobizing treatment to primary particles of silica having various average particle diameters without performing treatment with the treatment agent.

Here, the treatment agent was prepared by adding 0.1 parts by mass of a treatment aid (water or a 1% by mass aqueous solution of acetic acid) to 1 part of methylmethoxysilane. The average particle diameters, shapes, etc., of secondary particles produced by coalescing the primary particles are shown in Table 1.

<Various Measurements>

For $Db_{50}$ in the coalescent particles (secondary particles), the particle diameters of coalescent particles were measured to determine a particle diameter where the accumulated value of a cumulative distribution when plotted from the smaller particle side reaches 50% by number. For $Db_{10}$, the particle diameters of coalescent particles were measured to determine a particle diameter where the accumulated value of a cumulative distribution when plotted from the smaller particle side reaches 10% by number.

For a number average particle diameter (Dba) of the coalescent particles (secondary particles), the maximum lengths (length of the arrow shown in FIG. 2) of aggregated particles were measured (the number of particles measured: 150). For an average diameter (Da) of primary particles of the coalescent particles, whole pictures are estimated from the outer frames of coalescent silica, and an average value of the maximum lengths (lengths of all arrows shown in FIG. 1) of the whole pictures was measured (the number of particles measured: 150).

Determination of the particle diameters of these respective particles was performed, with a sample for which the coalescent particles were dispersed in an appropriate solvent (THF or the like), and then the solvent was removed for drying and hardening on a substrate, by measuring the particle diameters of in a field of view by using a field emission-scanning electron microscope (FE-SEM, accelerating voltage: 5 kV to 8 kV, observation magnification: 8,000× to 10,000×).

<Production of Carrier A>

The following carrier raw materials were dispersed for 10 minutes by a homomixer to obtain a coating layer forming solution of an acryl resin and a silicone resin including alumina particles. The above-described coating layer forming solution was coated on the surface of fired ferrite power [$(MgO)_{1.8}(MnO)_{49.5}(Fe_2O_3)_{48.0}$: average particle diameter of 35 μm] used as a core material so as to give a thickness of 0.15 μm by using SPIRA COTA (manufactured by Okada Seiko Co., Ltd.) and dried to obtain coated ferrite powder. The obtained coated ferrite powder was fired by being allowed to stand at 150° C. for 1 hour in an electric furnace. After cooling, the ferrite powder bulk was disintegrated by use of a sieve with an aperture of 106 μm to obtain a carrier. For a film thickness measurement, a coating layer covering the carrier surface can be observed by observing a carrier section through a transmission electron microscope, an average value of its thickness is regarded as the thickness of a coating layer. Thus, a carrier A with a weight-average particle diameter of 35 μm was obtained.

[Raw Material of Carrier A]

| | |
|---|---|
| Acrylic resin solution (solid content: 50% by mass) | 21.0 parts by mass |
| Guanamine resin solution (solid content: 70% by mass) | 6.4 parts by mass |
| Alumina particles (0.3 μm, specific resistance of $10^{14}$ Ω · cm) | 7.6 parts by mass |
| Silicone resin solution (solid content: 23% by mass) [SR2410, manufactured by Dow Corning Toray Co., Ltd.] | 65.0 parts by mass |
| Aminosilane coupling agent (solid content: 100% by mass) [SR6020, manufactured by Dow Corning Toray Co., Ltd.] | 1 part by mass |
| Toluene | 60.0 parts by mass |
| Buthyl cellosolve | 60.0 parts by mass |

<Break or Collapse Evaluation of External Additive>

A total of 50 g placed in a 50 mL-bottle (manufactured by NICHIDEN-RIKA GLASS CO., LTD.) consisting of 0.5 g each of the external additives 1 to 12 and 49.5 g of the above-described carrier A was stirred by use of a rocking mill (manufactured by Seiwa Giken Co., Ltd.) under the conditions of 67 Hz and for 10 minutes. The stirred developer was diluted and dispersed into tetrahydrofuran (THF), the external additive was separated to the supernatant fluid side, and then field emission-scanning electron microscope (FE-SEM) observation was performed. By the FE-SEM observation, a rate (%) of the number of broken or collapsed particles in 1,000 particles of the external additive was determined. FIG. 4 shows a photograph of a measurement result where the rate of the number of broken or collapsed particles is 30% or less, and FIG. 5 shows a photograph of a measurement result where the rate of the number of broken or collapsed particles exceeds 30%. In the case of measurement, particles like a particle that existed on its own as shown by reference sign 2 of FIG. 3 and particles that existed on their own as shown within the black frames of FIG. 4 to FIG. 5 were counted as "broken or collapsed particles" to determine the rate.

TABLE 1

| Treatment agent | Primary particle/ treatment agent rate | Firing temperature/ ° C. | Firing time/hr | Db10/ nm | Db50/nm | Db50/Db10 | Average primary particle diameter (Da)/mm | Average secondary particle diameter (Dba)/nm | Average degree of coalescence | Breakability/ % |
|---|---|---|---|---|---|---|---|---|---|---|
| $MeSi(OMe)_3$ | 100/10 | 800 | 16 | 87 | 104 | 1.20 | 45 | 110 | 2.4 | 18 |
| $MeSi(OMe)_3$ | 100/10 | 800 | 16 | 132 | 149 | 1.13 | 58 | 155 | 2.7 | 20 |
| $MeSi(OMe)_3$ | 100/10 | 800 | 16 | 64 | 75 | 1.17 | 30 | 80 | 2.7 | 19 |
| $MeSi(OMe)_3$ | 100/10 | 800 | 16 | 161 | 184 | 1.14 | 82 | 190 | 2.3 | 16 |
| $MeSi(OMe)_3$ | 100/10 | 800 | 16 | 78 | 95 | 1.22 | 36 | 100 | 2.8 | 20 |
| $MeSi(OMe)_3$ | 100/10 | 800 | 16 | 60 | 71 | 1.18 | 28 | 76 | 2.7 | 16 |
| $MeSi(OMe)_3$ | 100/10 | 800 | 16 | 170 | 204 | 1.20 | 110 | 210 | 1.9 | 18 |

TABLE 1-continued

| Treatment agent | Primary particle/ treatment agent rate | Firing temperature/ ° C. | Firing time/hr | Db10/ nm | Db50/nm | Db50/Db10 | Average primary particle diameter (Da)/mm | Average secondary particle diameter (Dba)/nm | Average degree of coalescence | Breakability/ % |
|---|---|---|---|---|---|---|---|---|---|---|
| $MeSi(OMe)_3$ | 100/10 | 800 | 8 | 160 | 208 | 1.30 | 93 | 214 | 2.3 | 25 |
| $MeSi(OMe)_3$ | 100/10 | 400 | 8 | 98 | 115 | 1.17 | 58 | 120 | 2.1 | 32 |
| $MeSi(OMe)_3$ | 100/10 | 400 | 8 | 89 | 113 | 1.27 | 34 | 120 | 3.5 | 33 |
| — | — | — | — | 59 | 76 | 1.29 | 80 | — | — | — |
| — | — | — | — | 102 | 116 | 1.14 | 120 | — | — | — |

Production Example 13

Production of Crystalline Polyester Resin 1

202 parts by mass (1.00 mol) of sebacic acid, 154 parts by mass of 1,6-hexane diol (1.30 mol), and 0.5 parts by mass of tetrabutoxy titanate as a condensation catalyst were placed in a reaction tank equipped with a cooling tube, a stirrer, and a nitrogen introducing tube and allowed to react for 8 hours while distilling off water to be produced, at 180° C. under a nitrogen current. Next, the resultant was gradually heated up to 220° C. while being allowed to react for 4 hours under nitrogen current while distilling off water to be produced and 1,6-hexane diol, and the resultant was further allowed to react under a reduced pressure of 5 mmHg to 20 mmHg until the weight-average molecular weight Mw reached approximately 15,000 to obtain a [crystalline polyester resin 1]. The obtained [crystalline polyester resin 1] had Mw of 14,000 and a melting point of 66° C.

Production Example 14

Production of Non-Crystalline Polyester Resin 1

Non-Modified Polyester Resin 222 parts by mass of bisphenol A EO 2-mole adduct, 129 parts by mass of bisphenol A PO 2-mole adduct, 150 parts by mass of terephthalic acid, 15 parts by mass of adipic acid, and 0.5 parts by mass of tetrabutoxy titanate were placed in a reaction tank equipped with a cooling tube, a stirrer, and a nitrogen introducing tube and allowed to react for 8 hours while distilling off water to be produced, under normal pressure, at 230° C. under a nitrogen current. Next, the resultant was allowed to react under a reduced pressure of 5 mmHg to 20 mmHg, and cooled down to 180° C. at the point in time where the acid value had reached 2 mgKOH/g, and 35 parts by mass of trimellitic anhydride was added thereto and allowed to react for 3 hours under normal pressure to obtain a [non-crystalline polyester resin 1]. The obtained [non-crystalline polyester resin 1] had Mw of 6,000 and Tg of 54° C.

Production Example 15

Production of Non-Crystalline Polyester Resin 2

Non-Modified Polyester Resin 212 parts by mass of bisphenol A EO 2-mole adduct, 116 parts by mass of bisphenol A PO 2-mole adduct, 166 parts by mass of terephthalic acid, and 0.5 parts by mass of tetrabutoxy titanate were placed in a reaction tank equipped with a cooling tube, a stirrer, and a nitrogen introducing tube and allowed to react for 8 hours while distilling off water to be produced, under normal pressure, at 230° C. under a nitrogen current. Next, the resultant was allowed to react under a reduced pressure of 5 mmHg to 20 mmHg, and allowed to react until Mw reached approximately 15,000 to obtain a [non-crystalline polyester resin 2]. The obtained [non-crystalline polyester resin 2] had Mw of 14,000 and Tg of 60° C.

Production Example 16

Production of Non-Crystalline Polyester Resin 3

Non-Modified Polyester Resin 204 parts by mass of bisphenol A EO 2-mole adduct, 106 parts by mass of bisphenol A PO 2-mole adduct, 166 parts by mass of terephthalic acid, and 0.5 parts by mass of tetrabutoxy titanate were placed in a reaction tank equipped with a cooling tube, a stirrer, and a nitrogen introducing tube and allowed to react for 8 hours while distilling off water to be produced, under normal pressure, at 230° C. under a nitrogen current. Next, the resultant was allowed to react under a reduced pressure of 5 mmHg to 20 mmHg, and allowed to react until Mw reached approximately 40,000 to obtain a [non-crystalline polyester resin 3]. The obtained [non-crystalline polyester resin 3] had Mw of 38,000 and Tg of 62° C.

Production Example 17

Production of Polyester Prepolymer 720 parts by mass of bisphenol A EO 2-mole adduct, 90 parts by mass of bisphenol A PO 2-mole adduct, 290 parts by mass of terephthalic acid, and 1 part by mass of tetrabutoxy titanate were placed in a reaction tank equipped with a cooling tube, a stirrer, and a nitrogen introducing tube and allowed to react for 8 hours while distilling off water to be produced, under normal pressure, at 230° C. under a nitrogen current. Next, the resultant was allowed to react for 7 hours under a reduced pressure of 10 mmHg to 15 mmHg to obtain [intermediate polyester 1]. The obtained [intermediate polyester 1] had Mn of 3,200 and Mw of 9,300.

Then, 400 parts by mass of the obtained [intermediate polyester 1], 95 parts by mass of isophorone diisocyanate, and 500 parts by mass of ethyl acetate were placed in a reaction tank equipped with a cooling tube, a stirrer, and a nitrogen introducing tube and allowed to react at 80° C. for 8 hours under a nitrogen current to obtain a 50% by mass ethyl acetate solution of the [polyester prepolymer 1] having an isocyanate group at its end. The percentage by mass of free isocyanate of the [polyester prepolymer 1] was 1.47%.

Production Example 18

Production of Graft Polymer 480 parts by mass of xylene and 100 parts by mass of low molecular weight polyethylene (SANWAX LEL-400, manufactured by Sanyo Chemical Industries, Ltd.: softening point 128° C.) were placed in a reaction vessel set with a stirring rod and a thermometer and sufficiently dissolved, and after nitrogen substitution, a mixed solution of 740 parts by mass of styrene, 100 parts by mass of acrylonitrile, 60 parts by mass of butyl acrylate, 36 parts by mass of di-t-butylperoxy hexahydroterephthalate, and 100 parts by mass of xylene was dripped at 170° C. for 3 hours for polymerization, and further the resultant was allowed to stand at this temperature for 30 minutes. Next, desolventization was performed to synthesize a [graft polymer]. The obtained [graft polymer] had Mw of 24,000 and Tg of 67° C.

Production Example 19

Production of Toner Base 1

Ester Elongation Method

—Preparation of Releasing Agent Dispersion 1—

50 parts by mass of paraffin wax (HNP-9, manufactured by Nippon Seiro Co., Ltd., melting point 75° C.), 30 parts by mass of the [graft polymer], and 420 parts by mass of ethyl acetate were placed in a vessel set with a stirring rod and a thermometer, heated to 80° C. under stirring, and allowed to stand for 5 hours remaining at 80° C., and then cooled down to 30° C. in 1 hour, and the resultant was dispersed by use of a bead mill (ULTRAVISCOMILL, manufactured by Aimex Co., Ltd.) under the conditions of a feeding speed of 1 kg/hr, a disk circumferential speed of 6 m/second, 0.5 mm-zirconia beads filled at 80% by volume, and 3 passes to obtain a [releasing agent dispersion 1].

—Preparation of Master Batch 1—

| | |
|---|---|
| Non-crystalline polyester resin 1 | 100 parts by mass |
| Carbon black (Printex 35, manufactured by Degussa AG)<br>(DBP oil absorption amount: 42 mL/100 g, pH: 9.5) | 100 parts by mass |
| Ion exchanged water | 50 parts by mass |

The above raw materials were mixed by a Henschel mixer (manufactured by Nippon Coke & Engineering Co., Ltd.). The obtained mixture was kneaded by a two-roll mill. The kneading was started from a kneading temperature of 90° C., which was thereafter gradually cooled down to 50° C. The obtained kneaded product was pulverized by a pulverizer (manufactured by Hosokawa Micron Corporation) to prepare a [master batch 1].

—Preparation of Oil Phase 1—

107 parts by mass of the [non-crystalline polyester resin 1], 75 parts by mass of the [releasing agent dispersion 1], 18 parts by mass of the [master batch 1], and 73 parts by mass of ethyl acetate were placed in a vessel equipped with a thermometer and a stirrer, pre-dispersed by the stirrer, and then stirred at a rotation speed of 5,000 rpm with a TK-type homomixer (manufactured by Primix Corporation) to be uniformly dissolved and dispersed to obtain an [oil phase 1].

—Production of Aqueous Dispersion of Resin Fine Particles—

600 parts by mass of water, 120 parts by mass of styrene, 100 parts by mass of methacrylic acid, 45 parts by mass of butyl acrylate, 10 parts by mass of sodium alkyl allyl sulfosuccinate (ELEMINOL JS-2, manufactured by Sanyo Chemical Industries, Ltd.), and 1 part by mass of ammonium persulfate were charged in a reaction vessel set with a stirring rod and a thermometer and stirred at 400 rpm for 20 minutes, and as a result, a white emulsion was obtained. The emulsion was heated up to a system temperature of 75° C. and allowed to react for 6 hours. Further, 30 parts by mass of a 1% aqueous ammonium persulfate solution was added thereto, and the resultant was aged at 75° C. for 6 hours to obtain an [aqueous dispersion of resin fine particles]. Particles included in this [aqueous dispersion of resin fine particles] had a volume-average particle diameter of 60 nm, the resin component had a weight-average molecular weight of 140,000, and Tg was 73° C.

—Preparation of Aqueous Phase 1—

990 parts by mass of water, 83 parts by mass of the [aqueous dispersion of resin fine particles], 37 parts by mass of a 48.5% by mass aqueous solution of sodium dodecyl diphenyl ether disulfonate (ELEMINOL MON-7, manufactured by Sanyo Chemical Industries, Ltd.), and 90 parts by mass of ethyl acetate were mixed and stirred to obtain an [aqueous phase 1].

—Emulsification or Dispersion—

45 parts by mass of an ethyl acetate solution of the [polyester prepolymer 1] and 3 parts by mass of a 50% by mass ethyl acetate solution of isophorone diamine were added to 273 parts by mass of the [oil phase 1] and stirred at a rotation speed of 5,000 rpm by a TK-type homomixer (manufactured by Primix Corporation) to be uniformly dissolved and dispersed to obtain an [oil phase 1']. Next, 400 parts by mass of the [aqueous phase 1] was placed in another vessel set with a stirrer and a thermometer, and stirred at 13,000 rpm with a TK-type homomixer (manufactured by Primix Corporation) while being added with the [oil phase 1'], and the resultant was emulsified for 1 minute to obtain an [emulsified slurry 1].

—Desolventization to Washing to Drying—

The [emulsified slurry 1] was charged into a vessel set with a stirrer and a thermometer, and desolventized at 30° C. for 8 hours to obtain a [slurry 1]. The obtained [slurry 1] was filtered under reduced pressure, and then subjected to the following washing treatment.

(1) 100 parts by mass of ion-exchanged water was added to a filter cake and mixed by a TK-type homomixer (for 5 minutes at a rotation speed of 6,000 rpm), and then the resultant was filtered.

(2) 100 parts by mass of a 10% by mass aqueous sodium hydroxide solution was added to the filter cake prepared in (1) and mixed by the TK-type homomixer (for 10 minutes at a rotation speed of 6,000 rpm), and then the resultant was filtered under reduced pressure.

(3) 100 parts by mass of 10% by mass hydrochloric acid was added to the filter cake prepared in (2) and mixed by the TK-type homomixer (for 5 minutes at a rotation speed of 6,000 rpm), and then the resultant was filtered.

(4) 300 parts by mass of ion-exchanged water was added to the filter cake prepared in (3) and mixed by the TK-type homomixer (for 5 minutes at 6000 rmp), and then the resultant was filtered. The above procedure was conducted two times to obtain a [filter cake 1].

The thus obtained [filter cake 1] was dried at 45° C. for 48 hours by using a circulation dryer. Thereafter, the cake was sieved through a mesh having an aperture of 75 μm to prepare a [toner base body 1].

Production Example 20

Production of Toner Base 2

Ester Elongation Method

—Preparation of Crystalline Polyester Resin Dispersion 1—

100 parts by mass of the [crystalline polyester resin 1] and 400 parts by mass of ethyl acetate were placed in a vessel set with a stirring rod and a thermometer, heated and dissolved at 75° C. under stirring, and then cooled down to 10° C. or less in 1 hour, and the resultant was dispersed for 5 hours by use of a bead mill (ULTRAVISCOMILL, manufactured by Aimex Co., Ltd.) under the conditions of a feeding speed of 1 kg/hr, a disk circumferential speed of 6 m/second, and 0.5 mm-zirconia beads filled at 80% by volume to obtain a [crystalline polyester resin dispassion 1].

—Preparation of Oil Phase 2—

93 parts by mass of the [non-crystalline polyester resin 1], 68 parts by mass of the [crystalline polyester resin dispersion 1], 75 parts by mass of the [releasing agent dispersion 1], 18 parts by mass of the [master batch 1], and 19 parts by mass of ethyl acetate were placed in a vessel equipped with a thermometer and a stirrer, pre-dispersed by the stirrer, and then stirred at a rotation speed of 5,000 rpm with a TK-type homomixer (manufactured by Primix Corporation) to be uniformly dissolved and dispersed to obtain an [oil phase 2].

—Emulsification or Dispersion—

45 parts by mass of an ethyl acetate solution of the [polyester prepolymer 1] and 3 parts by mass of a 50% by mass ethyl acetate solution of isophorone diamine were added to 273 parts by mass of the [oil phase 2] and stirred at a rotation speed of 5,000 rpm with a TK-type homomixer (manufactured by Primix Corporation) to be uniformly dissolved and dispersed to obtain an [oil phase 2']. Next, 400 parts by mass of the [aqueous phase 1] was placed in another vessel set with a stirrer and a thermometer, and stirred at 13,000 rpm with a TK-type homomixer (manufactured by Primix Corporation) while being added with the [oil phase 2'], and the resultant was emulsified for 1 minute to obtain an [emulsified slurry 2].

—Desolventization to Washing to Drying—

The [emulsified slurry 2] was desolventized, washed, dried, and sieved under the same conditions as those for the [emulsified slurry 1] to prepare a toner base 2.

Production Example 21

Production of Toner Base 3

Dissolution Suspension Method

—Preparation of Oil Phase 3—

107 parts by mass of the [non-crystalline polyester resin 1], 23 parts by mass of the [non-crystalline polyester resin 3], 75 parts by mass of the [releasing agent dispersion 1], 18 parts by mass of the [master batch 1], and 97 parts by mass of ethyl acetate were placed in a vessel equipped with a thermometer and a stirrer, pre-dispersed by the stirrer, and then stirred at a rotation speed of 5,000 rpm with a TK-type homomixer (manufactured by Primix Corporation) to be uniformly dissolved and dispersed to obtain an [oil phase 3].

—Emulsification or Dispersion—

400 parts by mass of the [aqueous phase 1] was placed in another vessel set with a stirrer and a thermometer, and stirred at 13,000 rpm with a TK-type homomixer (manufactured by Primix Corporation) while being added with the [oil phase 3], and the resultant was emulsified for 1 minute to obtain an [emulsified slurry 3].

—Desolventization to Washing to Drying—

The [emulsified slurry 3] was desolventized, washed, dried, and sieved under the same conditions as those for the [emulsified slurry 1] to prepare a toner base 3.

Production Example 22

Production of Toner Base 4

Dissolution Suspension Method

—Preparation of Oil Phase 4—

93 parts by mass of the [non-crystalline polyester resin 1], 23 parts by mass of the [non-crystalline polyester resin 3], 68 parts by mass of the [crystalline polyester resin dispersion 1], 75 parts by mass of the [releasing agent dispersion 1], 18 parts by mass of the [master batch 1], and 43 parts by mass of ethyl acetate were placed in a vessel equipped with a thermometer and a stirrer, pre-dispersed by the stirrer, and then stirred at a rotation speed of 5,000 rpm with a TK-type homomixer (manufactured by Primix Corporation) to be uniformly dissolved and dispersed to obtain an [oil phase 4].

—Emulsification or Dispersion—

400 parts by mass of the [aqueous phase 1] was placed in another vessel set with a stirrer and a thermometer, and stirred at 13,000 rpm with a TK-type homomixer (manufactured by Primix Corporation) while being added with the [oil phase 4], and the resultant was emulsified for 1 minute to obtain an [emulsified slurry 4].

—Desolventization to Washing to Drying—

The [emulsified slurry 4] was desolventized, washed, dried, and sieved under the same conditions as those for the [emulsified slurry 1] to prepare a toner base 4.

Production Example 23

Production of Toner Base 5

Emulsion Aggregation Method

—Preparation of Non-Crystalline Polyester Resin Dispersion 2—

60 parts by mass of ethyl acetate was added and dissolved into 60 parts by mass of the [non-crystalline polyester resin 2]. Next, 120 parts by mass of the resin solution was added to an [aqueous phase] for which 120 parts by mass of water, 2 parts by mass of an anionic surface active agent (NEOGEN R, manufactured by Daiichi Kogyo Seiyaku Co., Ltd.), and 2.4 parts by mass of a 2% by mass aqueous sodium hydroxide solution were mixed, and the resultant was emulsified by use of a homogenizer (Ultra Turrax T50, manufactured by IKA GmbH), and then subjected to emulsification by a Manton Gaulin high-pressure homogenizer (manufactured by Gaulin Corp.) to obtain an [emulsified slurry].

Next, the [emulsified slurry] was charged into a vessel set with a stirrer and a thermometer, and desolventized at 30° C. for 4 hours to obtain a [non-crystalline polyester resin dispersion 2]. The volume-average particle diameter of particles in the obtained [non-crystalline polyester resin dispersion 2] was 0.15 μm when measured by a particle size distribution analyzer (LA-920, manufactured by HORIBA, Ltd.).

—Preparation of Non-Crystalline Polyester Resin Dispersion 3—

A [non-crystalline polyester resin dispersion 3] was obtained in the same manner as preparation of the [non-crystalline polyester resin dispersion 2] described above, except that the [non-crystalline polyester resin 2] was substituted by a [non-crystalline polyester resin 3]. The volume-average particle diameter of particles in the obtained [non-crystalline polyester resin dispersion 3] was 0.16 μm when measured by a particle size distribution analyzer (LA-920, manufactured by HORIBA, Ltd.).

—Preparation of Releasing Agent Dispersion 2—

25 parts by mass of paraffin wax (HNP-9, manufactured by Nippon Seiro Co., Ltd., melting point 75° C.), 1 part by mass of an anionic surface active agent (NEOGEN R, manufactured by Daiichi Kogyo Seiyaku Co., Ltd.), and 200 parts by mass of water were mixed, and melted at 90° C. Next, this melt was emulsified by a homogenizer (Ultra Turrax T50, manufactured by IKA GmbH), and then subjected to emulsification by a Manton Gaulin high-pressure homogenizer (manufactured by Gaulin Corp.) to obtain a [releasing agent dispersion 2].

—Preparation of Colorant Dispersion 1—

20 parts by mass of carbon black (Printex 35, manufactured by Degussa AG), 0.5 parts by mass of an anionic surface active agent (NEOGEN R, manufactured by Daiichi Kogyo Seiyaku Co., Ltd.), and 80 parts by mass of water were mixed, and dispersed by a TK-type homomixer (manufactured by Primix Corporation) to obtain a [colorant dispersion 1].

—Aggregation—

235 parts by mass of the [non-crystalline polyester resin dispersion 2], 57 parts by mass of the [non-crystalline polyester resin dispersion 3], 45 parts by mass of the [releasing agent dispersion 2], 26 parts by mass of the [colorant dispersion 1], and 600 parts by mass of water were placed in a vessel equipped with a thermometer and a stirrer, and stirred at 30° C. for 30 minutes. This dispersion was added with a 2% by mass aqueous sodium hydroxide solution to be adjusted to pH10. Then, this dispersion was stirred at 5,000 rpm by a homogenizer (Ultra Turrax T50, manufactured by IKA GmbH) while being heated up to 45° C., while a 5% by mass aqueous magnesium chloride solution was gradually dripped. The resultant was maintained at 45° C. until aggregated particles had grown to a volume-average particle diameter of 5.3 μm. This was added with a 2% by mass aqueous sodium hydroxide solution to be kept at pH9 while being heated up to 90° C., and kept for 2 hours in this state, and then cooled down to 20° C. at 1° C./minute to obtain a [slurry 5].

—Desolventization to Washing to Drying—

The [slurry 5] was washed, dried, and sieved under the same conditions as those for the [slurry 1] to prepare a toner base 5.

Production Example 24

Production of Toner Base 6

Emulsion Aggregation Method

—Preparation of Crystalline Polyester Resin Dispersion 2—

60 parts by mass of ethyl acetate was added and dissolved into 60 parts by mass of the [crystalline polyester resin 1] by mixing and stirring at 60° C. Next, 120 parts by mass of the resin solution was added to an [aqueous phase] for which 120 parts by mass of water, 2 parts by mass of an anionic surface active agent (NEOGEN R, manufactured by Daiichi Kogyo Seiyaku Co., Ltd.), and 2.4 parts by mass of a 2% by mass aqueous sodium hydroxide solution were mixed, and the resultant was emulsified by use of a homogenizer (Ultra Turrax T50, manufactured by IKA GmbH), and then subjected to emulsification by a Manton Gaulin high-pressure homogenizer (manufactured by Gaulin Corp.) to obtain an [emulsified slurry].

Next, the [emulsified slurry] was charged into a vessel set with a stirrer and a thermometer, and desolventized at 60° C. for 4 hours to obtain a [crystalline polyester resin dispersion 2]. The volume-average particle diameter of particles in the obtained [crystalline polyester resin dispersion 2] was 0.17 μm when measured by a particle size distribution analyzer (LA-920, manufactured by HORIBA, Ltd.).

—Aggregation—

207 parts by mass of the [non-crystalline polyester resin dispersion 2], 57 parts by mass of the [non-crystalline polyester resin dispersion 3], 28 parts by mass of the [crystalline polyester resin dispersion 2], 45 parts by mass of the [releasing agent dispersion 2], 26 parts by mass of the [colorant dispersion 1], and 600 parts by mass of water were placed in a vessel equipped with a thermometer and a stirrer, and stirred at 30° C. for 30 minutes. This dispersion was added with a 2% by mass aqueous sodium hydroxide solution to be adjusted to pH10. Then, this dispersion was stirred at 5,000 rpm by a homogenizer (Ultra Turrax T50, manufactured by IKA GmbH) while being heated up to 45° C., while a 5% by mass aqueous magnesium chloride solution was gradually dripped. The resultant was maintained at 45° C. until aggregated particles had grown to a volume-average particle diameter of 5.3 μm. This was cooled down to 20° C. to obtain a [slurry 6].

—Desolventization to Washing to Drying—

The [slurry 6] was washed, dried, and sieved under the same conditions as those for the [emulsified slurry 1] to prepare a toner base 6.

Production Example 25

Production of Toner Base 7

Pulverizing Method

—Preparation of Master Batch 2—

| | |
|---|---|
| Non-crystalline polyester resin 2 | 100 parts by mass |
| Carbon black (Printex 35, manufactured by Degussa AG)<br>(DBP oil absorption amount: 42 mL/100 g, pH: 9.5) | 100 parts by mass |
| Ion exchanged water | 50 parts by mass |

The above raw materials were mixed by a Henschel mixer (Henschel 20B, manufactured by Nippon Coke & Engineering Co., Ltd.). The obtained mixture was kneaded by a two-roll mill. The kneading was started from a kneading temperature of 90° C., which was thereafter gradually cooled down to 50° C. The obtained kneaded product was pulverized by a pulverizer (manufactured by Hosokawa Micron Corporation) to prepare a [master batch 2].

—Melt Kneading/Pulverization/Classification—

49 parts by mass of the [non-crystalline polyester resin 2], 40 parts by mass of the [non-crystalline polyester resin 3], 6 parts by mass of paraffin (HNP-9, manufactured by Nippon Seiro Co., Ltd., melting point 75° C.), and 12 parts by mass of the [master batch 2] were preliminarily mixed for 3 minutes at 1,500 rpm by use of a Henschel mixer (Henschel 20B, manufactured by Nippon Coke & Engineering Co., Ltd.), and then melt-kneaded by a single-screw kneader (small-sized Buss co-kneader, manufactured by Buss AG) under the conditions of a preset temperature (inlet part: 90° C.), an outlet part (60° C.), and a feed amount (10 kg/Hr). The obtained kneaded product was rolled and cooled, and coarsely pulverized by a pulverizer (manufactured by Hosokawa Micron Corporation). Next, the resultant was finely pulverized, by an I-type mill (manufactured by Nippon Pneumatic Mfg. Co., Ltd.), under the conditions of an air pressure (6.0 atm/cm$^2$) and a feed amount (0.5 kg/hr) by use of a planar collision plate, and further classified by a classifier (Model IDS-2, manufactured by Alpine AG) to obtain a [toner base 7].

Production Example 26

Production of Toner Base 8

Pulverizing Method

—Melt Kneading/Pulverization/Classification—

54 parts by mass of the [non-crystalline polyester resin 2], 27 parts by mass of the [non-crystalline polyester resin 3], 8 parts by mass of the [crystalline polyester resin 1], 6 parts by mass of paraffin (HNP-9, manufactured by Nippon Seiro Co., Ltd., melting point 75° C.), and 12 parts by mass of the [master batch 2] were preliminarily mixed for 3 minutes at 1,500 rpm by use of a Henschel mixer (Henschel 20B, manufactured by Nippon Coke & Engineering Co., Ltd.), and then melt-kneaded by a single-screw kneader (small-sized Buss co-kneader, manufactured by Buss AG) under the conditions of a preset temperature (inlet part: 90° C.), an outlet part (60° C.), and a feed amount (10 kg/Hr). The obtained kneaded product was rolled and cooled, and coarsely pulverized by a pulverizer (manufactured by Hosokawa Micron Corporation). Next, the resultant was finely pulverized, by an I-type mill (Model IDS-2, manufactured by Nippon Pneumatic Mfg. Co., Ltd.), under the conditions of an air pressure (6.0 atm/cm$^2$) and a feed amount (0.5 kg/hr) by use of a planar collision plate, and further classified by a classifier (132MP, manufactured by Alpine AG) to obtain a [toner base 7].

<Preparation of Toners 1 to 26>

Toner 1 to toner 26 were obtained in accordance with Tables 3-1 to 3-3 by mixing, into 100 parts by mass each of the obtained [toner base 1] to [toner base 8], 2.0 parts by mass of any of the external additive 1 to external additive 12, 2.0 parts by mass of silica (trade name "H1303VP," manufactured by Clariant AG) having a voltage-average particle diameter of 20 nm, and 0.6 parts by mass of titanium oxide (trade name "JMT-1501B," manufactured by Tayca Corporation) by a Henschel mixer (manufactured by Nippon Coke & Engineering Co., Ltd.), and passing the mixtures through a sieve having an aperture of 500 mesh.

<Production of Core Particles 1>

$MnCO_3$, $Mg(OH)_2$, and $Fe_2O_3$ powders were weighed, and mixed to obtain a mixed powder. This mixed powder was temporarily fired at 900° C. for 3 hours under an atmosphere by a heating furnace, and the obtained temporarily fired product was cooled, and then pulverized into a powder having a particle diameter of substantially 1 μm. This powder was added with 1% by mass of a dispersing agent along with water to prepare a slurry, and this slurry was fed to a spray dryer for granulation to obtain a granulated product having an average particle diameter of approximately 40 μm. This granulated product was loaded into a firing furnace and fired, under a nitrogen atmosphere, at 1,180° C. for 4 hours. The obtained fired product was disintegrated by a disintegrator, and then adjusted in particle size by sieving to obtain [core particles 1] which are spherical ferrite particles having a voltage-average particle diameter of approximately 35 μm. The [core particles 1] had SF-1 of 135, SF-2 of 122, and Ra of 0.63 μm.

<Production of Core Particles 2>

$MnCO_3$, $Mg(OH)_2$, and $Fe_2O_3$ powders were weighed, and mixed to obtain a mixed powder. This mixed powder was temporarily fired at 900° C. for 3 hours under an atmosphere by a heating furnace, and the obtained temporarily fired product was cooled, and then pulverized into a powder having a particle diameter of substantially 1 μm. This powder was added with 1% by mass of a dispersing agent along with water to prepare a slurry, and this slurry was fed to a spray dryer for granulation to obtain a granulated product having an average particle diameter of approximately 40 μm. This granulated product was loaded into a firing furnace and fired, under a nitrogen atmosphere, at 1,300° C. for 5 hours. The obtained fired product was disintegrated by a disintegrator, and then adjusted in particle size by sieving to obtain [core particles 2] which are spherical ferrite particles having a voltage-average particle diameter of approximately 35 μm. This [core particles 2] had SF-1 of 125, SF-2 of 119, and Ra of 0.45 μm.

<Production of Core Particles 3>

$MnCO_3$, $Mg(OH)_2$, $Fe_2O_3$, and $SrCO_3$ powders were weighed, and mixed to obtain a mixed powder. This mixed powder was calcined at 850° C. for 1 hour under an atmosphere by a heating furnace, and the obtained calcined product was cooled, and then pulverized into a powder having a particle diameter of 3 μm or less. This powder was added with 1% by mass of a dispersing agent along with water to prepare a slurry, and this slurry was fed to a spray dryer for granulation to obtain a granulated product having a volume-average particle diameter of approximately 40 μm. This granulated product was loaded into a firing furnace and fired, under a nitrogen atmosphere, at 1,120° C. for 4 hours. The obtained fired product was disintegrated by a disintegrator, and then adjusted in particle size by sieving to obtain [core particles 3] which are spherical ferrite particles having a voltage-average particle diameter of approximately 35 μm. The [core particles 3] had SF-1 of 145, SF-2 of 155, and Ra of 0.85 p.m.

<Production of Conductive Inorganic Fine Particles 1>

100 g of aluminum oxide (AKP-30, manufactured by Sumitomo Chemical Co., Ltd.) was dispersed into 1 L of water to prepare a suspension, and this fluid was warmed to 70° C. A solution for which 11.6 g of stannic chloride was dissolved in 1 L of 2N hydrochloric acid and 12% by mass ammonia water were dripped into this suspension in 40 minutes so that the suspension reached pH of 7 to 8. Subsequently, a solution for which 36.7 g of indium chloride and 5.4 g of stannic chloride were dissolved in 450 mL of 2N hydrochloric acid and 12% by mass ammonia water were dripped in 1 hour so that the suspension has pH of 7 to 8. After dripping, a cake obtained by filtering and washing the suspension was dried at 110° C. This dry powder was then treated at 500° C. for 1 hour in a nitrogen current to obtain [conductive inorganic fine particles 1]. The obtained [conductive inorganic fine particles 1] had a number-average particle diameter of 300 nm and a voltage specific resistance of 4 Ω·cm.

<Production of Non-Conductive Inorganic Fine Particles 1>

100 g of aluminum oxide (AKP-30, manufactured by Sumitomo Chemical Co., Ltd.) was dispersed into 1 L of water to prepare a suspension, and this fluid was warmed to 70° C. A solution for which 10 g of stannic chloride and 0.30 g of phosphorus pentoxide were dissolved in 100 mL of 2N hydrochloric acid and 12% by mass ammonia water were dripped into this suspension in 12 minutes so that the suspension reached pH of 7 to 8. After dripping, a cake obtained by filtering and washing the suspension was dried at 110° C. This dry powder was then treated at 500° C. for 1 hour in a nitrogen current to obtain [non-conductive inorganic fine particles 1]. The obtained [non-conductive inorganic fine particles 1] had a number-average particle diameter of 300 nm and a voltage specific resistance of 1200 Ω·cm.

<Production of Coating Resin 1>

300 g of toluene was charged in a flask with a stirring rod, and heated up to 90° C. under a nitrogen gas current. Next, into this, a mixture of 84.4 g (200 mmol: Silaplane TM-0701T/manufactured by Chisso Corporation) of 3-methacryloxypropyl tris(trimethylsiloxy)silane expressed by $CH_2{=}CMe\text{-}COO{-}C_3H_6{-}Si(OSiMe_3)_3$ (in the above formula, Me denotes a methyl group), 37.2 g (150 millimoles) of 3-methacryloxypropyltrimethoxysilane, 65.0 g (650 mmol) of methyl methacrylate, and 0.58 g (3 mmol) of 2,2'-azobis-2-methyl butyronitrile was dripped in 1 hour. After the dripping ends, a solution for which 0.06 g (0.3 mmol) of 2,2'-azobis-2-methyl butyronitrile was dissolved in 15 g of toluene was further added (a total amount of 2,2'-azobis-2-methyl butyronitrile 0.64 g=3.3 mmol), and mixed at 90° C. to 100° C. for 3 hours to effect radical copolymerization to obtain a [coating resin 1].

The obtained [coating resin 1] had Mw of 34,000. Then, this [coating resin 1] solution was diluted with toluene so as to reach a non-volatile content of 25% by mass. The [coating resin 1] solution thus obtained had a viscosity of 8.7 $mm^2/s$ and a specific gravity of 0.91.

<Preparation of Carrier 1>

26 parts by mass of a methyl silicone resin (Mw: 15,000, solid content: 25% by mass), 2.5 parts by mass of an acrylic resin (Hitaloid 3001, solid content: 50% by mass, manufactured by Hitachi Chemical Company, Ltd.), 5 parts by mass of a benzoguanamine-based resin (Mycoat 106, solid content: 77% by mass, manufactured by Mitsui Cytec Ltd.), 20 parts by mass of the [conductive inorganic fine particles 1], 2 parts by mass of diisopropoxybis(ethylacetoacetate)titanium TC-750 (manufactured by Matsumoto Fine Chemical Co., Ltd.) as a catalyst, and 1.4 parts by mass of SH6020 (manufactured by Toray Silicone Co., Ltd.) as a silane coupling agent prepared from di-functional or tri-functional monomers were diluted with toluene to obtain a resin solution with a solid content of 10% by mass. This resin solution was coated on 1000 parts by mass of [core particles 1] by a dipping method using a multifunctional mixer. At this time, the carrier core temperature was set to 100° C., the resin solution was charged into the mixer, and a mixing stirring blade was rotated until the coating liquid evaporated to perform coating and stirring/drying treatment, and a carrier was taken out. The obtained carrier was fired at 180° C. for 2 hours in an electric furnace to obtain a carrier 1. This carrier 1 had a work function of 4.0 eV and SF-2 of 114, and the carrier bulk density was 2.42 $g/cm^3$.

<Preparation of Carrier 2>

26 parts by mass of a methyl silicone resin (Mw: 15,000, solid content: 25% by mass), 2.5 parts by mass of an acrylic resin (Hitaloid 3001, solid content: 50% by mass, manufactured by Hitachi Chemical Company, Ltd.), 5 parts by mass of a benzoguanamine-based resin (Mycoat 106, solid content: 77% by mass, manufactured by Mitsui Cytec Ltd.), 16.4 parts by mass of the [conductive inorganic fine particles 1], 2 parts by mass of diisopropoxybis(ethylacetoacetate)titanium TC-750 (manufactured by Matsumoto Fine Chemical Co., Ltd.) as a catalyst, and 0.7 parts by mass of SH6020 (manufactured by Toray Silicone Co., Ltd.) as a silane coupling agent prepared from di-functional or tri-functional monomers were diluted with toluene to obtain a resin solution with a solid content of 10% by mass. This resin solution was coated on 1000 parts by mass of [core particles 2] by a dipping method using a multifunctional mixer. At this time, the carrier core temperature was set to 100° C., the resin solution was charged into the mixer, and a mixing stirring blade was rotated until the coating liquid evaporated to perform coating and stirring/drying treatment, and a carrier was taken out. The obtained carrier was fired at 180° C. for 2 hours in an electric furnace to obtain a carrier 2. This carrier 2 had a work function of 4.3 eV and SF-2 of 111, and the carrier bulk density was 2.46 $g/cm^3$.

<Preparation of Carrier 3>

26 parts by mass of a methyl silicone resin (Mw: 15,000, solid content: 25% by mass), 2.5 parts by mass of an acrylic resin (Hitaloid 3001, solid content: 50% by mass, manufactured by Hitachi Chemical Company, Ltd.), 5 parts by mass of a benzoguanamine-based resin (Mycoat 106, solid content: 77% by mass, manufactured by Mitsui Cytec Ltd.), 18 parts by mass of the [conductive inorganic fine particles 1], 2 parts by mass of diisopropoxybis(ethylacetoacetate)titanium TC-750 (manufactured by Matsumoto Fine Chemical Co., Ltd.) as a catalyst, and 0.2 parts by mass of SH16020 (manufactured by Toray Silicone Co., Ltd.) as a silane coupling agent prepared from bifunctional or tri-functional monomers were diluted with toluene to obtain a resin solution with a solid content of 10% by mass. This resin solution was coated on 1000 parts by mass of [core particles 2] by a dipping method using a multifunctional mixer. At this time, the carrier core temperature was set to 100° C., the resin solution was charged into the mixer, and a mixing stirring blade was rotated to perform coating and stirring/drying treatment until the coating liquid evaporated, and a carrier was taken out. The obtained carrier was fired at 180° C. for 2 hours in an electric furnace to obtain a carrier 3. This carrier 3 had a work function of 4.4 eV and SF-2 of 112, and the carrier bulk density was 2.44 $g/cm^3$.

<Preparation of Carrier 4>

12 parts by mass of a methyl silicone resin (Mw: 15,000, solid content: 25% by mass), 48 parts by mass of the [coating resin 1] (solid content: 25% by mass), 1 part by mass of diisopropoxybis(ethylacetoacetate)titanium TC-750 (manufactured by Matsumoto Fine Chemical Co., Ltd.) as a catalyst and 1.8 parts by mass of SH6020 (manufactured by Toray Silicone Co., Ltd.) as a silane coupling agent prepared from bifunctional or tri-functional monomers were diluted with toluene to obtain a resin solution with a solid content of 10% by mass. This resin solution was coated and dried, by using a fluidized-bed coating apparatus, on 1000 parts by mass of [core particles 3] while controlling the temperature in the fluidizing tank at 70° C. each. The obtained carrier was fired at 180° C. for 2 hours in an electric furnace to obtain a carrier 4. This carrier 4 had a work function of 4.0 eV and SF-2 of 139, and the carrier bulk density was 2.14 $g/cm^3$.

<Preparation of Carrier 5>

64 parts by mass of a methyl silicone resin (Mw: 15,000, solid content: 25% by mass), 56 parts by mass of the [conductive inorganic fine particles 1], 6 parts by mass of diisopropoxybis(ethylacetoacetate)titanium TC-750 (manufactured by Matsumoto Fine Chemical Co., Ltd.) as a catalyst, and 1.8 parts by mass of SH6020 (manufactured by Toray Silicone Co., Ltd.) as a silane coupling agent prepared from bi-functional or tri-functional monomers were diluted with toluene to obtain a resin solution with a solid content of 10% by mass. This resin solution was, by using a fluidized-bed coating apparatus, coated and dried on 1000 parts by mass of [core particles 1] while controlling the temperature in the fluidizing tank at 70° C. each. The obtained carrier was fired at 180° C. for 2 hours in an electric furnace to obtain a carrier 5. This carrier 5 had a work function of 4.0 eV and SF-2 of 114, and the carrier bulk density was 2.42 g/cm$^3$.

<Carrier Work Function Measuring Method>

The carrier work function We was measured by use of a work function measuring device (Surface Analyzer AC-2, manufactured by Riken Keiki Co., Ltd.) using a photoelectric effect. Specifically, a carrier was filled into a recess portion of a sample measurement cell (having a shape having a recess portion with a diameter of 10 mm and a depth of 1 mm in the center of a stainless steel-made disk with a diameter of 13 mm and a height of 5 mm), and the surface was smoothed by a knife edge. After the sample measurement cell filled with a carrier was fixed to a defined position on a sample table, the irradiation light amount was set to 500 nW, the irradiation area was provided as 4 mm square, and a measurement was performed under a condition of an energy scanning range of 3.4 eV to 6.2 eV.

Examples 1 to 22, Comparative Examples 1 to 4

Preparation of Developers 1 to 26

Developers 1 to 26 of examples 1 to 22 and comparative examples 1 to 4 were prepared in accordance with Tables 3-1 to 3-3 by mixing 70 parts by mass each of toner 1 to toner 26 and 930 parts by mass each of carrier 1 to carrier 5 were mixed for 5 minutes at 81 rpm by a TURBULA mixer. In addition, as a refill developer for each developer, a refill developer was fabricated by mixing so that the carrier concentration reaches 10% by mass.

Next, in accordance with Table 3-1 to 3-3, the obtained developers 1 to 26 were filled in developing devices including developer bearing members each made of a surface material of any of Al (Ws: 3.7 eV), SUS (Ws: 4.4 eV), and TiN (Ws: 4.7 eV), and evaluated for the initial stability and over-time stability against a hysteresis, and the low-temperature fixability (middle-speed machine), the over-time stability against a hysteresis to make comprehensive judgments in the following manner. The results are provided in Tables 3-1 to 3-3.

<Initial Stability and Over-Time Stability Against Hysteresis (Middle-Speed Machine)>

Figure 10A:
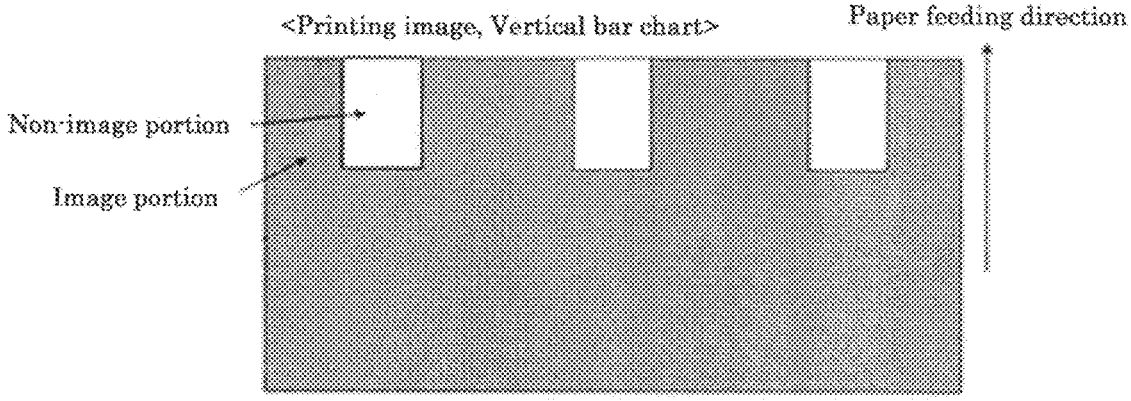
FIG. 10A is a view showing an example of a normal image by a vertical bar chart.
Figure 10B:
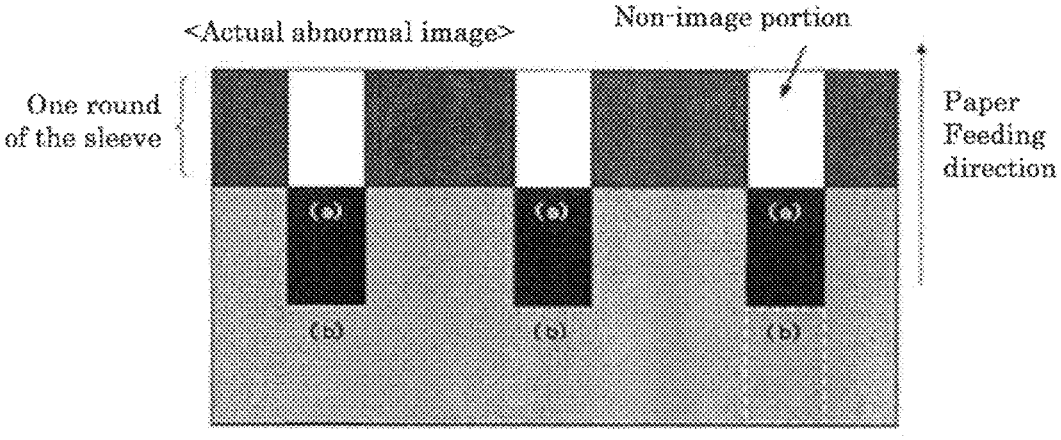
FIG. 10B is a view showing an example of an abnormal image by a vertical bar chart.

The prepared respective developers and refill developers were set in commercially available digital full-color printers (IMAGIO MPC6000, 50 sheets/minute of horizontal A4-size color images, manufactured by Ricoh Company, Ltd.), and 10 kp sheets of letter charts (the size of one letter: about 2 mm×2 mm) with an image area rate of 8% were printed, and then 200 kp sheets were further printed. In terms of hystereses, vertical bar charts shown in FIG. 10 were printed after 10 kp sheets of output and after 200 kp sheets of output, and concentration differences between an image portion after a non-image portion (first round of the sleeve) (a) and an image portion after a non-image portion (second round of the sleeve) (b) were respectively evaluated by X-Rite 938 (manufactured by X-Rite Inc.), using an average concentration difference of measurements at three locations of center, rear, and front as ΔID, on the following criteria, with ΔID after 10 kp sheets of output regarded as a hysteresis (initial stability, middle-speed machine), and ΔID after 200 kp sheets of output, as a hysteresis (over-time stability, middle-speed machine).

[Evaluation Criteria]

A: Very good, B: Good, C: Acceptable, D: Impractical

A, B, C: Pass, D: Fail

A: 0.01≥ΔID

B: 0.01≤ΔID 0.03

C, 0.03≤ΔID 0.06

D: 0.06≤ΔID

<Over-Time Stability Against Hysteresis (High-Speed Machine)>

The prepared respective developers and refill developers were set in commercially available digital full-color printers (RICOH Pro C901, 90 sheets/minute horizontal A4-size color images, manufactured by Ricoh Company, Ltd.), and 200 kp sheets of letter charts (the size of one letter: about 2 mm×2 mm) with an image area rate of 8% were printed. In terms of hystereses, vertical bar charts shown in FIG. 10A and FIG. 10B were printed after 200 kp sheets of output, and concentration differences between an image portion after a non-image portion (first round of the sleeve) (a) and an image portion after a non-image portion (second round of the sleeve) were respectively evaluated by X-Rite 938 (manufactured by X-Rite Inc.), using an average concentration difference of measurements at three locations of center, rear, and front as ΔID, on the following criteria, with ΔID after 10 kp sheets of output regarded as a hysteresis (initial stability, middle-speed machine), and ΔID after 200 kp sheets of output, as a hysteresis (over-time stability, middle-speed machine).

[Evaluation Criteria]

A: Very good, B: Good, C: Acceptable, D: Impractical

A, B, C: Pass, D: Fail

A: 0.01≥ΔID

B: 0.01≤ΔID 0.03

C: 0.03≤ΔID 0.06

D: 0.06≤ΔID

<Low-Temperature Fixability>

[Evaluation Criteria]

An apparatus for which an image forming apparatus (MF 2200, manufactured by Ricoh Company, Ltd.) using a Teflon (registered trademark) roller as a fixing roller was modified in the fixing section was used to test copying on recording paper (Type 6200, manufactured by Ricoh Company, Ltd.). Specifically, the fixing temperature was changed to determine a cold offset temperature (lower-limit fixing temperature). As evaluating conditions for the lower-limit fixing temperature, the linear speed of paper feeding was set to 120 mm/second to 150 mm/second, the surface pressure to 1.2 kgf/cm$^2$, and the nip width to 3 mm. The low-temperature fixability was evaluated on the following criteria. The lower the lower-limit fixing temperature, the more excellent in low-temperature fixability.

[Evaluation Criteria]

A: Very good, B: Good, C: Acceptable, D: Impractical

A, B, C: Pass, D: Fail

A: Lower-limit fixing temperature of less than 120° C.

B: Lower-limit fixing temperature of 120° C. or more and less than 130° C.

C: Lower-limit fixing temperature of 130° C. or more and less than 140° C.

D: Lower-limit fixing temperature of 140° C. or more and less than 150° C.

<Comprehensive Judgments>

AA: Extremely good, A: Very good, B: Good, C: Acceptable, D: Impractical

AA, A, B, C: Pass, D: Fail

AA: 3 or more As and no C or D

A: 2 As and no C or D

B: Other

C: 2 or more Cs and no A or D

D: 1 or more D

TABLE 2

| Carrier | Wc/eV | Carrier SF-2 | Carrier bulk density/ ($g/cm^3$) | Core particle SF-2 | Core particle Ra/um | Inorganic fine particle content/ parts by mass |
|---|---|---|---|---|---|---|
| Carrier 1 | 4.0 | 114 | 2.42 | 122 | 0.63 | 236 |
| Carrier 2 | 4.3 | 111 | 2.46 | 119 | 0.45 | 193 |
| Carrier 3 | 4.4 | 112 | 2.44 | 119 | 0.45 | 212 |
| Carrier 4 | 4.0 | 139 | 2.14 | 155 | 0.85 | 245 |
| Carrier 5 | 4.0 | 114 | 2.42 | 122 | 0.63 | 337 |

TABLE 3-1

| | Developing device | Toner | Developer | Toner base | External additive | Carrier | Developing sleeve | Ws-Wc (eV) | Image density Initial stability (Middle-speed machine) | Image density over-time stability (Middle-speed machine) | Image density over-time stability (High-speed machine) | Low-temp. fixability | Comprehensive judgment |
|---|---|---|---|---|---|---|---|---|---|---|---|---|---|
| Ex. 1 | Developing device 1 | Toner 1 | Developer 1 | Toner base 1 | External additive 3 | Carrier 1 | TiN | 0.7 | A | A | B | B | A |
| Ex. 2 | Developing device 2 | Toner 2 | Developer 2 | Toner base 1 | External additive 4 | Carrier 1 | TiN | 0.7 | A | A | B | B | A |
| Ex. 3 | Developing device 3 | Toner 3 | Developer 3 | Toner base 2 | External additive 2 | Carrier 4 | TiN | 0.7 | A | A | A | A | AA |
| Ex. 4 | Developing device 4 | Toner 4 | Developer 4 | Toner base 1 | External additive 1 | Carrier 5 | TiN | 0.7 | A | A | B | B | A |
| Ex. 5 | Developing device 5 | Toner 5 | Developer 5 | Toner base 1 | External additive 1 | Carrier 1 | SUS | 0.4 | A | B | B | B | B |
| Ex. 6 | Developing device 6 | Toner 6 | Developer 6 | Toner base 1 | External additive 1 | Carrier 2 | TiN | 0.4 | A | B | B | B | B |
| Ex. 7 | Developing device 7 | Toner 7 | Developer 7 | Toner base 2 | External additive 1 | Carrier 1 | SUS | 0.4 | B | B | C | A | B |
| Ex. 8 | Developing device 8 | Toner 8 | Developer 8 | Toner base 3 | External additive 1 | Carrier 1 | SUS | 0.4 | A | B | B | B | B |
| Ex. 9 | Developing device 9 | Toner 9 | Developer 9 | Toner base 4 | External additive 1 | Carrier 1 | SUS | 0.4 | B | C | C | A | B |
| Ex. 10 | Developing device 10 | Toner 10 | Developer 10 | Toner base 5 | External additive 1 | Carrier 1 | SUS | 0.4 | A | B | B | B | B |

TABLE 3-2

| | Developing device | Toner | Developer | Toner base | External additive | Carrier | Developing sleeve | Ws-Wc (eV) | Image density Initial stability (Middle-speed machine) | Image density over-time stability (Middle-speed machine) | Image density over-time stability (High-speed machine) | Low-temp. fixability | Comprehensive judgment |
|---|---|---|---|---|---|---|---|---|---|---|---|---|---|
| Ex. 11 | Developing device 11 | Toner 11 | Developer 11 | Toner base 6 | External additive 1 | Carrier 1 | SUS | 0.4 | B | B | C | A | B |
| Ex. 12 | Developing device 12 | Toner 12 | Developer 12 | Toner base 7 | External additive 1 | Carrier 1 | SUS | 0.4 | B | B | B | C | B |
| Ex. 13 | Developing device 13 | Toner 13 | Developer 13 | Toner base 8 | External additive 1 | Carrier 1 | SUS | 0.4 | B | C | C | B | C |
| Ex. 14 | Developing device 14 | Toner 14 | Developer 14 | Toner base 1 | External additive 6 | Carrier 1 | SUS | 0.4 | A | C | C | B | B |
| Ex. 15 | Developing device 15 | Toner 15 | Developer 15 | Toner base 1 | External additive 7 | Carrier 1 | SUS | 0.4 | A | B | C | C | B |
| Ex. 16 | Developing device 16 | Toner 16 | Developer 16 | Toner base 1 | External additive 8 | Carrier 1 | SUS | 0.4 | B | B | C | C | C |
| Ex. 17 | Developing device 17 | Toner 17 | Developer 17 | Toner base 1 | External additive 9 | Carrier 1 | SUS | 0.4 | A | C | C | B | B |
| Ex. 18 | Developing device 18 | Toner 18 | Developer 18 | Toner base 1 | External additive 10 | Carrier 1 | SUS | 0.4 | C | C | C | B | C |
| Ex. 19 | Developing device 19 | Toner 19 | Developer 19 | Toner base 1 | External additive 5 | Carrier 1 | SUS | 0.4 | B | B | C | B | B |
| Ex. 20 | Developing device 20 | Toner 20 | Developer 20 | Toner base 2 | External additive 2 | Carrier 1 | TiN | 0.7 | A | B | C | A | B |

TABLE 3-3

| | Developing device | Toner | Developer | Toner base | External additive | Carrier | Developing sleeve | Ws-Wc (eV) | Image density Initial stability (Middle-speed machine) | Image density over-time stability (Middle-speed machine) | Image density over-time stability (High-speed machine) | Low-temp. fixability | Comprehensive judgment |
|---|---|---|---|---|---|---|---|---|---|---|---|---|---|
| Ex. 21 | Developing device 21 | Toner 21 | Developer 21 | Toner base 2 | External additive 1 | Carrier 4 | SUS | 0.4 | A | B | B | A | A |
| Ex. 22 | Developing device 22 | Toner 22 | Developer 22 | Toner base 1 | External additive 10 | Carrier 4 | SUS | 0.4 | B | C | C | B | C |
| Comp. Ex. 1 | Developing device 23 | Toner 23 | Developer 23 | Toner base 1 | External additive 1 | Carrier 3 | TiN | 0.3 | B | C | D | B | D |
| Comp. Ex. 2 | Developing device 24 | Toner 24 | Developer 24 | Toner base 2 | External additive 1 | Carrier 3 | TiN | 0.3 | B | D | D | A | D |
| Comp. Ex. 3 | Developing device 25 | Toner 25 | Developer 25 | Toner base 1 | External additive 11 | Carrier 1 | SUS | 0.4 | B | D | D | B | D |
| Comp. Ex. 4 | Developing device 26 | Toner 26 | Developer 26 | Toner base 1 | External additive 12 | Carrier 1 | SUS | 0.4 | B | D | D | B | D |

It can be understood from Tables 3-1 to 3-3 that as compared with the developers of comparative examples 1 to 4, the developers of examples 1 to 22 could obtain good results in terms of the initial stability and over-time stability against a hysteresis and the over-time stability against a hysteresis in a high-speed machine.

Aspects of the present invention are, for example, as follows:

<1> A developing device, including:

a developer bearing member, which is disposed opposite to an electrostatic latent image bearing member and which bears thereon a developer for developing an electrostatic latent image formed on the electrostatic latent image bearing member and conveys the developer to a developing region, wherein the developer includes a toner and a carrier, the toner containing: a toner base containing a binder resin and a colorant; and an external additive, wherein the external additive contains coalescent particles each made up of a plurality of coalescing primary particles, and wherein a work function We of the carrier and a work function Ws of the developer bearing member satisfy a relationship of the following formula (1):

$$Ws-Wc \geq 0.4 \text{ eV} \tag{1}$$

<2> The developing device according to <1>, wherein the work function We of the carrier and the work function Ws of the developer bearing member satisfy a relationship of the following formula (I-1):

$$Ws-Wc \geq 0.6 \text{ eV} \tag{1-1}$$

<3> The developing device according to <1> or <2>, wherein the coalescent particles have a particle size distribution index expressed by the following formula (2):

$$\frac{Db_{50}}{Db_{10}} \leq 1.2 \tag{2}$$

where in the formula (2), in a distribution diagram in which particle diameters (nm) of the coalesced particles are on the horizontal axis and cumulative percentages (% by number) of the coalesced particles are on the vertical axis and in which the coalesced particles are accumulated from the coalesced particles having smaller particle diameters to the coalesced particles having larger particle diameters, $Db_{50}$ denotes a particle diameter of the coalesced particle at which the cumulative percentage is 50% by number, and $Db_{10}$ denotes a particle diameter of the coalesced particle at which the cumulative percentage is 10% by number.

<4> The developing device according to any one of <1> to <3>, wherein the coalescent particles satisfy the following formula (3):

$$\frac{N_x}{1000} \times 100 \leq 30 \ (\%) \tag{3}$$

where in the formula (3), Nx denotes the number of broken or collapsed particles in 1,000 of the coalescent particles, where the broken or collapsed particles are selected by stirring 10.5 g of the coalescent particles and 49.5 g of the carrier placed in a 50 mL-bottle by use of a rocking mill, which is manufactured by Seiwa Giken Co., Ltd., under conditions of 67 Hz and for 10 minutes, and then observing the stirred coalescent particles through a scanning electron microscope.

<5> The developing device according to any one of <1> to <4>, wherein the coalescent particles satisfy the following formula (3-1):

$$\frac{N_x}{1000} \times 100 \leq 20 \ (\%) \tag{3-1}$$

where in the formula (3-1), Nx denotes the number of broken or collapsed particles in 1,000 of the coalescent particles, where the broken or collapsed particles are selected by stirring 10.5 g of the coalescent particles and 49.5 g of the carrier placed in a 50 mL-bottle by use of a rocking mill, which is manufactured by Seiwa Giken Co., Ltd., under conditions of 67 Hz and for 10 minutes, and then observing the stirred coalescent particles through a scanning electron microscope.

<6> The developing device according to any one of <1> to <5>, wherein the coalescent particles have a number average particle diameter of 80 nm to 200 nm.

<7> The developing device according to any one of <1> to <6>, wherein the coalescent particles have a number average particle diameter of 100 nm to 160 nm.

<8> The developing device according to any one of <1> to <7>, wherein the binder resin contains a crystalline polyester resin.

<9> The developing device according to any one of <1> to <8>, wherein the carrier contains a magnetic core particle and a coating layer covering the core particle and has a shape factor SF-2 of 115 to 150 and a bulk density of 1.80 g/cm$^3$ to 2.40 g/cm$^3$, wherein the core particle has a shape factor SF-2 of 120 to 160 and has an arithmetic average surface roughness Ra of 0.5 μm to 1.0 and wherein the coating layer contains a resin and inorganic fine particles, and contains the inorganic fine particles at a rate of 50 parts by mass to 500 parts by mass to 100 parts by mass of the resin.

<10> An image forming apparatus, including:

an electrostatic latent image bearing member;

a charging unit configured to charge a surface of the electrostatic latent image bearing member;

an exposing unit configured to expose the charged surface of the electrostatic latent image bearing member to form an electrostatic latent image;

a developing unit configured to develop the electrostatic latent image with a toner to form a visible image;

a transferring unit configured to transfer the visible image to a recording medium; and a fixing unit configured to fix a transfer image transferred to the recording medium, wherein the developing unit is the developing device according to any one of <1> to <9>.

This application claims priority to Japanese application No. 2012-200356, filed on Sep. 12, 2012 and incorporated herein by reference.

The invention claimed is:

1. A developing device, comprising:

a developer bearing member, which is disposed opposite to an electrostatic latent image bearing member and which bears thereon a developer for developing an electrostatic latent image formed on the electrostatic latent image bearing member and conveys the developer to a developing region, wherein the developer comprises a toner and a carrier, the toner comprising: a toner base comprising a binder resin and a colorant; and an external additive, wherein the external additive comprises coalescent particles each made up of a plurality of coalescing primary particles, wherein a work function Wc of the carrier and a work function Ws of the developer bearing member satisfy a relationship of the following formula (1):

$$Ws - Wc \geq 0.4 \text{ eV} \quad (1)$$

and wherein said developing device satisfies at least one of the following conditions a), b) and c):

a) the coalescent particles have a particle size distribution index expressed by the following formula (2):

$$\frac{Db_{50}}{Db_{10}} \leq 1.2 \quad (2)$$

where in the formula (2), in a distribution diagram in which particle diameters (nm) of the coalesced particles are on the horizontal axis and cumulative percentages (% by number) of the coalesced particles are on the vertical axis and in which the coalesced particles are accumulated from the coalesced particles having smaller particle diameters to the coalesced particles having larger particle diameters, $Db_{50}$ denotes a particle diameter of the coalesced particle at which the cumulative percentage is 50% by number, and $Db_{10}$ denotes a particle diameter of the coalesced particle at which the cumulative percentage is 10% by number;

b) the coalescent particles satisfy the following formula (3):

$$\frac{N_x}{1000} \times 100 \leq 30 \ (\%) \quad (3)$$

where in the formula (3), Nx denotes the number of broken or collapsed particles in 1,000 of the coalescent particles, where the broken or collapsed particles are selected by stirring 10.5 g of the coalescent particles and 49.5 g of the carrier placed in a 50 mL-bottle by use of a rocking mill, which is manufactured by Seiwa Giken Co., Ltd., under conditions of 67 Hz and for 10 minutes, and then observing the stirred coalescent particles through a scanning electron microscope, and c) the coalescent particles satisfy the following formula (3-1):

$$\frac{N_x}{1000} \times 100 \leq 20 \ (\%) \quad (3\text{-}1)$$

where in the formula (3-1), Nx denotes the number of broken or collapsed particles in 1,000 of the coalescent particles, where the broken or collapsed particles are selected by stirring 10.5 g of the coalescent particles and 49.5 g of the carrier placed in a 50 mL-bottle by use of a rocking mill, which is manufactured by Seiwa Giken Co., Ltd., under conditions of 67 Hz and for 10 minutes, and then observing the stirred coalescent particles through a scanning electron microscope.

2. The developing device according to claim 1, wherein the work function We of the carrier and the work function Ws of the developer bearing member satisfy a relationship of the following formula (1-1):

$$Ws - Wc \geq 0.6 \text{ eV} \quad (1\text{-}1).$$

3. The developing device according to claim 1, wherein the coalescent particles have a particle size distribution index expressed by the following formula (2):

$$\frac{Db_{50}}{Db_{10}} \leqq 1.2 \quad (2)$$

where in the formula (2), in a distribution diagram in which particle diameters (nm) of the coalesced particles are on the horizontal axis and cumulative percentages (% by number) of the coalesced particles are on the vertical axis and in which the coalesced particles are accumulated from the coalesced particles having smaller particle diameters to the coalesced particles having larger particle diameters, $Db_{50}$ denotes a particle diameter of the coalesced particle at which the cumulative percentage is 50% by number, and $Db_{10}$ denotes a particle diameter of the coalesced particle at which the cumulative percentage is 10% by number.

4. The developing device according to claim 1, wherein the coalescent particles satisfy the following formula (3):

$$\frac{N_X}{1000} \times 100 \leqq 30(\%) \quad (3)$$

where in the formula (3), Nx denotes the number of broken or collapsed particles in 1,000 of the coalescent particles, where the broken or collapsed particles are selected by stirring 10.5 g of the coalescent particles and 49.5 g of the carrier placed in a 50 mL-bottle by use of a rocking mill, which is manufactured by Seiwa Giken Co., Ltd., under conditions of 67 Hz and for 10 minutes, and then observing the stirred coalescent particles through a scanning electron microscope.

5. The developing device according to claim 1, wherein the coalescent particles satisfy the following formula (3-1):

$$\frac{N_X}{1000} \times 100 \leqq 20(\%) \quad (3\text{-}1)$$

where in the formula (3-1), Nx denotes the number of broken or collapsed particles in 1,000 of the coalescent particles, where the broken or collapsed particles are selected by stirring 10.5 g of the coalescent particles and 49.5 g of the carrier placed in a 50 mL-bottle by use of a rocking mill, which is manufactured by Seiwa Giken Co., Ltd., under conditions of 67 Hz and for 10 minutes, and then observing the stirred coalescent particles through a scanning electron microscope.

6. The developing device according to claim 1, wherein the coalescent particles have a number average particle diameter of 80 nm to 200 nm.

7. The developing device according to claim 1, wherein the coalescent particles have a number average particle diameter of 100 nm to 160 nm.

8. The developing device according to claim 1, wherein the binder resin comprises a crystalline polyester resin.

9. A developing device, comprising:

a developer bearing member, which is disposed opposite to an electrostatic latent image bearing member and which bears thereon a developer for developing an electrostatic latent image formed on the electrostatic latent image bearing member and conveys the developer to a developing region, wherein the developer comprises a toner and a carrier, the toner comprising: a toner base comprising a binder resin and a colorant; and an external additive, wherein the external additive comprises coalescent particles each made up of a plurality of coalescing primary particles, and wherein a work function We of the carrier and a work function Ws of the developer bearing member satisfy a relationship of the following formula (1):

$$Ws - Wc \geq 0.4 \text{ eV} \quad (1)$$

wherein the carrier comprises a magnetic core particle and a coating layer covering the core particle and has a shape factor SF-2 of 115 to 150 and a bulk density of 1.80 $g/cm^3$ to 2.40 $g/cm^3$, wherein the core particle has a shape factor SF-2 of 120 to 160 and has an arithmetic average surface roughness Ra of 0.5 μm to 1.0 μm, and wherein the coating layer comprises a resin and inorganic fine particles, and contains the inorganic fine particles at a rate of 50 parts by mass to 500 parts by mass to 100 parts by mass of the resin.

10. An image forming apparatus, comprising:

an electrostatic latent image bearing member;

a charging unit configured to charge a surface of the electrostatic latent image bearing member;

an exposing unit configured to expose the charged surface of the electrostatic latent image bearing member to form an electrostatic latent image;

a developing device configured to develop the electrostatic latent image with a toner to form a visible image;

a transferring unit configured to transfer the visible image to a recording medium; and a fixing unit configured to fix a transfer image transferred to the recording medium, wherein the developing device is the developing device of claim 1

$$Ws - Wc \geq 0.4 \text{ eV} \quad (1).$$

* * * * *